US007155151B2

(12) United States Patent
Okamoto

(10) Patent No.: US 7,155,151 B2
(45) Date of Patent: Dec. 26, 2006

(54) DEVELOPER CARRIER, DEVELOPING DEVICE, IMAGE FORMING APPARATUS AND COMPUTER SYSTEM

(75) Inventor: Katsumi Okamoto, Nagano-ken (JP)
(73) Assignee: Seiko Epson Corporation, Tokyo (JP)

( * ) Notice: Subject to any disclaimer, the term of this patent is extended or adjusted under 35 U.S.C. 154(b) by 186 days.

(21) Appl. No.: 10/717,185

(22) Filed: Nov. 20, 2003

(65) Prior Publication Data

US 2005/0185980 A1 Aug. 25, 2005

(30) Foreign Application Priority Data

| | | |
|---|---|---|
| Nov. 20, 2002 | (JP) | P2002-336504 |
| Nov. 21, 2002 | (JP) | P2002-338500 |
| Nov. 25, 2002 | (JP) | P2002-340500 |
| Nov. 29, 2002 | (JP) | P2002-347538 |
| Dec. 10, 2002 | (JP) | P2002-357472 |
| Dec. 10, 2002 | (JP) | P2002-357476 |
| Dec. 10, 2002 | (JP) | P2002-357485 |
| Jan. 14, 2003 | (JP) | P2003-005719 |
| Jan. 28, 2003 | (JP) | P2003-018291 |

(51) Int. Cl.
*G03G 15/08* (2006.01)

(52) U.S. Cl. ..... 399/279; 399/286

(58) Field of Classification Search ..... 399/279–286
See application file for complete search history.

(56) References Cited

U.S. PATENT DOCUMENTS

| | | | |
|---|---|---|---|
| 5,287,150 | A | 2/1994 | Kinoshita et al. |
| 5,510,878 | A | 4/1996 | Noda et al. |

FOREIGN PATENT DOCUMENTS

| | | | |
|---|---|---|---|
| JP | 63-58384 | A | 3/1988 |
| JP | 06308816 | A * | 11/1994 |
| JP | 07-77846 | | 3/1995 |
| JP | 08-129306 | A | 5/1996 |
| JP | 10-3248 | A | 1/1998 |
| JP | 10-48933 | A | 2/1998 |
| JP | 2002-268319 | A | 9/2002 |

* cited by examiner

*Primary Examiner*—David M. Gray
*Assistant Examiner*—Ruth N LaBombard
(74) *Attorney, Agent, or Firm*—Sughrue Mion, PLLC

(57) ABSTRACT

A developer carrier includes: an opposing region that opposes a latent image-carryable region on an image carrier, and a solid portion that is solid at an end portion of the developer carrier in a longitudinal direction of the developer carrier. An end of the solid portion, which is on a side of a center of the developer carrier in the longitudinal direction, is located closer to the center of the developer carrier than an edge of the opposing region.

11 Claims, 46 Drawing Sheets

DEVELOPER CARRIER, DEVELOPING DEVICE, IMAGE FORMING APPARATUS AND COMPUTER SYSTEM

The present application is based on Japanese Patent Applications Nos. 2002-336504, 2002-338500, 2002-340500, 2002-347538, 2002-357472, 2002-357476, 2002-357485, 2003-005719 and 2003-018291, the entire contents of which are incorporated herein by reference.

BACKGROUND OF THE INVENTION

1. Field of the Invention

The present invention relates to a developer carrier, a developing device, an image forming apparatus and a computer system.

More specifically, the present invention relates to a developing device used in an image forming apparatus, in which toner is attached onto an electrostatic latent image formed on an image carrier to make the image visible.

2. Related Art

As this type of image forming apparatus, image forming apparatuses are known, for example as disclosed in Japanese Patent Publications Nos. JP S63-58384A and JP H10-48933A, that include plural developing devices that develop a latent image formed on a photosensitive body as an example of an image carrier with toner as an example of a developer, and which are disposed with a developing unit of a rotary format where these developing devices are radially disposed around a rotary shaft. In these image forming apparatuses, when an image signal is sent from an external device such as a host computer, the developing unit is rotated around the shaft, whereby one of the plural developing devices is positioned at a development position opposing the photosensitive body. Additionally, the latent image formed on the photosensitive body is developed to form a toner image and transferred onto an intermediate medium. At this time, the plural developing devices are successively switched to similarly repeat development and transfer, whereby plural toner images are superposed to form a color image.

In order to realize the aforementioned function of developing the latent image formed on the photosensitive body, the above-described developing devices include a developing roller as a developer carrier, a toner container, a toner supply roller, and a regulation blade as a developer charging member or the like. Additionally, the developing roller includes the function of carrying the toner and opposes the photosensitive body in order to appropriately develop, with the toner, the latent image formed on the photosensitive body. Also, in a format that conducts development in a state that the developing roller and the photosensitive body are not in contact, such as a jumping development format, a gap is present between the developing roller and the photosensitive body.

Incidentally, for whatever reason, there are cases where the space of the gap at the longitudinal-direction end portions of the developing roller is larger than the space at the longitudinal-direction center portion.

For example, the above-described situation arises when the developing roller is bent due to the regulation blade or the toner supply roller, which abuts against the developing roller along the longitudinal direction of the developing roller, pressing the developing roller towards the photosensitive body.

Also, although the developing roller rotates around the central axis thereof, deflection occurs in the developing roller due to this rotation. Due to this deflection, the space of the gap fluctuates by the rotational period of the developing roller.

The image density of the image formed by development fluctuates in accordance with the fluctuation in the space of the gap. However, whereas the fluctuation in the image density at the longitudinal-direction center portion of the developing roller is minute stemming from the fact that the space of the gap is small, the image density at the longitudinal-direction end portions fluctuates relatively largely stemming from the fact that the space of the gap is large. Additionally, the fluctuation in image density leads to unevenness of density having a periodicity and becomes visible.

Thus, there is a need for a method for realizing a developing roller that is suitable for suppressing the occurrence of uneven density appearing in the image.

Additionally, the regulation blade is fixed, by spot welding, to a support member for supporting the regulation blade and is attached to the developing device via the support member. In this state, the regulation blade abuts against the developing roller, imparts a charge to the toner carried on the developing roller, and regulates the layer thickness of the toner carried on the developing roller.

In a case that the regulation blade is fixed by spot welding to the support member, there are cases where the spot-welded position on the regulation blade determines the free length of the regulation blade. In this instance, the distance between the spot-welded position and the free end of the regulation blade in the lateral direction of the regulation blade becomes the free length. Additionally, fixing the free length along the longitudinal direction of the regulation blade contributes to the evenness of the pressure of the regulation blade on the developing roller.

However, because spot welding is ordinarily done by welding at plural points, of the positions in the longitudinal direction of the regulation blade, the pressure differs between the positions where spot welding has been conducted and the positions where spot welding has not been conducted, and there is the potential for the pressure in the longitudinal direction to become uneven.

Additionally, because the regulation blade is fixed to the support member, the rigidity of the support member is weak, and if flexure occurs in the support member, there is the potential for flexure to also occur in the regulation blade and for the pressure to become uneven.

Further, there is the potential for uneven pressure of the regulation blade arising as a result of these causes being compounded to cause the charge of the toner to become uneven, and such unevenness of the charge triggers drawbacks such as image deterioration, toner leakage and toner scattering.

Thus, in order to make the charge of the toner even, there is a need for a method for reducing unevenness of the pressure of the regulation blade on the developing roller.

Explanation is made on another structure of a conventional laser beam printer provided with a rotary development unit (see Japanese Patent Publications JP 2002-268319A, JP H10-3248A, and JP H08-129306A, for example). Similarly to the foregoing examples, such the laser beam printer has a rotary development unit, and the rotary development unit is loaded with a plurality of developing cartridges served as developing device respectively containing the different colors of toner. During printing, a required color of the rotary developing cartridge is positioned adjacent to the photosensitive body by rotating the rotary development unit, to cause the latent image formed on the photosensitive body to carry toner thereon. The toner is transferred from the photosensitive body through a transfer belt onto a sheet (printing medium) where fixed thereon.

The developing cartridge is provided with a supply roller and a developing roller. The toner is supplied to the developing roller through the supply roller, and then delivered from the developing roller onto the photosensitive body.

The developing cartridge generates heat due to rotational friction of the feed and developing rollers or by driving the other drive systems. If such heat accumulates within the developing cartridge, the toner is denatured by temperature rise, thus causing an adverse effect upon the quality of printing. Particularly, the developing roller, made of metal and hence small in specific heat, is ready to be hot in its surface. Moreover, because the toner delivered from the supply roller exists as a thin layer on the developing roller, the toner is readily denatured by heat.

Meanwhile, a helical gear is provided on the rotation shaft of the developing roller. By the action of the idle gear structured likewise by a helical gear in mesh therewith, the developing roller is urged toward the side of the gear position. By bringing the developing cartridge into abutment against an end abutment part, the developing cartridge is determined for its lengthwise position.

In the meanwhile, the developing cartridge is usually of a plastic material in a thermoplastic nature. Consequently, there encounters softening by the heat of friction or the like caused upon driving various constituent elements including rotating gears, readily causing a deformation in the housing part under the application of a load. Particularly, the support shaft of the idle gear is supported by end faces of the developing cartridge. When the developing roller is urged toward the gear by the action of the helical gear, the reaction of which causes the support shaft of the idle gear to act in a manner pushing the developing cartridge at its end face. With such a load application, there is a problem that the thermally softened end face of the developing cartridge is pushed into deformation.

Meanwhile, with this structure, because the end face of the developing roller is always in pressure-contact with the end abutment part, frictional heat is caused at between the developing roller end face and the end-abutment surface during rotation of the developing roller. The end abutment part, usually structured by a thermoplastic member, possibly softens into deformation due to the frictional heat. This results in a positional deviation of the developing roller in the lengthwise direction. Meanwhile, in case the developing roller end face and the end abutment part have a great frictional resistance, any of these are worn out. This can form a cause of a positional deviation of the developing roller or a cause to impede stable rotation of the developing roller.

Additionally, in order to adsorb toner on a peripheral surface, the supply roller and developing roller is pressure-contacted with an electric contact at an end face of the rotation shaft thereof, to which a charging bias voltage is applied thereby causing charge on the peripheral surface of the roller.

The conventional electric contact is formed nearly in the center of a linear-formed conductor plate. Because the both ends of the conductor plate are fixed to the end faces of the developing cartridge by screws or the like, in case the screw tightening force is strong at the both ends of the conductor plate, the electric contact positioned in the center is strongly pressed directly on the end face of the rotation shaft. Consequently, when the rotation shaft is rotated, there encounters a problem that the electric contact is overheated by the friction between the rotation-shaft end face and the electric contact or the electric contact is worn out into an open hole. In case the screw tightening force is weakened in order to solve the problem, there is a reduction in the contact force of the electric contact with the rotation-shaft end face, possibly causing a problem of shutting down of energization during service.

On the other hands, in such the conventional developing device, at a boundary portion between a developing region of the developing roller and a non-developing region (both ends of the developing roller), a seal member is provided in a gap between the developing roller and the developing device body thereby to prevent the toner around the developing roller in the developing region from leaking to the non-developing region (for example, JP H06-230665A).

However, the above conventional developing device has the following problems: The toner leaks from a small gap between the toner layer regulation blade and the seal member, and the toner disperses by centrifugal force caused by rotation of the developing roller, so that the inside of the device body is stained. Further, the toner is accumulated at both ends of the developing roller, and this accumulated toner is attached onto the photosensitive body and transferred onto both ends of a sheet.

In order to prevent these problems, in the above JP H06-230665A, a magnetism generator is arranged between the seal member and a developer container or the toner layer regulation blade, whereby the toner leakage and the toner dispersion are prevented. However, this causes troublesome assembly work and increase of cost.

Further, in such the developing device, a system is known in which the developing roller is rotatably held with the predetermined gap from the photosensitive body, preferably with a gap of 0.2 mm to 0.5 mm. For example, in JP H12-267439A, to both ends of the developing roller, distance keeping members having the thickness of 0.2 mm to 0.5 mm are rotatably fit, and the developing roller is brought into contact with the photosensitive body.

However, in the above conventional developing device, the frictional power between the developing roller and the distance keeping member increases by long use, and sliding performance of the distance keeping member lowers. Therefore, unevenness in speed is produced in the photosensitive body through the distance keeping member, so that there is a problem that a bad image is produced. Particularly, in case that a peripheral speed of the developing roller is set higher than the peripheral speed of the photosensitive body, this problem becomes large.

SUMMARY OF THE INVENTION

The present invention has been devised in light of the aforementioned problems, and it is an object thereof to realize an image forming apparatus and a computer system that suppress the occurrence of density unevenness appearing in a formed image. More specifically, it is an object of the invention to realize a developer carrier suitable for suppressing the occurrence of density unevenness appearing in an image, a developing device provided with the developer carrier, and a developer charging unit that makes the charge of the developer even.

The present invention provides a heat releasing device for a developing device which can efficiently release the heat caused in the developing device.

The present invention provides a developing device deformation preventing device for preventing the end face of a thermally-softened developing device from deforming by resisting to the force of the idle-gear support shaft pressing the developing device end face, and a developing device having the same.

The present invention provides a developing-roller frictional-heat-generation suppressing device for reducing the frictional heat generation at between the end face of developing roller and the end abutment part to a possible low extent and thereby allowing for smooth, stable rotation of the developing roller, and a developing device having the same.

The present invention provides an electric-contact urging device on rotation shaft which can maintain, over a long term, the contact-pressure of the electric contact with the end face of rotation shaft in a degree not to open a hole in the electric contact due to friction, and a developing device having the same device.

The present invention provides seal structure of developing device in which toner leakage and toner dispersion from developing roller both ends can be prevented with simple constitution and at a low cost.

The present invention provides a developing device having a developing roller with a predetermined gap from a photosensitive body, in which the frictional power between a developing roller and a distance keeping member can be reduced, and unevenness in speed of the photosensitive body can be eliminated.

The invention is provided with a developer carrier for carrying a developer, the developer carrier including: an opposing region that opposes a latent image-carryable region on an image carrier; and solid portions that are solid at longitudinal-direction end portions of the developer carrier, wherein the positions of ends of the solid portions near the longitudinal-direction center are closer to the longitudinal-direction center than the positions of ends of the opposing region.

Other features of the invention will be made apparent by the description of the specification and the attached drawings.

The invention provides a developer carrier for carrying a developer, the developer carrier including: an opposing region that opposes a latent image-carryable region on an image carrier; and solid portions that are solid at longitudinal-direction end portions of the developer carrier, wherein the positions of ends of the solid portions near the longitudinal-direction center are closer to the longitudinal-direction center than the positions of ends of the opposing region.

Because the positions of ends of the solid portions near the longitudinal-direction center are closer to the longitudinal-direction center than the positions of ends of the opposing region, it becomes possible to realize a developer carrier suitable for suppressing the occurrence of density unevenness appearing in an image.

Also, the developer carrier may be formed by fitting solid axial members into both longitudinal-direction end portions of a hollow roller.

By forming the developer carrier in this manner, it becomes possible to easily achieve the aforementioned effect—i.e., the effect that a developer carrier suitable for suppressing the occurrence of density unevenness in an image can be realized.

Also, the developer carrier may be manufactured by at least one of cutting and polishing being conducted.

In this case, the action resulting from an improvement in processing precision becomes more effectively exhibited.

Next, developing device disposed with a developer carrier for carrying a developer, the developer carrier including an opposing region that opposes a latent image-carryable region on an image carrier, and solid portions that are solid at longitudinal-direction end portions of the developer carrier, with the developing device developing, with the developer carried on the developer carrier, a latent image carried in the latent image-carryable region, wherein the positions of ends of the solid portions near the longitudinal-direction center are closer to the longitudinal-direction center than the positions of ends of the opposing region.

By configuring the developing device in this manner, a developing device that exhibits the aforementioned effect can be realized.

Also, the developer carrier may be formed by fitting solid axial members into both longitudinal-direction end portions of a hollow roller.

By forming the developer carrier in this manner, a developing device that exhibits the aforementioned effect can be realized.

Also, the developer carrier may be manufactured by at least one of cutting and polishing being conducted.

In this case, the action resulting from an improvement in processing precision becomes more effectively exhibited.

Also, the developing device may include an abutment member that abuts against the developer carrier along the longitudinal direction of the developer carrier, and the developer carrier may be supported at both longitudinal-direction end portions of the developer carrier and abutted against by the abutment member along the longitudinal direction of the developer carrier.

In this case, because a development gap becomes more even in the longitudinal direction of the developer carrier, not only the development gap at the longitudinal-direction center portion but also the development gap at the longitudinal-direction end portions can be made smaller. Thus, density unevenness generated by a fluctuation in image density becomes further suppressed.

Also, the abutment member may press the developer carrier towards the image carrier.

In this case, the function where the configuration of the developer carrier, in which the solid portions of the developer carrier are disposed as far as inside the opposing region, reduces flexure of the developer carrier is more effectively exhibited.

Also, the abutment member may be a developer supply member for supplying the developer to the developer carrier.

In a case that the developer carrier is abutted against by the developer supply member along the longitudinal direction of the developer carrier, the development gap becomes more even in the longitudinal direction of the developer carrier due to the action pertaining to the configuration of the developer carrier. Thus, not only the development gap at the longitudinal-direction center portion but also the development gap at the longitudinal-direction end portions can be made smaller. Thus, density unevenness generated by a fluctuation in image density becomes further suppressed.

Also, the abutment member may be a layer thickness regulating member for regulating the layer thickness of the developer carried on the developer carrier.

In a case that the developer carrier is abutted against by the layer thickness regulating member along the longitudinal direction of the developer carrier, the development gap becomes more even in the longitudinal direction of the developer carrier due to the action pertaining to the configuration of the developer carrier. Thus, not only the development gap at the longitudinal-direction center portion but also the development gap at the longitudinal-direction end portions can be made smaller. Thus, density unevenness generated by a fluctuation in image density becomes further suppressed.

Also, the developer carrier may be made of metal.

In a case that the developer carrier is made of metal, because the potential for the developer carrier to become easy to bend, due to the elasticity of the developer carrier becoming lower, and for the development gap at the longitudinal-direction end portions of the developer carrier to become larger than the development gap at the longitudinal-direction center portion rises, it becomes easy for density unevenness having a periodicity to occur. Thus, the aforementioned effect—i.e., the effect that a developer carrier suitable for suppressing the occurrence of density unevenness appearing in an image can be realized—is more effectively exhibited.

Also, the developing device may develop the latent image carried in the latent image-carryable region in a state that the developer carrier and the image carrier are not in contact. By configuring the invention in this manner, in a case that the developing device develops the latent image with the developer in a state that the developer carrier and the image carrier are not in contact, it becomes possible to appropriately achieve the aforementioned effect—i.e., the effect that a developer carrier suitable for suppressing the occurrence of density unevenness appearing in an image can be realized.

Also, a developing device is also realizable where the developing device is disposed with a developer carrier for carrying a developer, the developer carrier including an opposing region that opposes a latent image-carryable region on an image carrier, and solid portions that are solid at longitudinal-direction end portions of the developer carrier, with the developing device developing, with the developer carried on the developer carrier, a latent image carried in the latent image-carryable region, wherein the positions of ends of the solid portions near the longitudinal-direction center are closer to the longitudinal-direction center than the positions of ends of the opposing region, the developer carrier is formed by fitting solid axial members into both longitudinal-direction end portions of a hollow roller, the developer carrier is manufactured by at least one of cutting and polishing being conducted, the developing device includes an abutment member that abuts against the developer carrier along the longitudinal direction of the developer carrier, and the developer carrier is supported at both longitudinal-direction end portions of the developer carrier and is abutted against by the abutment member along the longitudinal direction of the developer carrier, the abutment member presses the developer carrier towards the image carrier, the abutment member is a developer supply member for supplying the developer to the developer carrier, the developer carrier is made of metal, and the developing device develops the latent image carried in the latent image-carryable region in a state that the developer carrier and the image carrier are not in contact.

Also, an image forming apparatus is also realizable where the image forming apparatus includes an image carrier for carrying a latent image, and a developer carrier for carrying a developer, the developer carrier including an opposing region that opposes a latent image-carryable region on the image carrier and solid portions that are solid at longitudinal-direction end portions of the developer carrier, with the image forming apparatus being disposed with a developing device that develops, with the developer carried on the developer carrier, a latent image carried in the latent image-carryable region, wherein the positions of ends of the solid portions near the longitudinal-direction center are closer to the longitudinal-direction center than the positions of ends of the opposing region.

By configuring the invention in this manner, an image forming apparatus exhibiting the aforementioned effect can be realized.

Also, a computer system is also realizable where the computer system includes a computer mainframe, a display device connectable to the computer mainframe and an image forming apparatus connectable to the computer mainframe, the image forming apparatus including an image carrier for carrying a latent image and a developer carrier for carrying a developer, the developer carrier including an opposing region that opposes a latent image-carryable region on the image carrier and solid portions that are solid at longitudinal-direction end portions of the developer carrier, with the image forming apparatus being disposed with a developing device that develops, with the developer carried on the developer carrier, a latent image carried in the latent image-carryable region, wherein the positions of ends of the solid portions near the longitudinal-direction center are closer to the longitudinal-direction center than the positions of ends of the opposing region.

The computer system realized in this manner becomes a system that is more excellent as an overall system than conventional systems.

Another aspect of the invention is a developing device that includes a developer carrier for carrying a developer and develops, with the developer carried on the developer carrier, a latent image carried on an image carrier in a state that the developer carrier and the image carrier are not in contact, wherein the deflection amount of the developer carrier at longitudinal-direction end portions of the developer carrier is smaller than the deflection amount at a longitudinal-direction center portion of the developer carrier.

The invention provides a developing device that includes a developer carrier for carrying a developer and develops, with the developer carried on the developer carrier, a latent image carried on an image carrier in a state that the developer carrier and the image carrier are not in contact, wherein the deflection amount of the developer carrier at longitudinal-direction end portions of the developer carrier is smaller than the deflection amount at a longitudinal-direction center portion of the developer carrier.

Because the deflection amount of the developer carrier at longitudinal-direction end portions of the developer carrier is smaller than the deflection amount at a longitudinal-direction center portion of the developer carrier, it becomes possible to effectively suppress density unevenness appearing in an image.

Also, the developing device may include an abutment member that abuts against the developer carrier along the longitudinal direction of the developer carrier, and the developer carrier may be supported at both longitudinal-direction end portions of the developer carrier and abutted against by the abutment member along the longitudinal direction of the developer carrier.

In this situation, because the potential for the developer carrier to become easy to bend and for the development gap at the longitudinal-direction end portions of the developer carrier to become larger than the development gap at the longitudinal-direction center portion rises, it becomes easy for density unevenness having a periodicity to occur. Thus, the aforementioned effect—i.e., the effect of effectively suppressing the occurrence of density unevenness appearing in an image—is more effectively exhibited.

Also, the abutment member may press the developer carrier towards the image carrier.

In this situation, because the potential for the development gap at the longitudinal-direction end portions of the developer carrier to become larger than the development gap at the longitudinal-direction center portion further rises, it becomes easy for density unevenness having a periodicity to occur. Thus, the aforementioned effect—i.e., the effect of effectively suppressing the occurrence of density unevenness appearing in an image—is more effectively exhibited.

Also, the abutment member may be a developer supply member for supplying the developer to the developer carrier.

In this situation, because the potential for the developer carrier to become easy to bend, due to the developer supply member abutting against the developer carrier along the longitudinal direction of the developer carrier, and for the development gap at the longitudinal-direction end portions of the developer carrier to become larger than the development gap at the longitudinal-direction center portion rises, it becomes easy for density unevenness having a periodicity to occur. Thus, the aforementioned effect—i.e., the effect of effectively suppressing the occurrence of density unevenness appearing in an image—is more effectively exhibited.

Also, the abutment member may be a layer thickness regulating member for regulating the layer thickness of the developer carried on the developer carrier.

In this situation, because the potential for the developer carrier to become easy to bend, due to the layer thickness regulating member abutting against the developer carrier along the longitudinal direction of the developer carrier, and for the development gap at the longitudinal-direction end portions of the developer carrier to become larger than the development gap at the longitudinal-direction center portion rises, it becomes easy for density unevenness having a periodicity to occur. Thus, the aforementioned effect—i.e., the effect of effectively suppressing the occurrence of density unevenness appearing in an image—is more effectively exhibited.

Also, the developer carrier may be made of metal.

In a case that the developer carrier is made of metal, because the potential for the developer carrier to become easy to bend, due to the elasticity of the developer carrier becoming lower, and for the development gap at the longitudinal-direction end portions of the developer carrier to become larger than the development gap at the longitudinal-direction center portion rises, it becomes easy for density unevenness having a periodicity to occur. Thus, the aforementioned effect—i.e., the effect of effectively suppressing the occurrence of density unevenness appearing in an image—is more effectively exhibited.

Also, the latent image carried on the image carrier may be developed with the developer using a jumping development format.

By configuring the invention in this manner, it becomes possible to appropriately develop the latent image by using a jumping development format.

Also, a developing device is also realizable where the developing includes a developer carrier for carrying a developer and develops, with the developer carried on the developer carrier, a latent image carried on an image carrier in a state that the developer carrier and the image carrier are not in contact, wherein the deflection amount of the developer carrier at longitudinal-direction end portions of the developer carrier is smaller than the deflection amount at a longitudinal-direction center portion of the developer carrier, the developing device includes an abutment member that abuts against the developer carrier along the longitudinal direction of the developer carrier, the developer carrier is supported at both longitudinal-direction end portions of the developer carrier and is abutted against by the abutment member along the longitudinal direction of the developer carrier, the abutment member presses the developer carrier towards the image carrier, the abutment member is a developer supply member for supplying the developer to the developer carrier, the developer carrier is made of metal, and the latent image carried on the image carrier is developed with the developer using a jumping development format.

Also, a developer carrier is also realizable where the developer carrier carries a developer for developing a latent image carried on an image carrier in a state that the developer carrier and the image carrier are not in contact, wherein the deflection amount of the developer carrier at longitudinal-direction end portions of the developer carrier is smaller than the deflection amount at a longitudinal-direction center portion of the developer carrier.

By configuring the developer carrier in this manner, a developer carrier exhibiting the aforementioned effect can be realized.

Also, an image forming apparatus is also realizable where the image forming apparatus includes an image carrier for carrying a latent image and a developer carrier for carrying a developer, the image forming apparatus being disposed with a developing device that develops, with the developer carried on the developer carrier, a latent image carried on the image carrier in a state that the developer carrier and the image carrier are not in contact, wherein the deflection amount of the developer carrier at longitudinal-direction end portions of the developer carrier is smaller than the deflection amount at a longitudinal-direction center portion of the developer carrier.

By configuring the image forming apparatus in this manner, an image forming apparatus exhibiting the aforementioned effect can be realized.

Also, a computer system is also realizable where the computer system includes a computer mainframe, a display device connectable to the computer mainframe and an image forming apparatus connectable to the computer mainframe, the image forming apparatus including an image carrier for carrying a latent image and a developer carrier for carrying a developer, with the image forming apparatus being disposed with a developing device that develops, with the developer carried on the developer carrier, a latent image carried on the latent image-carryable region, wherein the deflection amount of the developer carrier at longitudinal-direction end portions of the developer carrier is smaller than the deflection amount at a longitudinal-direction center portion of the developer carrier.

The computer system realized in this manner becomes a system that is more excellent as an overall system than conventional systems.

Another aspect of the invention is a developer charging unit including a developer charging member for charging a developer carried on a developer carrier and a support member for supporting the developer charging member, with the developer charging member and the support member being fixed by spot welding, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member.

The invention provides a developer charging unit including a developer charging member for charging a developer carried on a developer carrier and a support member for supporting the developer charging member, with the developer charging member and the support member being fixed by spot welding, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member.

Because the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member, it becomes possible to make the charge of the developer even.

Also, it is preferable for the free length determining member to include an abutment portion for abutting against the developer charging member, and for the distance from an end of the abutment portion closest to a free length end of the developer charging member to the free length end to be shorter than the distance from a fixed portion, at which the developer charging member and the support member are fixed, to the free length end.

By configuring the invention in this manner, the free length determining member can reliably determine the free length rather than the fixed portion.

Also, the developer charging member may be nipped between the free length determining member and the support member.

By configuring the invention in this manner, because the developer charging member is stably supported and it becomes difficult for flexure to arise in the developer charging member, it becomes possible to further make the pressure of the developer charging member on the developer carrier even. Consequently, the charge of the developer can be made more even.

Also, the developer charging member may include an elastic body that abuts against the surface of the developer carrier and an elastic body support member for supporting the elastic body, with the elastic body support member being nipped between the free length determining member and the support member.

By configuring the invention in this manner, because the elastic body support member is stably supported and it becomes difficult for flexure to arise in the elastic body support member, it becomes possible to further make the pressure of the developer charging member on the developer carrier even. Consequently, the charge of the developer can be made more even.

Also, the thickness of the elastic body support member is 1 mm or less. In a case that the thickness of the elastic body support member is 1 mm or less, it becomes easy for the developer charging member to be affected by the flexure of the support member due to the thinness of the elastic body support portion. Thus, the aforementioned effect—i.e., the effect of suppressing the occurrence of flexure of the support member, so that it becomes possible to reduce the flexure of the developer charging member supported by the support member and make the charge of the developer even-becomes more effectively exhibited.

Also, the abutment portion and the developer charging member may be fixed by spot welding.

By configuring the invention in this manner, because the developer charging member is stably supported and it becomes difficult for flexure to arise in the developer charging member, it becomes possible to further make the pressure of the developer charging member on the developer carrier even. Consequently, the charge of the developer can be made more even.

Also, the developer charging member and the support portion may be fixed by spot welding at plural places along the longitudinal direction of the developer charging member. In this case, there is the potential for the developer charging member to become bent along the line joining the plural spot-welded places. In this situation, because the free length of the developer charging member is determined by the spot-welded positions on the developer charging member, the charge of the developer becomes more uneven. Thus, the aforementioned effect—i.e., the effect that it becomes possible to make the charge of the developer even by disposing the free length determining member in the toner charging unit and determining the free length with the free length determining member rather than the spot-welded positions on the regulation blade—becomes more effectively exhibited.

Also, the support member may be fixed by screws to the free length determining member at both longitudinal-direction end portions of the support member.

In this case, the free length is reliably determined by the free length determining member.

Also, the spot welding may be laser welding.

By using laser welding, accurate and precise control becomes possible and one is liberated from the difficulty of welding together plates whose materials are different and whose thicknesses are different.

Also, a developer charging unit is also realizable where the developer charging unit includes a developer charging member for charging a developer carried on a developer carrier and a support member for supporting the developer charging member, with the developer charging member and the support member being fixed by spot welding, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, the developer charging unit includes a free length determining member for determining a free length of the developer charging member, the free length determining member includes an abutment portion for abutting against the developer charging member, and the distance from an end of the abutment portion closest to a free length end of the developer charging member to the free length end is shorter than the distance from a fixed portion, at which the developer charging member and the support member are fixed, to the free length end, the developer charging member includes an elastic body that abuts against the surface of the developer carrier and an elastic body support member for supporting the elastic body, with the elastic body support member being nipped between the free length determining member and the support member, the thickness of the elastic body support member is 1 mm or less, the developer charging member and the support portion are fixed by spot welding at plural places along the longitudinal direction of the developer charging member, the support member is fixed by screws to the free length determining member at both longitudinal-direction end portions of the support member, and the spot welding is laser welding.

By configuring the invention in this manner, the object of the invention is more effectively achieved because the invention exhibits most of the aforementioned effects.

Also, a developing device is also realizable where the developing devices includes a developer carrier for carrying a developer, and a charging unit that includes a developer charging member for charging the developer carried on the developer carrier and a support member for supporting the developer charging member and in which the developer charging member and the support member are fixed by spot welding, with the developing device developing, with the developer carried on the developer carrier, a latent image carried on an image carrier, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member.

By configuring the developing device in this manner, a developing device exhibiting the aforementioned function can be realized.

Also, an image forming apparatus is also realizable where the image forming apparatus includes an image carrier for carrying a latent image, a developer carrier for carrying a developer, and a developer charging unit that includes a developer charging member for charging the developer carried on the developer carrier and a support member for supporting the developer charging member and in which the developer charging member and the support member are fixed by spot welding, with the image forming apparatus developing, with the developer carried on the developer carrier, the latent image carried on the image carrier, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member.

By configuring the image forming apparatus in this manner, an image forming apparatus exhibiting the aforementioned function can be realized.

Also, a computer system is also realizable where the computer system includes a computer mainframe, a display device connectable to the computer mainframe and an image forming apparatus connectable to the computer mainframe, the image forming apparatus including an image carrier for carrying a latent image, a developer carrier for carrying a developer, and a developer charging unit that includes a developer charging member for charging the developer carried on the developer carrier and a support member for supporting the developer charging member and in which the developer charging member and the support member are fixed by spot welding, with the image forming apparatus developing, with the developer carried on the developer carrier, the latent image carried on the image carrier, wherein the support member includes a first bent portion and a second bent portion that are formed by bending a rectangular member along a longitudinal direction thereof, the support portion supports the developer charging member and the direction in which the first bent portion is bent is the opposite direction of the direction in which the second bent portion is bent, and the developer charging unit includes a free length determining member for determining a free length of the developer charging member.

The computer system realized in this manner becomes a system that is more excellent as an overall system than conventional systems.

A developing device according to the present invention is a developing device in a rotary development unit that, by rotating a plurality of developing devices in a loaded state about a rotary shaft, a selected one of the developing devices is placed adjacent to a photosensitive body in an image forming apparatus so that toner within the selected developing device can be moved onto the photosensitive body, a heat releasing device of a developing device wherein the developing device comprising: a housing having a peripheral surface and two end faces at the both sides of the peripheral surface; a toner container formed in the housing and containing toner; a roller for supplying the toner in the toner container onto the photosensitive body; and a gear provided on a metal rotation shaft of the roller outside the housing, for rotatively driving the roller; the gear having a double-layer structure constructed by an outer part formed, of resin, with gear teeth in an outer periphery and an inner part of sintered metal positioned inside of the outer part, the inner part being inserted by and fixed with the rotation shaft of the roller.

According to the invention, because the heat generated within the developing device conducts through a metal rotation shaft, to be released at an inner part of the gear, excessive heating can be prevented at the inside of the developing device. Also, by merely press-fitting the roller rotation shaft in the inner part made of sintered metal, the rotation shaft and the gear can be fixed together.

A heat releasing device of a developing device according to the invention is that the roller for supplying toner onto the photosensitive body is a supply roller provided adjacent to the toner container and having a rotation shaft rotatably supported by the two end faces and a developing roller having a peripheral surface in contact with a peripheral surface of the supply roller and a rotation shaft rotatably supported by the two end faces. According to the invention, because the toner carried thin over the surface of the feed and developing rollers can be prevented from thermally denaturing, high quality of printing is realized.

A heat releasing device of a developing device according to the invention is that the gear in the double-layer structure is a developing-roller driving gear for driving the developing roller. The surface of the developing roller is of metal and small in specific heat, and hence readily becomes hot. By adopting the heat releasing structure of such a developing-roller driving gear, the surface of the developing roller can be prevented from being overheated. Toner transfer can be positively made onto the photosensitive body.

A heat releasing device of a developing device according to the invention is that the developing-roller driving gear has a peripheral surface formed with first and second gear parts different in diameter and adjacent with respect to a rotation axis direction, the inner part lying astride the first and second gear parts. According to the invention, after die-molding a resin outer part of a first and second gear part, the inner part during cooling can be made uniform in inner diameter without affected by the phenomenon called "sink mark" resulting from a difference in thickness between the two gear parts. Furthermore, error is less caused in the outer diameter of the gear. Accordingly, accuracy is improved for the bearing of the developing-roller driving gear and gear itself, making it possible to prevent the chatter in the developing-roller rotation shaft and mismatching in gear meshing resulting from "sink mark" phenomenon.

A heat releasing device of a developing device according to the invention is that the gear in the double-layer structure is formed by insert-molding an outer part member in a state the inner part is present. According to this structure, because the inner part is not changed in form during forming the outer part, accuracy can be maintained for the bearing of the developing-roller driving gear.

A developing device of the invention has a heat releasing device as described above. According to the invention, because the heat within the developing device is released to the outside through the heat releasing device, toner less undergoes thermal denaturing. Thus, high quality of printing is realized.

A deformation preventing device of a developing device according to the invention is a developing device in a rotary development unit that, by rotating a plurality of developing devices in a loaded state about a rotary shaft, a selected one of the developing devices is placed adjacent to a photosensitive body in an image forming apparatus so that toner within the selected developing device can be moved onto the photosensitive body, a deformation preventing device of a developing device wherein the developing device comprising: a housing having a peripheral surface and two end faces at the both sides of the peripheral surface; a toner container formed in the housing and containing toner; a supply roller provided adjacent to the toner container and having a rotation shaft rotatably supported by the two end faces; a developing roller having a peripheral surface in contact with the peripheral surface of the supply roller and having a rotation shaft rotatably supported by the two end faces; a developing-roller driving gear provided at one end of the rotation shaft of the developing roller and having a first gear part formed with helical teeth on a peripheral surface thereof; and an intermediate gear provided on a same side as the first gear part of the developing-roller driving gear, and having a rotation shaft supported by the end faces of the housing, and a peripheral surface formed with helical teeth in mesh with the first gear, for receiving a drive force from a driving source; the helical teeth on the first gear of the developing-roller driving gear and the helical teeth on the intermediate gear being formed in a direction to urge the developing roller toward the first gear; a deformation preventing device being provided in a state restricted in axial movement on the support shaft of the intermediate gear, the deformation preventing device being in abutment against an end outer face of the housing on a side the intermediate gear is provided.

A deformation preventing device of a developing device according to the invention is a developing device in a rotary development unit that, by rotating a plurality of developing devices in a loaded state about a rotary shaft, a selected one of the developing devices is placed adjacent to a photosensitive body in an image forming apparatus so that toner within the selected developing device can be moved onto the photosensitive body, a deformation preventing device of a developing device wherein the developing device comprising: a housing having a peripheral surface and two end faces at the both sides of the peripheral surface; a toner container formed in the housing and containing toner; a supply roller provided adjacent to the toner container and having a rotation shaft rotatably supported by the two end faces; a developing roller having a peripheral surface in contact with the peripheral surface of the supply roller and having a rotation shaft rotatably supported by the two end faces; a supply-roller driving gear provided at one end of the rotation shaft of the developing roller and formed with spur teeth on a peripheral surface thereof; a developing-roller driving part provided at one end of the rotation shaft of the developing roller and having a second gear part formed on a peripheral surface with spur teeth in mesh with the supply-roller driving gear and a first gear part provided adjacent to the second gear part and formed with helical teeth on a peripheral surface thereof; and an intermediate gear provided on a same side as the first gear part of the developing-roller driving gear and having a rotation shaft supported by the end faces of the housing, and a peripheral surface formed with helical teeth in mesh with the first gear, for receiving a drive force from a driving source; the helical teeth on the first gear of the developing-roller driving gear and the helical teeth on the intermediate gear being formed in a direction to urge the developing roller toward the first gear; a deformation preventing device being provided in a state restricted in axial movement on the support shaft of the intermediate gear, the deformation preventing device being in abutment against an end outer face of the housing on a side the intermediate gear is provided.

By the meshing action of the first gear helical teeth on the developing roller and the intermediate gear helical teeth, the developing roller is urged toward the first gear. By the reaction thereof, the intermediate-gear support shaft acts to press the housing end face. According to the invention, the deformation preventing device is provided on the intermediate-gear support shaft, in a state restricted from moving in the axial direction. The deformation preventing device is provided in abutment against the end outer face of the housing at the side the intermediate gear is provided. Accordingly, the force applied in the direction pressing the housing end face to the intermediate-gear support shaft is dispersed to the deformation preventing device. By evenly dispersing the force to the housing end outer face, the housing end face can be prevented from being locally deformed.

A deformation preventing device of a developing device according to the invention is that the intermediate gear is rotatable about the support shaft of the intermediate gear, the deformation preventing device having a pressure dispersing plate placed in abutment against an outer surface of the housing at an area sufficiently broader than a section of the support shaft of the intermediate gear.

According to the invention, the rotation force on the intermediate gear is not delivered to the support shaft, and hence no rotation force is caused in the deformation preventing device. The force the intermediate-gear support shaft presses the housing end face only is delivered to the pressure dispersing plate as a deformation preventing device. By dispersing the force to the area sufficiently broader than the section of the intermediate-gear support shaft, relieved is the pressure exerted per unit area to the housing end face thereby preventing the deformation in the housing end face.

A deformation preventing device of a developing device according to the invention is that the support shaft of the intermediate gear is fixed with a holding part, by the holding part the pressure dispersing plate being urged on the end outer face of the housing.

According to the invention, the force the intermediate-gear support shaft presses the housing end face is conveyed to the pressure dispersing plate through the holding part fixed on the support shaft. As a result of dispersion to the housing end face similarly to the above, the housing end face can be prevented from being deformed.

A deformation preventing device of a developing device according to the invention is that the pressure dispersing plate is a metal plate.

According to the invention, by merely providing a metal plate to the housing end outer face in the existing structure around the intermediate gear, the developing device can be effectively prevented from being deformed.

A developing device according to the invention has a deformation preventing device as described above.

According to the invention, because it is possible to provide a developing device not to be deformed in the end face by thermal influence, smooth rotation of the supply and developing rollers can be maintained. Thus, stable toner supply can be realized over a long term.

An image forming apparatus according to the invention uses a developing device as described above. Due to this, high quality of image can be stably obtained.

A frictional-heat-generation suppressing device of a developing roller according to the present invention is a developing device in a rotary development unit that, by rotating a plurality of developing devices in a loaded state about a rotary shaft, a selected one of the developing devices is placed adjacent to a photosensitive body of an image forming apparatus so that toner within the selected developing device can be moved onto the photosensitive body, a frictional-heat-generation suppressing device of a developing roller wherein the developing device comprising: a housing formed therein with a toner container; a developing roller having a rotation shaft rotatably supporting by end faces of the housing; an urging device for urging the developing roller toward one of the end faces of the housing; an end abutment part formed in an inner surface of the housing, to restrict from moving the end face of the developing roller positioned on a side in a direction the developing roller is urged; and a low friction member provided in a manner sandwiched between the end face of the developing roller and the end abutment part.

A frictional-heat-generation suppressing device of a developing roller according to the invention is a developing device in a rotary development unit that, by rotating a plurality of developing devices in a loaded state about a rotary shaft, a selected one of the developing devices is placed adjacent to a photosensitive body of an image forming apparatus so that toner within the selected developing device can be moved onto the photosensitive body, a frictional-heat-generation suppressing device of a developing roller wherein the developing device comprising: a housing formed therein with a toner container; a supply roller provided adjacent to the toner container and having a rotation shaft rotatably supported by end faces of the housing; a developing roller having a peripheral surface in contact with a peripheral surface of the supply roller and a rotation shaft rotatably supported by the end faces of the housing; an urging device for urging the developing roller on one of the end faces of the housing; an end abutment part formed in an inner surface of the housing, to restrict from moving the end face of the developing roller positioned on a side in a direction the developing roller is urged; and a low friction member provided in a manner sandwiched between the end face of the developing roller and the end abutment part.

According to the invention, during rotation of the developing roller, the end face of developing roller and the low friction member can be smoothly in slide contact together and end abutment part and the low friction member can be smoothly in slide contact together. Because this suppresses the frictional heat generation at a slide point to a possible low extent, the end abutment part is not deformed by frictional heat. Meanwhile, because no friction is caused at the end abutment part or developing-roller end face, the developing roller is positively positioned in position with respect to the lengthwise direction.

A frictional-heat-generation suppressing device of a developing roller according to the invention is that the low friction member is a polyslider. The polyslider has a low frictional coefficient with the material in contact and an excellent wear resistance, hence being suited as a low friction member.

A frictional-heat-generation suppressing device of a developing roller according to the invention is that the urging device is structured by a developing-roller driving gear provided at one end of the rotation shaft of the developing roller and formed with helical teeth in a peripheral surface thereof, and an intermediate gear having a support shaft supported by the end faces of the housing and formed in a peripheral surface with helical teeth in mesh with the developing-roller driving gear, the developing roller being urged toward the developing-roller driving gear by an action of the helical teeth.

According to the invention, by the meshing action of the helical teeth on the developing-roller driving gear and the helical teeth on the intermediate gear, the developing gear is urged toward the developing-roller driving gear.

A frictional-heat-generation suppressing device of a developing roller according to the invention has a frictional-heat-generation suppressing device as described above. According to the invention, because the end abutment part is not deformed by frictional heat or the end abutment part is not worn out, the developing roller is accurately determined in lengthwise position. Thus, stable toner supply to the photosensitive body can be realized over a long term.

An image forming apparatus according to the invention uses a developing device as described above. Due to this, high quality of image can be stably obtained.

An electric-contact urging device on a rotation shaft according to a first embodiment of the present invention is an electric contact that a conductor elastic plate having an electric contact for contact with an end of a rotation shaft is fixed on a fixing member positioned around the end of the rotation shaft at first and second fixing parts, the electric contact with the end of the rotary shaft being positioned between the first and second fixing parts, an electric-contact urging device on a rotation shaft characterized in that: the conductor elastic plate has a first arm part extending between the first fixing part and the electric contact and a second arm part extending between the second fixing part and the electric contact; the first arm part and the second arm part intersecting at an intersecting angle of 30 to 150 degree; the electric contact being elastically urged on and contacted with an end of the rotation shaft by an elasticity of the conductor elastic plate.

According to the invention, by forming an electric contact in an intersection where the first and second arms intersect at an intersecting angle of 30 degree to 150 degree, the first and second arms act as leaf springs, to damp the contact pressure that the electric contact is in contact with the end of the rotation shaft. Accordingly, even in case the conductor elastic plate is fixed at an end distant from the electric contact of the first and second arms, there is no substantial increase in the contact pressure of the electric contact with the rotation-shaft end.

On the other hand, as a result of fixing at the end distant from the electric contact, because the conductor elastic plate elastically deforms such that the electric contact is urged on the rotation-shaft end, it is possible to positively maintain the state that the electric contact is in contact with the rotation-shaft end at a proper contact pressure. In this manner, because the electric contact can be positively contacted with the rotation-shaft end at a comparatively weak contact pressure, it is possible to prevent the electric contact from being opened with a hole resulting from a wear due to rotating shaft with the electric contact.

An electric-contact urging device on a rotation shaft according to the invention is that the intersecting angle is approximately 90 degrees.

According to the invention, it is possible to positively realize the state that the electric contact is in contact with the rotation-shaft end at a proper contact pressure.

An electric-contact urging device on a rotation shaft according to the invention is that the first and second fixing parts are fixed by screws. The present invention makes it possible to place the electric contact in contact at a proper contact pressure with the rotation-shaft end, regardless of the degree of screw tightening.

An electric-contact urging device on a rotation shaft according to the invention is that the rotation shaft is a rotation shaft of a roller for toner carriage provided in a developing device capable of moving toner to a photosensitive body by positioning adjacent to the photosensitive body of an image forming apparatus, the electric contact being to be used as an electricity feed base point for charging an outer peripheral surface of the roller. According to the invention, because charging bias voltage can be stably applied to the developing and supply rollers, charged state can be stabilized on the roller surface. Thus, a constant amount of toner can be stable supplied onto the photosensitive body.

An electric-contact urging device on a rotation shaft according to the invention is characterized in that: a conductor elastic plate having an electric contact for contact with one end of a rotation shaft is fixed to a fixing member positioned around the end of the rotation shaft, at one fixing part; the electric contact being formed close to a free end of a branch arm part branched from an intermediate of a third arm part extending from the one fixing part; a fourth arm part bent approximately 90 degrees at an opposite end of the third arm part to the one fixing part and extending toward the other end of the rotation shaft; the fourth arm part being formed with another fixing part for fixing the third arm part to the fixing member in a state of pulling toward the other end of the rotation shaft; the electric contact being elastically urged by and contacted with one end of the rotation shaft by an elasticity of the conductor elastic plate.

According to the invention, the fourth arm is fixed in a state being pulled toward the other end of the rotation shaft, the fourth arm deflects toward the other end. Due to this, the electric contact deflects to maintain the state of abutment against the rotation-shaft end at a proper contact pressure. Because the electric contact is formed in a free end branched from the fourth arm, even if somewhat strong is the pulling force toward the other end of the rotation shaft, the electric contact exhibits an elastic action like a leaf spring. This causes a damp effect to moderate the force of the electric contact. Such a strong contact pressure as to form a hole in the electric contact is not caused on the electric contact. Accordingly, it is possible to provide an electric contact stable over a long term.

An electric-contact urging device on a rotation shaft according to the invention is that the one fixing part and the other fixing part are fixed by screws. According to the invention, the pulling force from the fourth arm can be adjusted by changing the fixing position of screws, it is possible to change the pressure force by the electric contact is in contact with the rotation-shaft end.

An electric-contact urging device on a rotation shaft according to the invention is that the rotation shaft is a rotation shaft of a roller for toner carriage provided in a developing device for moving toner to a photosensitive body by being placed adjacent to the photosensitive body of an image forming apparatus, the electric contact being to be used as an electricity feed base point for charging an outer peripheral surface of the roller. According to the invention, because charging bias voltage can be stably applied to the developing and supply rollers provided on the developing device, the charged state can be stabilized on the roller surface. Thus, a constant amount of toner can be stably fed onto the photosensitive body.

An electric-contact urging device on a rotation shaft according to the invention is that an electric-contact urging device according to the invention is provided on one conductor elastic plate. According to the invention, by one conductor elastic plate, it is possible to easily adjust a proper contact pressure of the electric contacts with a plurality of rotation shafts.

A developing device of the invention has an electric-contact urging device on a rotation shaft as described above. According to the invention, because charged state can be stabilized on the surface of the developing and supply rollers, toner can be stably supplied. Consequently, high quality of printing can be realized.

Therefore, the seal structure of developing device according to the invention includes a developing roller, a toner layer regulation member which is brought into contact with the developing roller, and seal members which are provided at both ends of the developing roller, and the invention is characterized in that hard resin adhesive is filled in a gap between the toner layer regulation member and the seal member.

Further, the invention is characterized in that the toner layer regulation member comprises a leaf spring and a regulation blade, and the hard resin adhesive is filled in a gap between the leaf spring and the seal member. Further, the invention is characterized in that the hard resin adhesive is filled also in a gap between the regulation blade and the seal member. Furthermore, the invention is characterized in that the hard resin adhesive is UV-curing adhesive.

Therefore, a developing device of the invention includes a developing roller having a rotation shaft formed on both sides in the axial direction of the roller body, and a distance keeping member which is rotatably attached to the rotation shaft and comes into contact with a photosensitive body thereby to keep the distance between the roller body and the photosensitive body, and the invention is characterized in that lubricant is filled between the distance keeping member and the rotation shaft.

Further, the invention is characterized in that lubricant is silicon oil or grease. Further, the invention is characterized in that a lubricant absorber is interposed between the distance keeping member and the side surface of the roller body. Furthermore, the invention is characterized in that a high sliding resin plate is arranged between the distance keeping member and the lubricant absorber.

DETAILED DESCRIPTION OF THE PREFERRED EMBODIMENTS

FIRST EMBODIMENT

===Example of Overall Configuration of Image Forming Apparatus===

Figure 1:
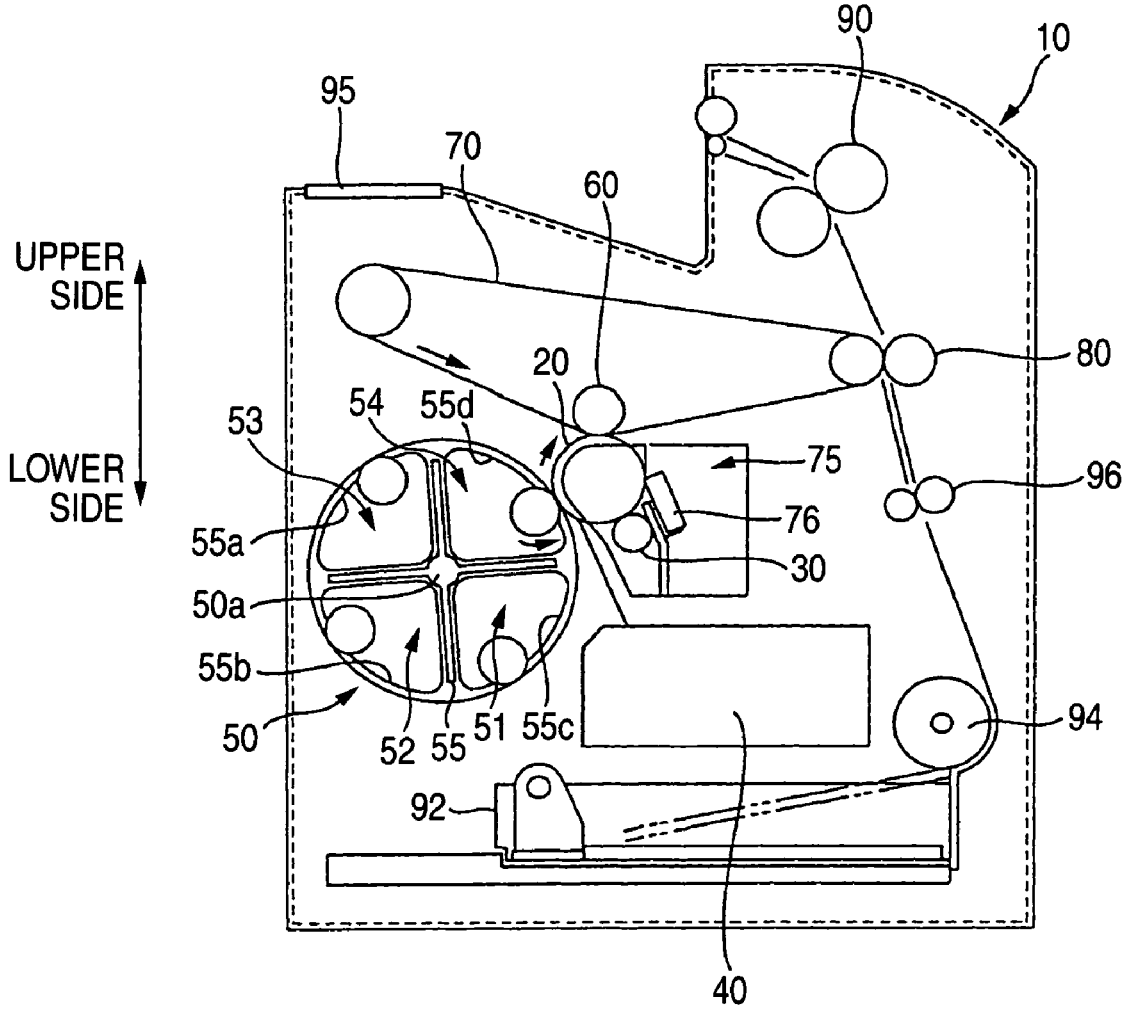
FIG. 1 is a diagram showing the main constituent elements configuring an image forming apparatus pertaining to an embodiment of the invention.

Next, using FIG. 1, an overview of an image forming apparatus of the first embodiment will be described below using a laser beam printer (referred to below as a printer) 10 as an example. FIG. 1 is a diagram showing the main constituent elements configuring the printer 10. It should be noted that, in FIG. 1, upper and lower directions are represented by arrows. For example, a sheet supply tray 92 is disposed in a lower portion of the printer 10 and a fixing unit 90 is disposed in an upper portion of the printer 10.

As shown in FIG. 1, the printer 10 pertaining to the present embodiment includes, along the rotational direction of a photosensitive body 20 serving as an example of an image carrier that carries a latent image, a charging unit 30, an exposure unit 40, a YMCK development unit 50, a primary transfer unit 60, an intermediate transfer body 70 and a cleaning unit 75, and further includes a secondary transfer unit 80, the fixing unit 90, a display unit 95 that serves as means for informing a user and comprises a liquid crystal panel, and a control unit 100 (FIG. 2) that controls these units and the operation of the printer.

The photosensitive body 20 includes a cylindrical conductive base material and a photosensitive layer formed on an outer peripheral surface thereof, and is rotatable around a central axis. In the present embodiment, the photosensitive body 20 rotates clockwise as indicated by the arrow in FIG. 1.

The charging unit 30 is a device for charging the photosensitive body 20, and the exposure unit 40 is a device that forms a latent image on the charged photosensitive body 20 by irradiating a laser. The exposure unit 40 includes a semiconductor laser, a polygon mirror and an F-θ lens and, on the basis of an image signal inputted from an unillustrated host computer, such as a personal computer or a word processor, irradiates a modulated laser onto the charged photosensitive body 20.

The YMCK development unit 50 is a device for developing the latent image formed on the photosensitive body 20, using black (K) toner serving as an example of a developer accommodated in a black developing device 51, magenta (M) toner accommodated in a magenta developing device 52, cyan (C) toner accommodated in a cyan developing device 53 and yellow (Y) toner accommodated in a yellow developing device 54.

In the present embodiment, the YMCK development unit 50 is rotated, whereby it becomes possible to move the positions of the four developing devices 51, 52, 53 and 54. That is, the YMCK development unit retains the four development devices 51, 52, 53 and 54 with four retainers 55*a*, 55*b*, 55*c* and 55*d*, so that the four developing devices 51, 52, 53 and 54 are rotatable around a center axis 50*a* with their relative positions being maintained.

Additionally, the developing devices 51, 52, 53 and 54 selectively oppose the photosensitive body 20 each time the photosensitive body 20 rotates once, so that the latent image formed on the photosensitive body 20 is developed by the respective toners accommodated in the developing devices 51, 52, 53 and 54. The details of the developing devices will be described later.

The primary transfer unit 60 is a device for transferring, to the intermediate transfer body 70, the monochrome toner image formed on the photosensitive body 20. When the toners of the four colors are superposed and transferred, a full-color toner image is formed on the intermediate transfer body 70. The intermediate transfer body 70 is an endless belt and is rotatingly driven at a peripheral velocity that is substantially the same as that of the photosensitive body 20. The secondary transfer unit 80 is a device for transferring, to a recording medium such as paper sheet, film or cloth, the monochrome toner image and the full-color toner image formed on the intermediate transfer body 70.

The fixing unit 90 is a device for fusing, to a recording medium such as paper sheet, the monochrome toner image and the full-color toner image transferred onto the recording medium to create a permanent image.

The cleaning unit 75 is disposed between the primary transfer unit 60 and the charging unit 30, includes a rubber cleaning blade 76 that abuts against the surface of the photosensitive body 20, and is a device for scraping off and removing, with the cleaning blade 76, toner remaining on the photosensitive body 20 after the toner image has been transferred by the primary transfer unit 60 onto the intermediate transfer body 70.

Figure 2:
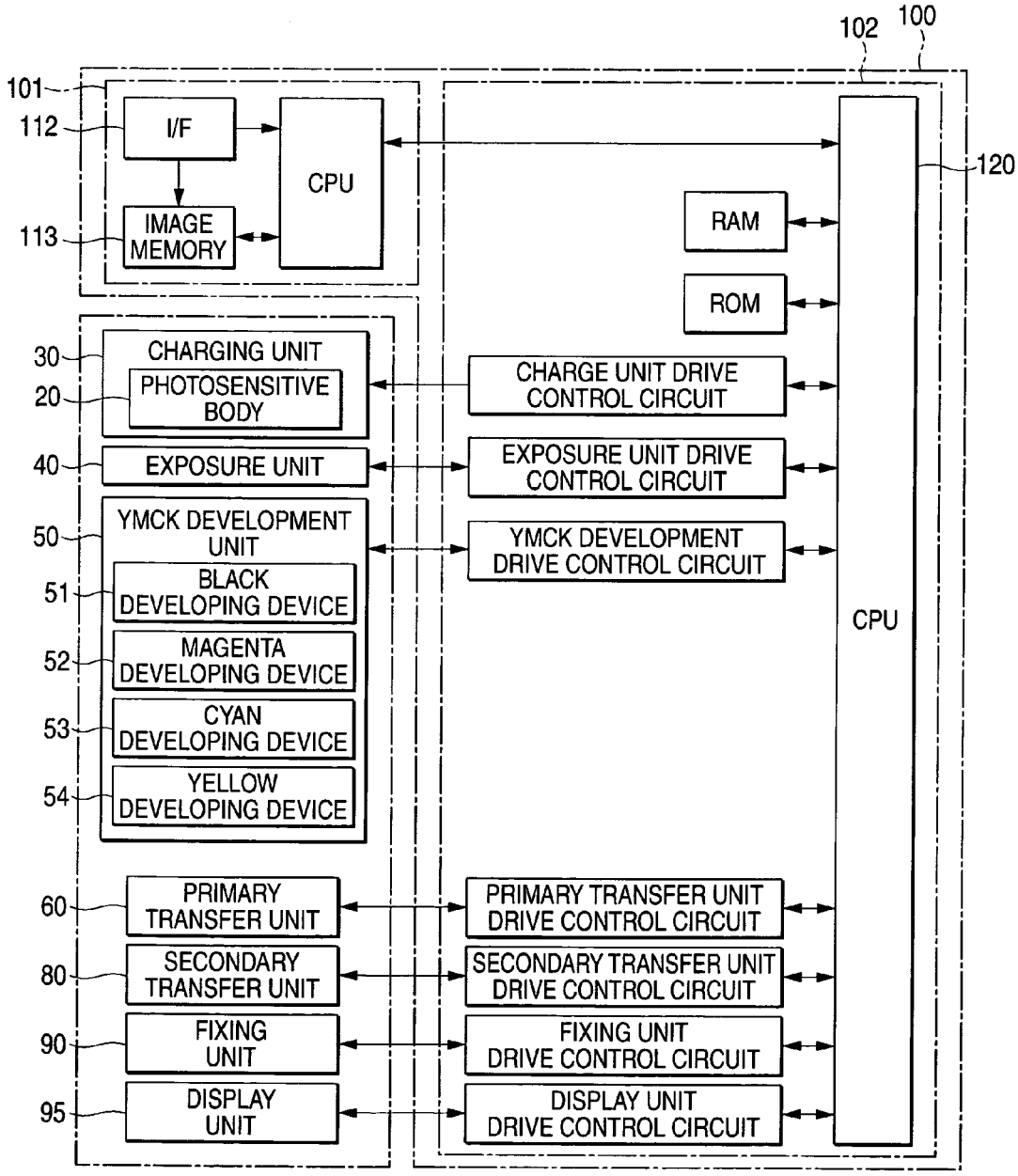
FIG. 2 is a block diagram showing a control unit of the image forming apparatus of FIG. 1.

As shown in FIG. 2, the control unit 100 is configured by a main controller 101 and a unit controller 102. An image signal is inputted to the main controller 101 and the unit controller 102 controls the respective units to form an image in accordance with a command based on this image signal.

Next, the operation of the printer 10 configured in this manner will be described with reference also to other constituent elements.

First, when an image signal from an unillustrated host computer is inputted to the main controller 101 of the printer 10 via an interface (I/F) 112, the photosensitive body 20, a developing roller serving as an example of a developer carrier, and the intermediate transfer body 70 are rotated by the control of the unit controller 102 based on a command from the main controller 101. As it rotates, the photosensitive body 20 is successively charged at charging positions by the charging unit 30.

The charged region of the photosensitive body 20 reaches an exposure position in accompaniment with the rotation of the photosensitive body 20, and a latent image corresponding to image information of the first color—e.g., yellow Y—is formed in that region by the exposure unit 40. Also, the yellow developing device 54, in which the yellow (Y) toner is accommodated, of the YMCK development unit 50 is positioned at a development position opposing the photosensitive body 20.

The latent image formed on the photosensitive body 20 reaches the development position in accompaniment with the rotation of the photosensitive body 20 and is developed by the yellow toner by the yellow developing device 54. Thus, a yellow toner image is formed on the photosensitive body 20.

The yellow toner image formed on the photosensitive body 20 reaches a primary transfer position in accompaniment with the rotation of the photosensitive body 20 and is transferred to the intermediate transfer body 70 by the primary transfer unit 60. At this time, a primary transfer voltage of a polarity that is opposite of the charge polarity of the toner is applied to the primary transfer unit 60. It should be noted that, during this time, the secondary transfer unit 80 is separated from the intermediate transfer body 70.

Due to the above-described processing being repeatedly executed with respect to the second color, the third color and the fourth color, toner images of the four colors corresponding to each image signal are superposed on and transferred to the intermediate transfer body 70. Thus, a full-color toner image is formed on the intermediate transfer body 70.

The full-color toner image formed on the intermediate transfer body 70 reaches a secondary transfer position in accompaniment with the rotation of the intermediate transfer body 70 and is transferred to a recording medium by the secondary transfer unit 80. It should be noted that the recording medium is conveyed from the sheet supply tray 92 to the secondary transfer unit 80 via a sheet supply roller 94 and registration rollers 96. Also, at the time the transfer operation is conducted, the secondary transfer unit 80 is pressed against the intermediate transfer body 70 so that a secondary transfer charge is applied thereto.

Heat and pressure are applied, by the fixing unit 90, to the full-color toner image transferred to the recording medium to fuse the full-color toner image to the recording medium.

After the photosensitive body 20 passes the primary transfer position, toner adhering to its surface is scraped off by the cleaning blade 76 supported at the cleaning unit 75, to prepare the photosensitive body 20 for charging for forming the next latent image. The scraped-off toner is recovered in a residual toner recovery section with which the cleaning unit 75 is disposed.

===Overview of Control Unit===

Next, the configuration of the control unit 100 will be described with reference to FIG. 2. The main controller 101 of the control unit 100 is connected to a host computer via the interface 112 and is disposed with an image memory 113 for storing an image signal inputted from the host computer. The unit controller 102 is electrically connected to the respective units (the charging unit 30, the exposure unit 40, the YMCK developing unit 50, the primary transfer unit 60, the cleaning unit 75, the secondary transfer unit 80, the fixing unit 90 and the display unit 95) of the device, and receives signals from sensors with which these are disposed, whereby the unit controller 102 detects the status of each unit and controls each unit on the basis of signals inputted from the main controller 101.

===Example of Configuration of Developing Devices===

Figure 3:
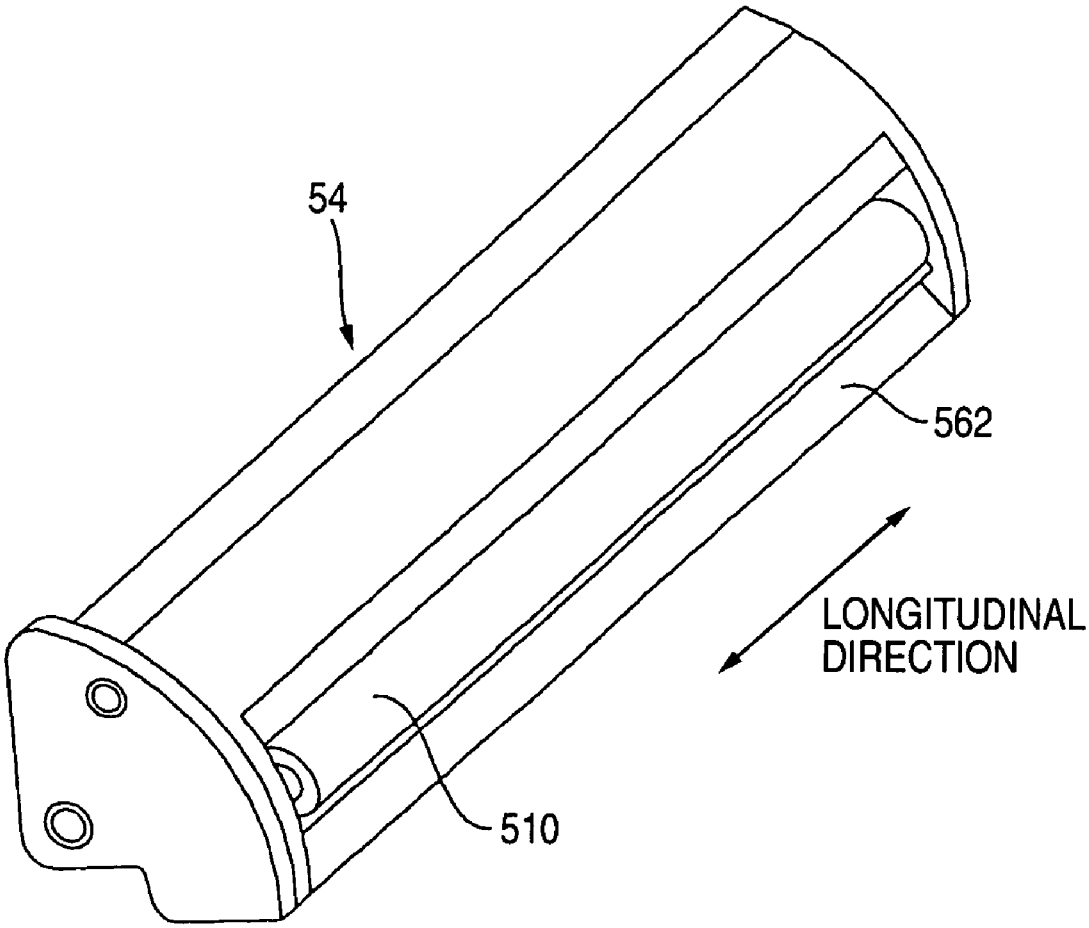
FIG. 3 is a perspective view of a developing device.
Figure 4:
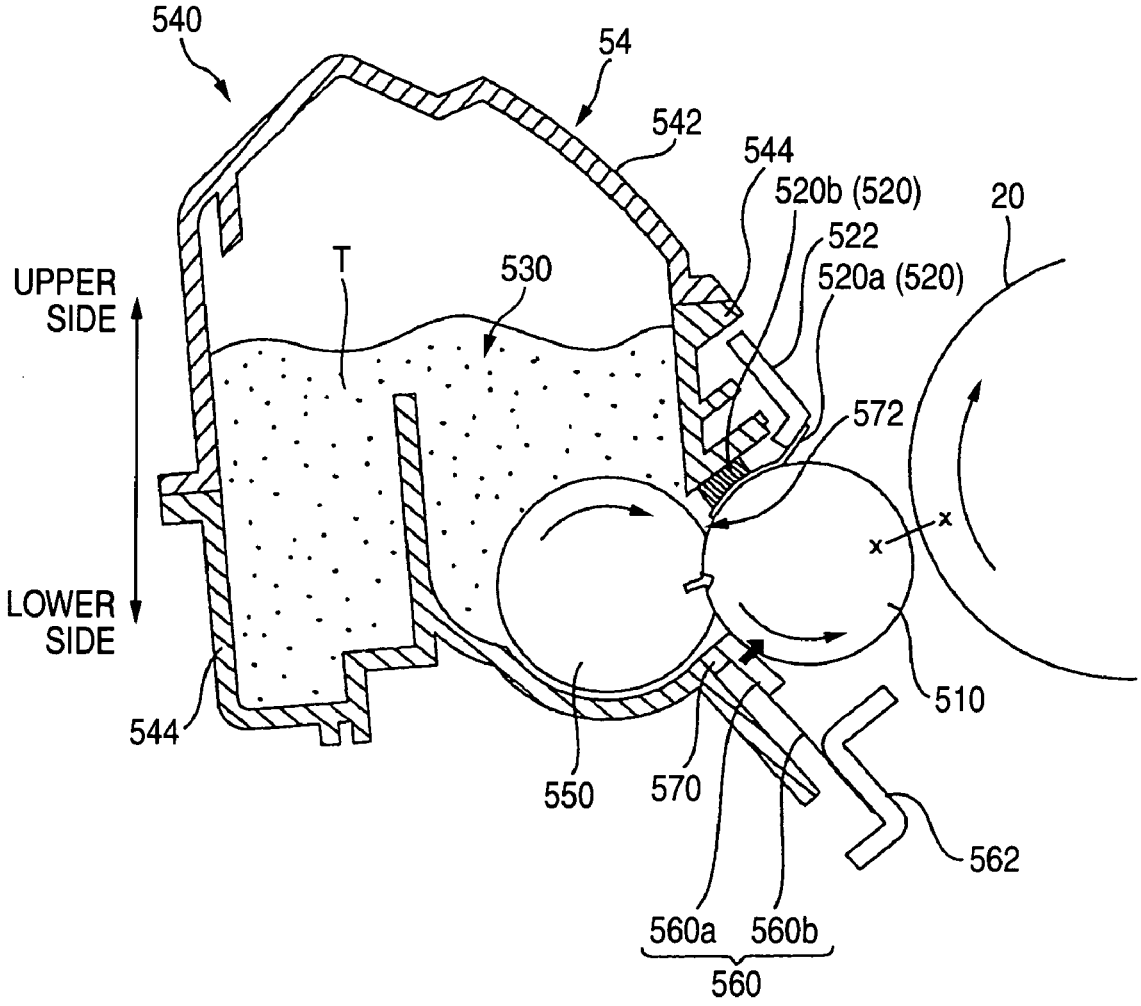
FIG. 4 is a cross-sectional view showing the main constituent elements of the developing device.

Next, an example of the configuration of the developing devices will be described using FIGS. 3 and 4. FIG. 3 is a perspective view of a developing device, and FIG. 4 is a cross-sectional view showing the main constituent elements of the developing device. It should be noted that the cross-sectional view shown in FIG. 4 is a diagram representing a cross section where the developing device is cut along a plane orthogonal to the longitudinal direction shown in FIG. 3. Also, in FIG. 4, similar to FIG. 1, upper and lower directions are represented with arrows. For example, a central axis of a developing roller as an example of a developer carrier is below the central axis of the photosensitive body 20. Also, in FIG. 4, the yellow developing device 54 is shown in a state that it is positioned at the development position opposing the photosensitive body 20.

Disposed in the YMCK development unit 50 are the black developing device 51 accommodating the black (K) toner, the magenta developing device 52 accommodating the magenta (M) toner, the cyan developing device 53 accommodating the cyan (C) toner and the yellow developing device 54 accommodating the yellow (Y) toner. Because the configuration of each developing device is the same, the yellow developing device 54 will be described below.

The yellow developing device 54 includes a developing roller 510, a seal member 520, a housing 540, a toner supply roller 550 serving as an example of a developer supplying member, and a regulation blade 560 serving as an example of a layer thickness regulating member.

The developing roller 510 retains toner T serving as an example of the developer and conveys the toner T to the development position opposing the photosensitive body 20. The developing roller 510 is manufactured with an aluminum alloy such as 5056 aluminum alloy and 6063 aluminum alloy and an iron alloy such as STKM, and nickel plating or chrome plating is administered as needed. As shown in FIG. 3, the developing roller 510 is supported at both longitudinal-direction end portions thereof and is rotatable around a central axis. As shown in FIG. 4, the developing roller 510 rotates in the direction (counter-clockwise direction in FIG. 4) opposite to the direction in which the photosensitive body 20 rotates (clockwise direction in FIG. 4). The central axis thereof is lower than the central axis of the photosensitive body 20. Also, as shown in FIG. 4, a gap is present between the developing roller 510 and the photosensitive body 20 in a state that the yellow developing device 54 is opposing the photosensitive body 20. That is, the yellow developing device 54 develops the latent image formed on the photosensitive body 20 in a state of non-contact. It should be noted that, when the latent image formed on the photosensitive body 20 is developed, an alternating electric field is formed between the developing roller 510 and the photosensitive body 20. That is, in the present embodiment, the latent image carried on the photosensitive body 20 is developed by the toner T using a jumping development format.

More detailed description of the structure of the yellow developing device 54 will be given later.

The seal member 520 is an attachment member attached to the housing 540 along the longitudinal direction of the yellow development device 54 and includes the function of preventing the toner T inside the yellow developing device 54 from leaking out from between the developing roller 510 and the housing 540. As the seal member 520 including this function, an axial-direction seal member **520*a* prevents the toner T inside the yellow developing device 54 from leaking outside a container and recovers the toner T on the developing roller 510 that has passed the development position inside a development container without scraping the toner T off. The axial-direction seal member 520*a* is a seal comprising a polyethylene film and the like. The axial-direction seal member 520*a* is supported by a seal support portion (support washer) 568*b* disposed at a frame 568 described later and is attached to the housing 540 via the seal support portion 568*b***.

Also, as another seal member 520 including the above-described function, a seal urging member **520*b* prevents the toner T inside the yellow developing device 54 from leaking outside the container and presses the axial-direction seal member 520*a* against the developing roller 510 with an elastic force. The seal urging member 520*b* comprises moltopren and is disposed at the side opposite to the developing roller 510 side of the axial-direction seal member 520*a***.

It should be noted that the abutment position at which the axial-direction seal member **520*a* abuts against the developing roller 510 is higher than the central axis of the developing roller 510**.

The housing 540 is manufactured by integrally molded plural housing portions—i.e., by welding together an upper housing portion 542 and a lower housing portion 544.

As shown in FIG. 4, the housing 540 includes an opening 572 in a lower portion thereof, and the developing roller 510 is disposed at the opening 572 in a state that a portion of the developing roller 510 is exposed.

Also, the housing 540 forms a toner accommodating portion 530 that can accommodate the toner T. An agitating member for agitating the toner T may also be disposed in the toner accommodating portion 530, but in the present embodiment an agitating member is not disposed in the toner accommodating portion 530 because the respective developing devices (the black developing device 51, the magenta developing device 52, the cyan developing device 53 and the yellow developing device 54) are rotated in accompaniment with the rotation of the YMCK development unit, whereby the toner T inside the developing devices is agitated.

The toner supply roller 550 is an abutment member that abuts against the developing roller 510 along the longitudinal direction of the developing roller 510, and supplies the toner T accommodated in the toner accommodating portion 530 to the developing roller 510. The toner supply roller 550 comprises polyurethane foam and abuts against the developing roller 510 in a state that it is elastically deformed. The toner supply roller 550 is disposed in a lower portion of the toner accommodating portion 530, and the toner T accommodated in the toner accommodating portion 530 is supplied to the developing roller 510 by the toner supply roller 550 at the lower portion of the toner accommodating portion 530. The toner supply roller 550 is rotatable around a central axis, and the central axis is lower than the rotational central axis of the developing roller 510. Also, the toner supply roller 550 rotates in the direction (counter-clockwise direction in FIG. 4) opposite to the direction in which the developing roller 510 rotates (clockwise direction in FIG. 4).

It should be noted that the toner supply roller 550 includes the function of supplying, to the developing roller 510, the toner T accommodated in the toner accommodating portion 530, and also includes the function of removing toner T remaining on the developing roller 510 after development from the developing roller 510. Also, the toner supply roller 550 abuts against the developing roller 510 along the longitudinal direction of the developing roller 510, whereby it presses the developing roller 510 towards the photosensitive body 20 as shown by the white arrow in FIG. 4.

The regulation blade 560 is an abutment member that abuts against the developing roller 510 along the longitudinal direction of the developing roller 510, regulates the layer thickness of the toner T carried on the developing roller 510, and imparts a charge to the toner T carried on the developing roller 510. The regulation blade 560 includes a rubber portion 560*a* and a rubber support portion 560*b*. The rubber portion 560*a* comprises silicon rubber or urethane rubber, and the rubber support portion 560*b* is a thin plate having resilience such as phosphor bronze or stainless steel. The rubber portion 560*a* is supported at the rubber support portion 560*b*, and the rubber support portion 560*b* is attached to the housing 540 via blade support plates 562 in a state that one end portion of the rubber support portion 560*b* is nipped between and supported by the pair of blade support plates 562. Also, a blade back member 570 comprising moltopren is disposed at the side opposite to the developing roller 510 side of the regulation blade 560.

Here, the rubber portion 560*a* is pressed against the developing roller 510 by the elastic force resulting from the flexure of the rubber support portion 560*b*. In other words, the rubber portion 560*a* of the regulation blade 560 abuts against the developing roller 510 along the longitudinal direction of the developing roller 510, whereby it presses the developing roller towards the photosensitive body 20 as shown by the black arrow in FIG. 4.

Also, the blade back member 570 prevents the toner T from entering between the rubber support portion 560*b* and the housing 540, stabilizes the elastic force resulting from the flexure of the rubber support portion 560*b*, and urges the rubber portion 560*a* from directly behind the rubber portion 560*a* in the direction of the developing roller 510, whereby it presses the rubber portion 560*a* against the developing roller 510. Thus, the blade back member 570 improves the even abutment of the rubber portion 560*a* against the developing roller 510.

The end of the regulation blade 560 of the side opposite from the side supported at the blade support plate 562, i.e., the proximal end, does not contact the developing roller 510, but a portion separated by a predetermined distance from the proximal end contacts the developing roller 510 with a width. That is, the regulation blade 560 does not contact the developing roller 510 at the edge but around the middle. Also, the regulation blade 560 is disposed so that the proximal end thereof faces the upstream side of the direction in which the developing roller 510 rotates. It should be noted that the abutment position at which the regulation blade 560 abuts against the developing roller 510 is lower than the central axis of the developing roller 510 and lower than the central axis of the toner supply roller 550.

In the yellow developing device 54 configured in this manner, the toner supply roller 550 supplies the toner T accommodated in the toner accommodating portion 530 to the developing roller 510. When the toner T supplied to the developing roller 510 reaches the abutment position of the regulation blade 560 in accompaniment with the rotation of the developing roller 510 and passes the abutment position, the layer thickness is regulated and a charge is imparted. The toner T on the developing roller 510 whose layer thickness has been regulated reaches the development position opposing the photosensitive body 20 due to further rotation of the developing roller 510 and is supplied to development of the latent image formed on the photosensitive body 20 under the alternating electrical field at the development position. The toner T on the developing roller 510 that has passed the development position due to further rotation of the developing roller 510 passes the axial-direction seal member 520*a* and is recovered inside the developing device without being scraped off by the axial-direction seal member 520*a*. Moreover, toner still remaining on the developing roller 510 is removed by the toner supply roller 550.

===Relation Between Development Gap and Image Density===

Figure 5A:
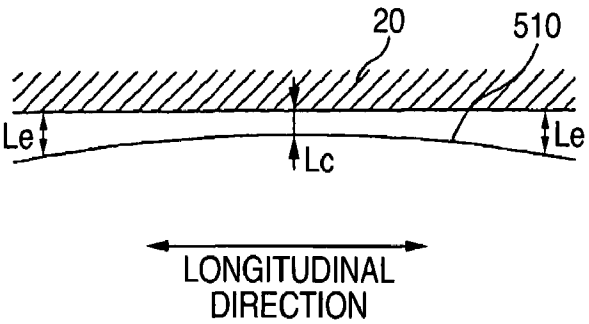
FIG. 5A is a diagram schematically showing the X—X cross section shown in FIG. 4.
Figure 6:
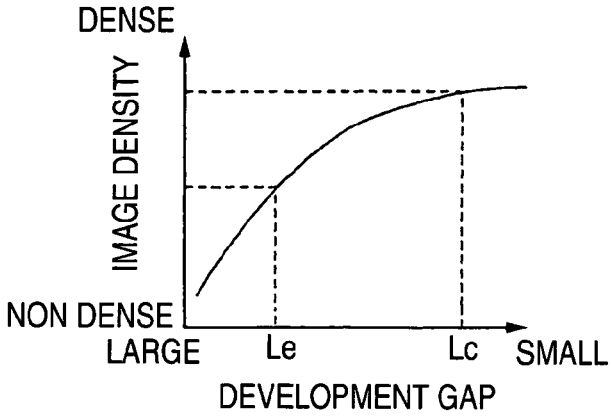
FIG. 6 is a diagram showing the relation between a development gap and image density.
Figure 7A:
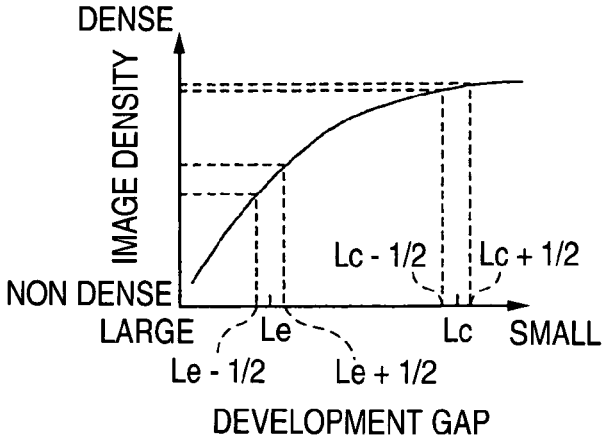
FIG. 7A is a diagram showing the relation between the development gap and image density.

Next, the relation between a development gap and image density will be described using FIGS. 4 to 7. FIG. 5 are diagrams where the X—X cross section shown in FIG. 4 is schematically represented. FIGS. 6 and 7 are graphs showing the relation between the development gap and image density.

As mentioned previously, the toner supply roller 550 abuts against the developing roller 510 along the longitudinal direction of the developing roller 510, whereby it presses the developing roller 510 towards the photosensitive body 20, as shown by the white arrow in FIG. 4. Also, the rubber portion 560*a* of the regulation blade 560 abuts against the developing roller 510 along the longitudinal direction of the developing roller 510, whereby it presses the developing roller 510 towards the photosensitive body 20, as shown by the black arrow in FIG. 4.

Additionally, the developing roller 510 is supported at both longitudinal-direction ends thereof. Thus, as shown in FIG. 5, in the space of the gap (also called the development gap in the present embodiment) between the developing roller 510 and the photosensitive body 20, an interval Lc at the longitudinal-direction center portion becomes smaller than intervals Le at the longitudinal-direction end portions of the developing roller 510.

Next, the relation between the development gap and the image density of the image formed by development at the time the latent image carried on the photosensitive body 20 is developed by the toner T in a state that the developing roller 510 and the photosensitive body 20 are not in contact, such as a jumping development format, will be considered using FIG. 6.

In FIG. 6, the development gap is represented on the horizontal axis and image density is represented on the vertical axis. The direction of the arrow on the horizontal axis is a direction in which the development gap becomes smaller, and the direction of the arrow on the vertical axis is a direction in which image density becomes denser. As is clear from the drawing, development efficiency rises and image density becomes denser as the development gap becomes smaller. Thus, image density at the longitudinal-direction center portion of the developing roller 510 is denser than image density at the longitudinal-direction end portions.

When attention is given simply to the developing roller 510, the developing roller 510 rotates around the central axis thereof as mentioned previously, but deflection occurs in the developing roller 510 due to this rotation. The occurrence of this deflection is caused by manufacturing errors and the like in the developing roller 510, and the development gap fluctuates with the rotational period of the developing roller 510 due to this deflection.

Here, the relation between the development gap and image density will again be considered using FIG. 7. In FIG. 7 also, the development gap is represented on the horizontal axis and image density is represented on the vertical axis. Also, the direction of the arrow on the horizontal axis is a direction in which the development gap becomes smaller, and the direction of the arrow on the vertical axis is a direction in which image density becomes denser.

Assuming that the deflection amount of the deflection is equal along the longitudinal direction of the developing roller 510, the development gap at the longitudinal-direction end portions fluctuates between Le−½ and Le+½, and the development gap at the longitudinal-direction center portion fluctuates between Lc−½ and Lc+½. In other words, at the longitudinal-direction end portions, the development gap becomes small to a minimum of Le−½ and becomes larger to a maximum of Le+½ due to the rotation of the developing roller 510. Similarly, at the longitudinal-direction center portion, the development gap becomes small to a minimum of Lc−½ and becomes larger to a maximum of Lc+½ due to the rotation of the developing roller 510. It should be noted that the deflection amount is represented by 1 in the above description.

Image density fluctuates in accordance with the fluctuation in the development gap resulting from the deflection of the developing roller 510. However, as is clear from the drawings, whereas the fluctuation in image density at the longitudinal-direction center portion of the developing roller 510 is minute, image density at the longitudinal-direction end portions fluctuates relatively largely. Additionally, this fluctuation in image density leads to density unevenness having a periodicity and becomes marked.

That is, at the longitudinal-direction center portion, the impact on the fluctuation in image density resulting from the fluctuation of the development gap becomes small because development is stably conducted because the development gap is small, but at the longitudinal-direction end portions, the impact on the fluctuation in image density resulting from the fluctuation of the development gap becomes large because the development gap is large.

Figure 5B:
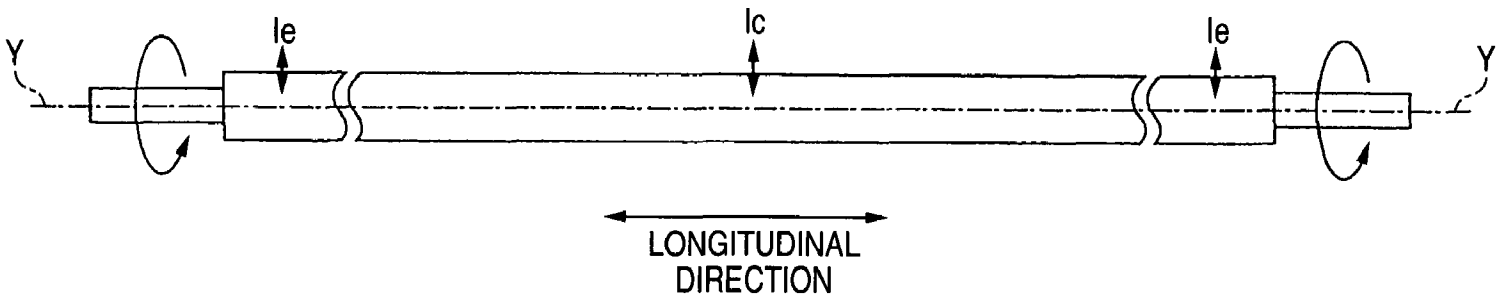
FIG. 5B is a cross-sectional view schematically showing the developing roller 510 where the deflection amount at longitudinal-direction ends is smaller than the deflection amount at a longitudinal-direction center portion.

Thus, in order to eliminate this drawback, a developing roller 510 such as shown in FIG. 5B is used as the developing roller 510, where the deflection amount at the longitudinal-direction end portions (represented by 1*e* in the drawing) is smaller than the deflection amount at the longitudinal-direction center portion (represented by 1*c* in the drawing).

Figure 7B:
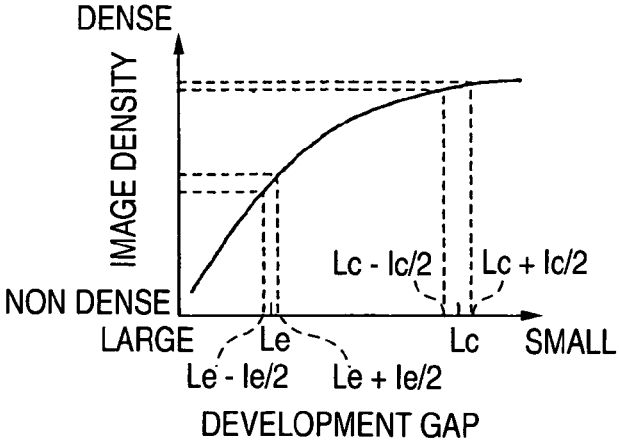
FIG. 7B is a diagram showing the relation between the development gap and image density.

The relation between the development gap and image density when the developing roller 510 is used in this manner where the deflection amount 1*e* is less than the deflection amount 1*c* is as shown in FIG. 7B. As is shown in the drawing, the fluctuation in image density corresponding to the fluctuation in the development gap resulting from the deflection of the developing roller 510 becomes smaller at the longitudinal-direction end portions. Additionally, density unevenness generated by the fluctuation in image density is further suppressed.

That is, because the impact on the fluctuation in image density resulting from the fluctuation in the development gap is greater at the longitudinal-direction end portions than at the longitudinal-direction center portion, it becomes possible to more effectively suppress density unevenness by using the developing roller 510 where the deflection amount 1*e* is less than the deflection amount 1*c*.

===Structure of the Developing Roller 510===

Figure 8:
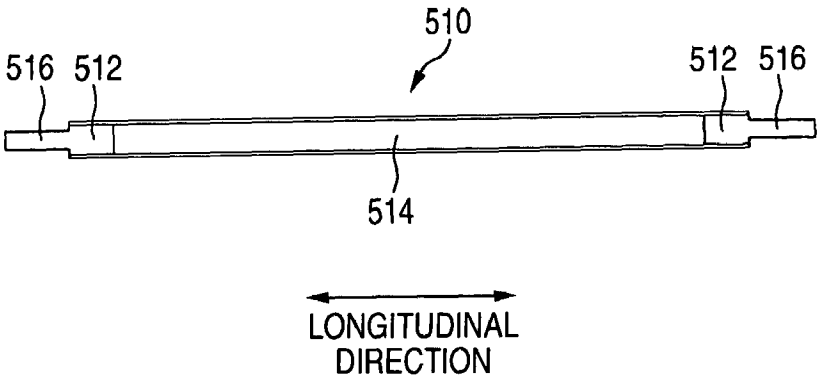
FIG. 8 is a diagram schematically showing the cross section of a developing roller 510.
Figure 9:
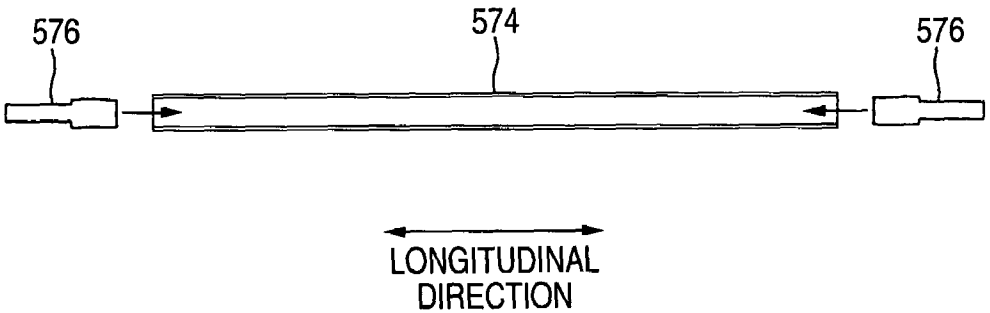
FIG. 9 is a diagram schematically showing a hollow roller 57 and axial members 576 configuring the developing roller 510.
Figure 10:
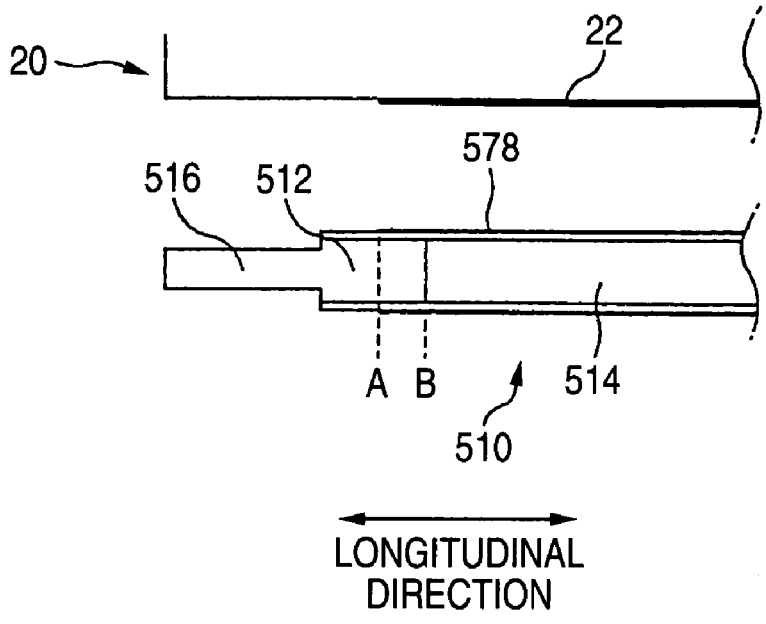
FIG. 10 is a diagram showing the positional relation between an opposing region 578 and a solid portion 512 of the developing roller 510.
Figure 11:
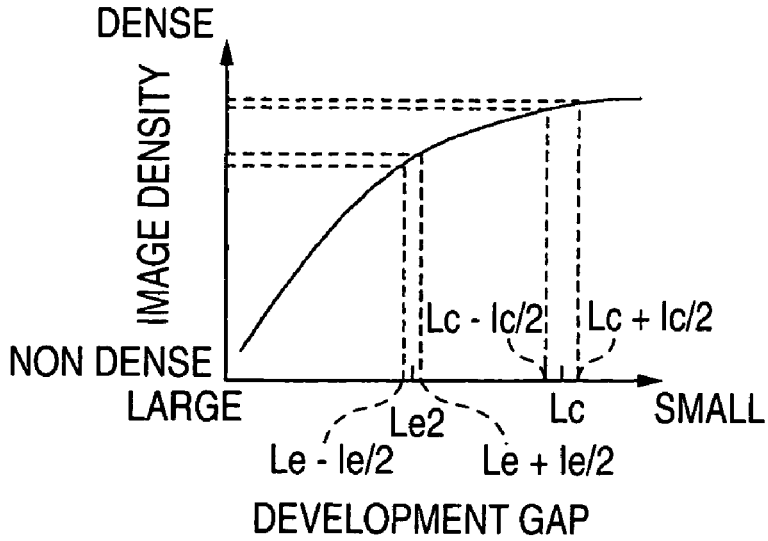
FIG. 11 is a diagram showing the relation between the development gap and image density.

Next, the structure of the developing roller 510 will be described using FIGS. 8 to 11. FIG. 8 is a diagram schematically showing the cross section of the developing roller 510 where the deflection amount at the longitudinal-direction end portions is smaller than the deflection amount at the longitudinal-direction center portion. FIG. 9 is a diagram schematically showing a hollow roller 574 and axial members 576 configuring the developing roller 510. FIG. 10 is a diagram showing the positional relation between an opposing region 578 and solid portions 512 of the developing roller 510. FIG. 11 is a graph showing the relation between the development gap and image density.

As mentioned previously, the developing roller 510 fulfills the role of carrying the toner T and conveying the toner T to the development position opposing the photosensitive body 20. The developing roller 510 is made of metal, is manufactured with an aluminum alloy such as 5056 aluminum alloy and 6063 aluminum alloy and an iron alloy such as STKM, and nickel plating or chrome plating is administered as needed.

As shown in FIG. 8, the developing roller 510 is disposed with the solid portions 512, which are solid, at both longitudinal-direction end portions and a hollow portion 514, which is hollow, at the longitudinal-direction center portion. Also, the developing roller 510 includes axial portions 516 at both longitudinal-direction end portions. The axial portions 516 are supported, whereby the developing roller 510 is supported. Additionally, the axial portions 516 form part of the solid portions 512.

Also, as shown in FIG. 9, the developing roller 510 is formed by fitting the solid axial members 576 into both longitudinal-direction end portions of the hollow roller 574, whereby it is configured as described above. The developing roller 510 is manufactured by at least one of cutting and polishing.

Moreover, as mentioned previously, the developing roller 510 opposes the photosensitive body 20 so that development is implemented appropriately. As shown in FIG. 10, when a region of the developing roller 510 opposing a latent image-carryable region 22 (represented by fat lines in the drawing with respect to the photosensitive body 20), which is a region that can carry a latent image on the photosensitive body, is made to serve as the opposing region 578 (represented by fat lines in the drawing with respect to the developing roller 510), the position (represented by reference sign B in the drawing) of the end of the solid portion 512 near the longitudinal-direction center becomes closer to the longitudinal-direction center than the position (represented by reference sign A in the drawing) of the end of the opposing region 578 in the longitudinal direction of the developing roller 510.

In this manner, by making the positions of the ends of the solid portions 512 near the longitudinal-direction center exceed the positions of the ends of the opposing region 578 in the longitudinal direction and making them close to the longitudinal-direction center, the range of the solid portions 512 at the longitudinal-direction end portions becomes wider. Thus, processing precision at the longitudinal-direction end portions of the developing roller 510 is raised and it becomes possible to easily realize the developing roller 510 where the deflection amount at the longitudinal-direction end portions is smaller than the deflection amount at the longitudinal-direction center portion.

Also, because the solid portions 512 are disposed as far as inside the opposing region 578, the strength of the developing roller 510 is raised, the developing roller 510 is supported at both longitudinal-direction end portions, and the structure of the developing roller 510 exhibits the function of reducing flexure of the developing roller 510 when it is abutted against along the longitudinal direction due to the abutment member. Thus, in this situation, because the development gap becomes more even in the longitudinal direction of the developing roller 510, not only the development gap at the longitudinal-direction center portion but also the development gap at the longitudinal-direction end portions can be made smaller.

Here, the relation between the development gap and image density when the developing roller 510 is used will be considered. In FIG. 11 also, the development gap is represented on the horizontal axis and image density is represented on the vertical axis. Also, the direction of the arrow on the horizontal axis is a direction in which the development gap becomes smaller, and the direction of the arrow on the vertical axis is a direction in which image density becomes denser.

As shown in FIG. 11, the deflection amount at the longitudinal-direction end portions becomes smaller from 1 to 1*e* in comparison to the example shown in FIG. 7, and the development gap at the longitudinal-direction end portions also becomes smaller from Le to Le2 in comparison to the example shown in FIG. 7. Thus, the fluctuation in image density corresponding to the fluctuation in the development gap becomes less at the longitudinal-direction end portions in comparison to the example shown in FIG. 7. Additionally, density unevenness generated by the fluctuation in image density is further suppressed.

In this manner, by making the positions of the ends of the solid portions near the longitudinal-direction center closer to the longitudinal-direction center with respect to the developing roller 510 than the positions of the ends of the opposing region, it becomes possible to easily realize the developing roller 510 that is suitable for suppressing the occurrence of density unevenness appearing in the image.

===Other Examples===

Although the developer carrier pertaining to the invention was described above on the basis of the above-described embodiment, the embodiment of the invention is for facilitating understanding of the invention and is not intended to limit the invention. Of course, the invention can be altered and improved without deviating from the gist thereof, and equivalents are included in the invention.

Although the image forming apparatus was described in the above-described embodiment using an intermediate transfer type full-color laser beam printer as an example, the invention is applicable to various image forming apparatuses, such as full-color laser beam printers other than an intermediate transfer type, and to monochrome laser beam printers, copiers and facsimiles.

Also, the photosensitive body is not limited to a so-called photosensitive roller configured by disposing a photosensitive layer on the outer peripheral surface of a cylindrical conductive base material, and may also be a so-called photosensitive belt configured by disposing a photosensitive layer on the surface of a belt-like conductive base material.

Also, although the developing roller in the above-described embodiment was formed by fitting solid axial members into both longitudinal-direction end portions of a hollow roller, the developing roller is not limited thereto.

However, by forming the developing roller in this manner, a developing roller where the positions of the ends of the solid portions near the longitudinal-direction center are closer to the longitudinal-direction center than the positions of the ends of the opposing region in the longitudinal direction can be easily obtained. Thus, it becomes possible to easily achieve the aforementioned effect—i.e., the effect that a developing roller suitable for suppressing the occurrence of density unevenness appearing in the image can be realized.

Also, although the developing roller in the above-described embodiment was manufactured by at least one of cutting and polishing being conducted, the developing roller is not limited thereto.

However, by administering at least one of cutting and polishing to the developing roller, the action resulting from improvement of processing precision becomes more effectively exhibited. In this respect, the above-described embodiment is more effective.

Also, in the above-described embodiment, although the abutment member that abuts against the developing roller along the longitudinal direction of the developing roller was included and the developing roller was supported at both longitudinal-direction end portions of the developing roller and was abutted against along the longitudinal direction of the developing roller by the abutment member, the invention is not limited thereto. For example, the developing roller does not have to be supported at both longitudinal-direction end portions and does not have to be abutted against along the longitudinal direction by the abutment member.

However, in this situation, because the potential for the developing roller to become easy to bend and for the development gap at the longitudinal-direction end portions of the developing roller to become larger than the development gap at the longitudinal-direction center portion rises, as mentioned previously, it becomes easy for density unevenness having a periodicity to occur. Thus, the above-described embodiment is more effective in that the aforementioned effect—i.e., the effect of effectively suppressing the occurrence of density unevenness appearing in the image—is more effectively exhibited.

That is, because the development gap becomes more even in the longitudinal direction of the developing roller, not only the development gap at the longitudinal-direction center portion but also the development gap at the longitudinal-direction end portions can be made smaller. Thus, density unevenness generated by the fluctuation in image density is further suppressed. In this respect, the above-described embodiment is more effective.

Also, although the abutment member pressed the developing roller towards the photosensitive body in the above-described embodiment, the invention is not limited thereto.

However, in this case, the above-described embodiment is more effective in that the function where the structure of the developing roller, in which the solid portions of the developing roller are disposed as far as inside the opposing region, reduces flexure of the developing roller is more effectively exhibited.

In such a situation, because the potential for the development gap at the longitudinal-direction end portions of the developing roller to become larger than the development gap at the longitudinal-direction center portion becomes higher, as mentioned previously, it becomes easier for density unevenness having a periodicity to occur. Thus, the above-described embodiment is more effective in that the aforementioned effect—i.e., the effect of effectively suppressing the occurrence of density unevenness appearing in the image—is more effectively exhibited.

Also, although the abutment member in the above-described embodiment was the toner supply roller, the invention is not limited thereto. Any member can be used as the abutment member as long as it is an abutment member that abuts against the developing roller along the longitudinal direction of the developing roller.

In a case that the developing roller is abutted against along the longitudinal direction of the developing roller by the toner supply roller, the development gap becomes more even in the longitudinal direction of the developing roller due to the action pertaining to the configuration of the developing roller. Thus, not only the development gap at the longitudinal-direction center portion but also the development gap at the longitudinal-direction end portions can be made smaller. Thus, density unevenness generated by the fluctuation in image density becomes further suppressed.

In this situation, because the potential for the developing roller to become easy to bend due to the toner supply roller abutting against the developing roller along the longitudinal direction of the developing roller and for the development gap at the longitudinal-direction end portions of the developing roller to become larger than the development gap at the longitudinal-direction center, as mentioned previously, it becomes easy for density unevenness having a periodicity to occur. Thus, the above-described embodiment is more effective in that the aforementioned effect—i.e., the effect of effectively suppressing the occurrence of density unevenness appearing in the image—is more effectively exhibited.

Also, although the abutment member in the above-described embodiment was the regulation blade, the invention is not limited thereto. Any member can be used as the abutment member as long as it is an abutment member that abuts against the developing roller along the longitudinal direction of the developing roller.

In a case that the developing roller is abutted against along the longitudinal direction of the developing roller by the regulation blade, the development gap becomes more even in the longitudinal direction of the developing roller due to the action pertaining to the configuration of the developing roller. Thus, not only the development gap at the longitudinal-direction center portion but also the development gap at the longitudinal-direction end portions can be made smaller. Thus, density unevenness generated by the fluctuation in image density becomes further suppressed.

In this situation, because the potential for the developing roller to become easy to bend due to the regulation blade abutting against the developing roller along the longitudinal direction of the developing roller and for the development gap at the longitudinal-direction end portions of the developing roller to become larger than the development gap at the longitudinal-direction center portion rises, as mentioned previously, it becomes easy for density unevenness having a periodicity to occur. Thus, the above-described embodiment is more effective in that the aforementioned effect—i.e., the effect of effectively suppressing the occurrence of density unevenness appearing in the image—is more effectively exhibited.

Also, although the developing roller in the above-described embodiment was made of metal, the developing roller is not limited thereto and may be of another material.

However, when the developing roller is made of metal, because the potential for the developing roller to become easy to bend due to the elasticity of the developing roller becoming lower and for the development gap at the longitudinal-direction end portions of the developing roller to become larger than the development gap at the longitudinal-direction center rises, as mentioned previously, it becomes easy for density unevenness having a periodicity to occur.

Thus, the above-described embodiment is more effective in that the aforementioned effect—i.e., the effect that a developing roller suitable for suppressing the occurrence of density unevenness appearing in the image can be realized—is more effectively exhibited.

Also, in the above-described embodiment, although the latent image carried in the latent image-carryable region was developed in a state that the developing roller and the photosensitive body were not in contact, the invention is not limited thereto.

For example, the invention is also applicable to a case that the latent image carried in the latent image-carryable region is developed by toner in a state that the developing roller and the photosensitive body are in contact.

Also, in the above-described embodiment, although the latent image carried on the photosensitive body was developed by the toner carried on the developing roller using the jumping development format, the invention is not limited thereto. The invention is applicable to any format as long as the latent image is developed by toner in a state that the developing roller and the photosensitive body are not in contact.

However, the above-described embodiment is more preferable in that the latent image can be developed more appropriately by using the jumping development format.

As mentioned previously, with respect to the developing roller, the positions of the ends of the solid portion near the longitudinal-direction center are closer to the longitudinal-direction center than the positions of the ends of the opposing region in the longitudinal direction. Additionally, in regard to the developing roller configured in this manner, the deflection amount at the longitudinal-direction end portions can be easily made smaller than the deflection amount at the longitudinal-direction center portion.

In this situation, in a case that the latent image is developed by the toner in a state that the developing roller and the photosensitive body are not in contact, as mentioned previously, the fluctuation in image density corresponding to the fluctuation in the development gap resulting from the deflection of the developing roller becomes less at the longitudinal-direction end portions.

In a case that the latent image is developed with the toner in a state that the developing roller and the photosensitive body are in contact, the pressure on the photosensitive body resulting from the developing roller fluctuates due to the rotation of the developing roller, but the fluctuation in image density corresponding to this fluctuation in pressure becomes less at the longitudinal-direction end portions because the deflection amount at the longitudinal-direction end portions of the developing roller becomes small. Additionally, density unevenness generated by the fluctuation in image density becomes further suppressed.

In this manner, by making the positions of the ends of the solid portions near the longitudinal-direction center closer to the longitudinal-direction center than the positions of the ends of the opposing region in the longitudinal direction, the invention is not limited to the case that the developing roller and the photosensitive body are not in contact. Even in a state that both are in contact, it becomes possible to realize a developer carrier that is suitable for suppressing the occurrence of density unevenness appearing in the image.

===Modified Example of the Configuration of the Regulation Blade and Its Periphery===

Figure 14A:
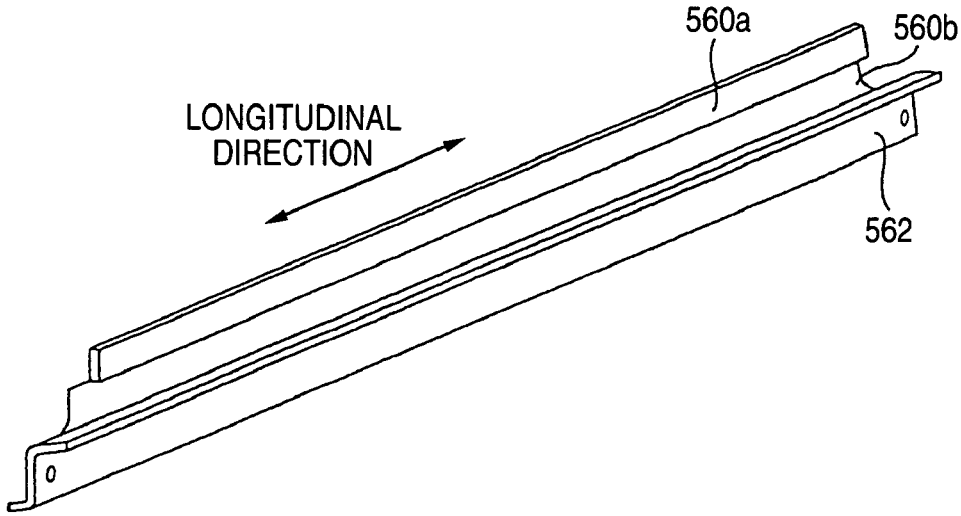
FIGS. 14A and 14B are perspective views showing a state that the regulation blade 560 is fixed to a blade support plate 562.
Figure 14B:
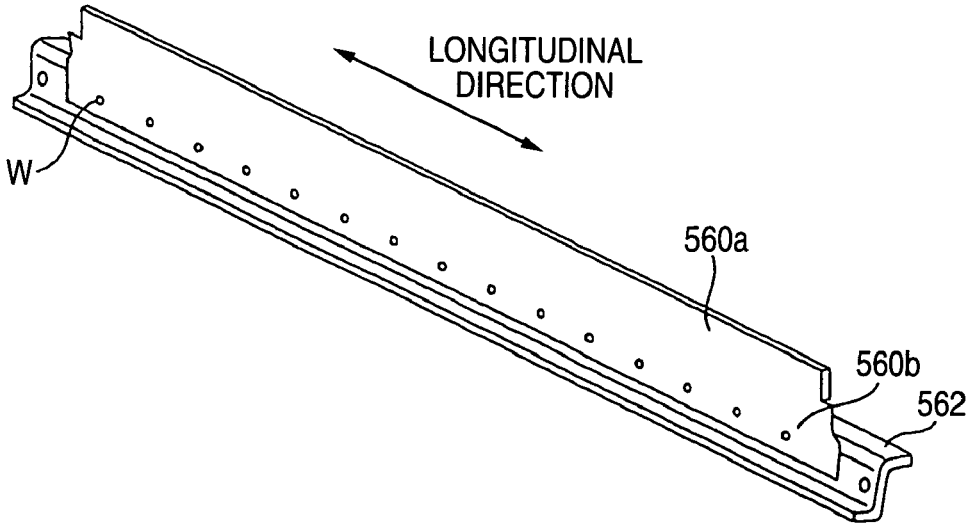
Figure 15:
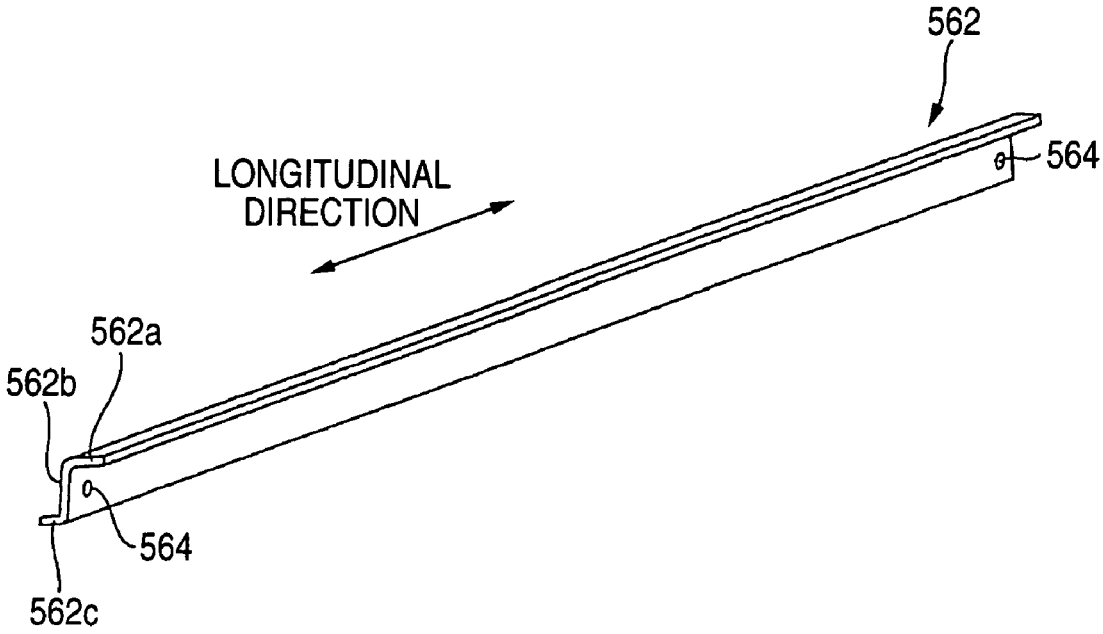
FIG. 15 is a perspective view of the blade support plate 562.
Figure 16A:
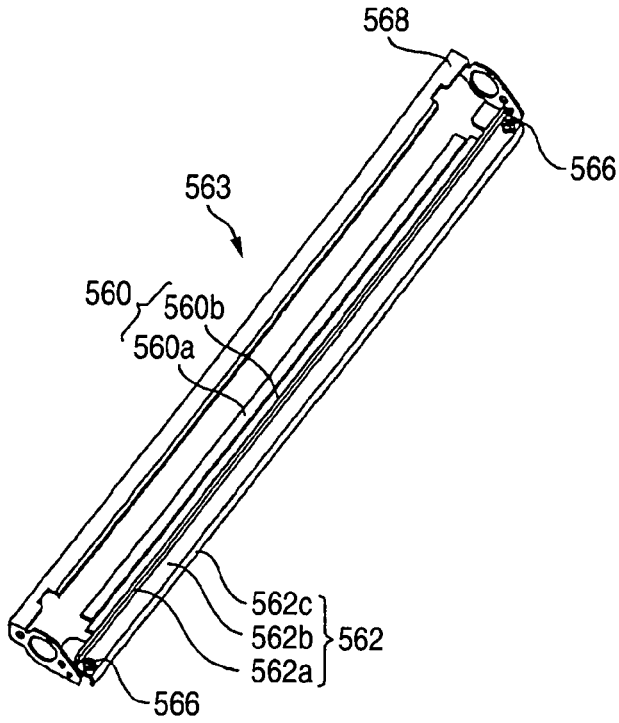
FIGS. 16A and 16B are perspective views showing a toner charging unit 563.
Figure 16B:
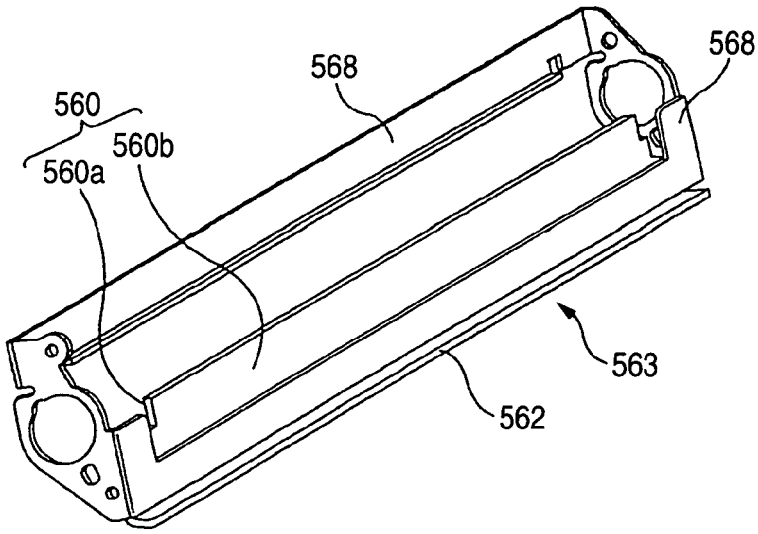
Figure 17:
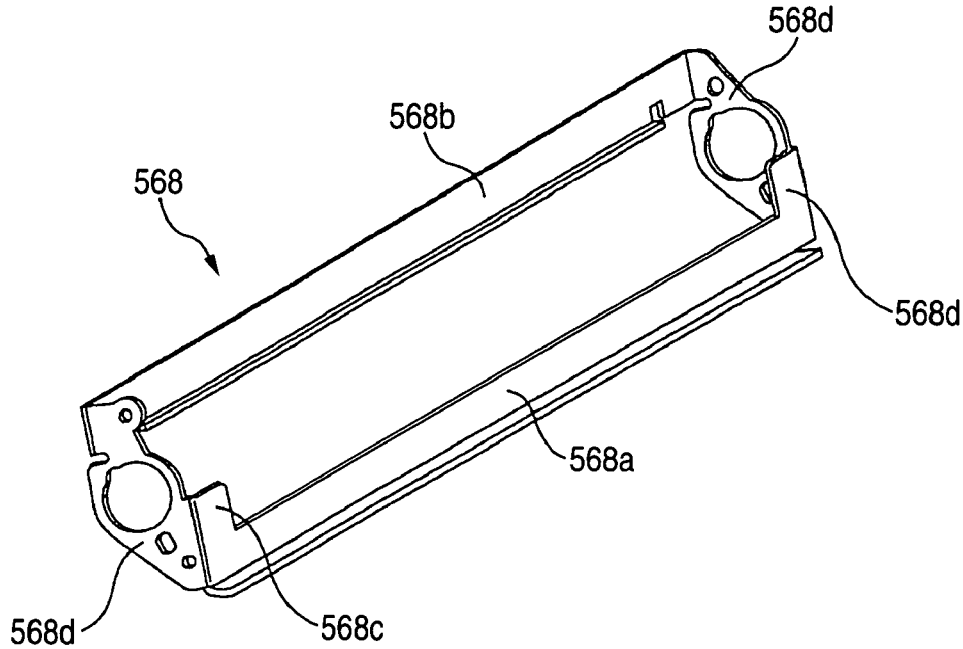
FIG. 17 is a perspective view showing a frame 568.

Next, a modified example of the regulation blade 560 serving as the layer thickness regulating member and its periphery will be described using FIGS. 12 to 21. It should be noted that description will be given by adding the same reference numerals to members that are the same as or correspond to those in the preceding example. FIGS. 14A and 14B are perspective views showing a state that the regulation blade 560 is fixed to the blade support plate 562. FIG. 15 is a perspective view of the blade support plate 562. FIGS. 16A and 16B are perspective views showing a toner charging unit 563. FIG. 17 is a perspective view showing the frame 568. FIGS. 18 to 21 will be described later.

As mentioned previously, the regulation blade 560 imparts a charge to the toner T carried on the developing roller 510 and regulates the layer thickness of the toner T carried on the developing roller 510.

Figure 13:
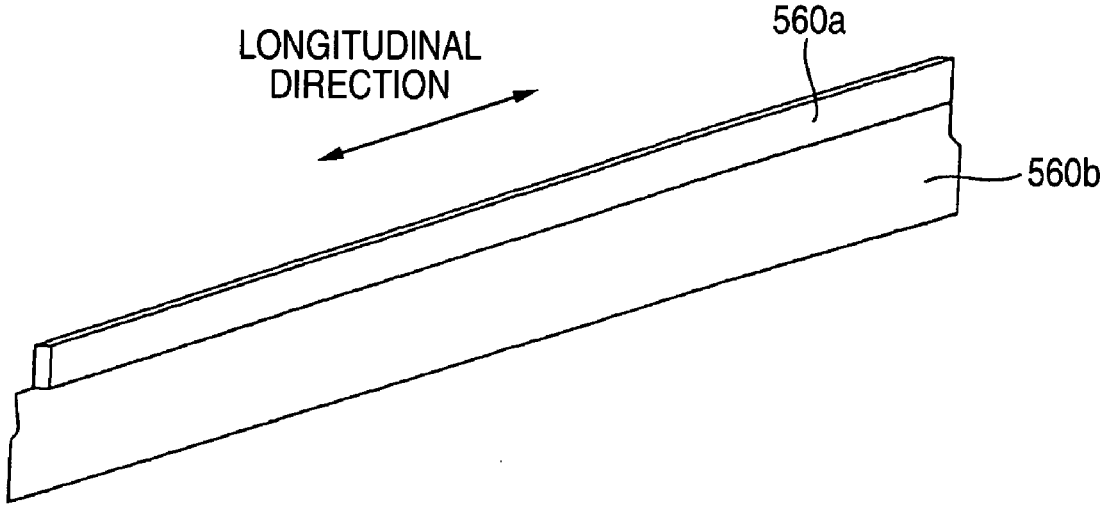
FIG. 13 is a perspective view of a regulation blade 560.

As shown in FIG. 13, the regulation blade 560 includes the rubber portion 560*a* serving as an elastic body and the rubber support portion 560*b* serving as an elastic body support member. The rubber portion 560*a* comprises silicon rubber or urethane rubber, and the rubber support portion 560*b* is a thin plate with a thickness of 1 mm or less having resilience such as phosphor bronze or stainless steel.

Figure 12:
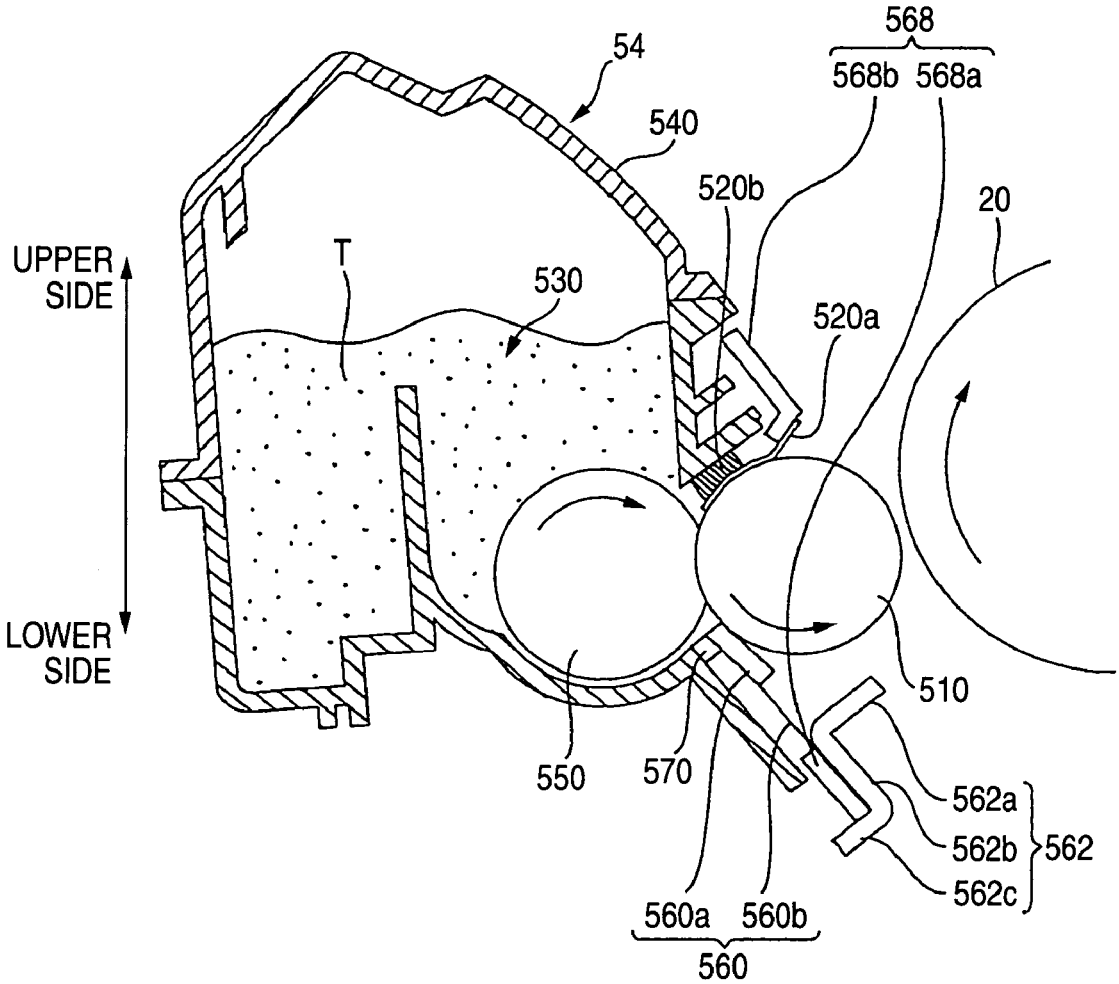
FIG. 12 is a cross-sectional view showing the main constituent elements of the developing device.

As shown in FIG. 13, the rubber portion 560*a* is supported at the rubber support portion 560*b* and, as shown in FIG. 12, the surface thereof abuts against the surface of the developing roller 510 and exhibits the aforementioned function with respect to the toner T carried on the developing roller 510.

The rubber support portion 560*b* presses the rubber portion 560*a* against the developing roller 510 with the elastic force thereof. As shown in FIGS. 14A and 14B, one end portion of the rubber support portion 560*b* is fixed to the blade support plate 562 serving as an example of a support member for supporting the developer charging member (the fixed portions are represented by W in the drawings). The blade support plate 562 is, for example, a steel plate that includes a galvanized layer. Of FIGS. 14A and 14B, FIG. 14A is a diagram where the surface of the rubber portion 560*a* that abuts against the developing roller 510 is shown from the front, and FIG. 14B is a diagram where the rear surface of the surface of the rubber portion 560*a* that abuts against the developing roller 510 is shown from the front.

As mentioned previously, the rubber support portion 560*a* of the regulation blade 560 is fixed to the blade support plate 562, and this fixing is realized by spot welding being conducted with laser welding.

In this case, mainly the rubber support portion 560*b* and the galvanized layer of the blade support plate 562 are welded in the laser welding. Specifically, it is preferable for the rubber support portion 560*b* to be a thin plate made of phosphor bronze or stainless steel because the rubber support portion 560*b* requires elasticity, and it is preferable for the blade support plate 562 to be a thick steel plate because high rigidity is required thereof. Because it is difficult to weld together steel plates whose materials are different and whose thicknesses are also different, here, laser welding where accurate and precise control is possible is used. Also, because the amount of heat necessary to weld the thick blade support plate 562 is large, directly welding the rubber support portion 560*b* to the base material is avoided and a galvanized steel plate having a galvanized layer on the surface thereof is used. Also, it is possible for spot welding resulting from laser welding, which can be conducted in a short period of time, to be automated with a robot or the like, and it is possible to fix at plural points more effectively than fixing with screws.

As shown in FIG. 15, the blade support plate 562 includes a first bent portion 562*a*, a support portion 562*b* and a second bent portion 562*c*, which are formed by folding, along the longitudinal direction thereof, a rectangular member whose thickness is 1.8 mm or more. The directions in which the first bent portion 562*a* and the second bent portion 562*c* are bent are opposite directions and, as shown in FIG. 12, the cross section thereof is formed in a so-called "Z" shape. It should be noted that, of the first bent portion 562*a* and the second bent portion 562*c*, the one that is closer to the rubber portion 560*a* is the first bent portion 562*a*. Also, as shown in FIGS. 12, 14A and 14B, the support portion 562*b* is fixed by the rubber support portion 560*b* of the regulation blade 560 and the support portion 562*b* being spot-welded together at plural places along the longitudinal direction of the regulation blade 510 and supports the regulation blade 560.

Moreover, as shown in FIG. 15, the blade support plate 562 includes, at both longitudinal-direction end portions of the support portion 562*b*, screw holes 564 for fixing the blade support plate 562. Additionally, as shown in FIGS. 16A and 16B, the blade support plate 562 is fixed, at both longitudinal-direction end portions of the support portion 562*b*, by screws 566 to the frame 568 serving as a free length determining member for determining the free length of the regulation blade 560. It should be noted that the frame 568 serving as the free length determining member not only includes the function of determining the free length but also includes the functions of supporting seal member 520 and passing the developing roller 510, as described later.

The frame 568 is a metal plate where metal has been thinly stretched and, as shown in FIG. 17, includes a free length determining portion 568*a*, which is disposed along the longitudinal direction of the frame 568 and serves as an abutment portion that abuts against the rubber support portion 560*b* of the regulation blade 560, a seal support portion 568*b*, which is similarly disposed along the longitudinal direction, blade support plate fixing portions 568*c*, which are positioned at outer sides of the free length determining portion 568*a* in the longitudinal direction, and frame side portions 568*d*, which are positioned at outer sides of the seal support portion 568*b* and the blade support plate fixing portions 568*c* in the longitudinal direction.

Figure 18:
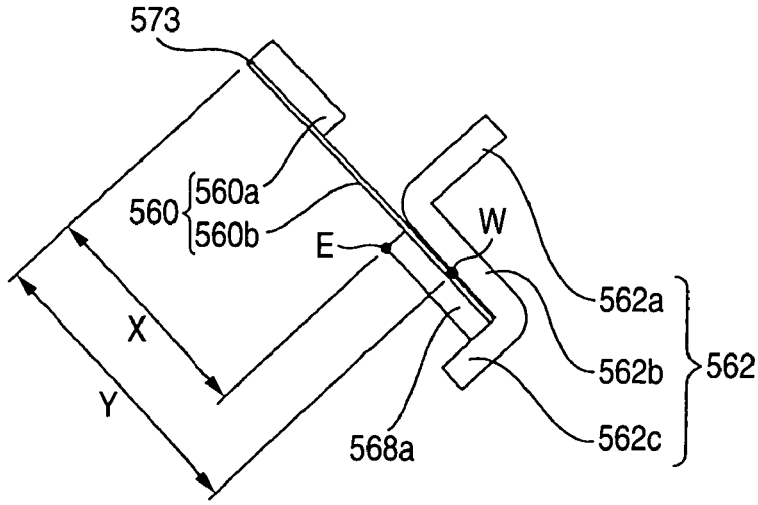
FIG. 18 is a cross-sectional view showing the regulation blade 560 and peripheral members thereof.

The free length determining portion 568*a* abuts against the rubber support portion 560*b* of the regulation blade 560 and determines the free length of the regulation blade 560. In regard thereto, more detailed description will be given using FIGS. 16A, 16B and 18. FIG. 18 is a cross-sectional view showing the regulation blade 560 and peripheral members thereof.

As shown in FIGS. 16A, 16B and 18, the regulation blade 560 is nipped between the frame 568 and the blade support plate 562, and in this state the blade support plate 562 is fixed by the screws 566 to the frame 568. More specifically, the rubber support portion 560*a* of the regulation blade 560 is nipped between the free length determining portion 568*a* of the frame 568 and the support portion 562*b* of the blade support blade 562, and the blade support plate 562 is fixed, at both longitudinal-direction end portions of the support portion 562*b* of the blade support portion 562, by the screws 566 to the blade support plate fixing portions 568*c* of the frame 568.

Here, consideration will be given to the free length of the regulation blade 560. The distance (represented by X in FIG. 18) from an end E of the free length determining portion 568*a* closest to a free length end 573 of the regulation blade 560 to the free length end 573 is shorter than the distance (represented by Y in FIG. 18) from the fixing portion W, at which the regulation blade 560 and the blade support plate 562 are fixed, to the free length end 573. Thus, the free length is not the distance Y from the fixing portion W to the free length end 573 but the distance X from the end E to the free length end 573. That is, due to the free length end determining portion 568*a*, the frame 568 fulfills the role of determining the free length of the regulation blade 560.

Also, as mentioned previously, the seal support portion 568*b* supports the seal member 520 and the blade support plate 562 is fixed by the screws 566 to the blade support plate fixing portions 568*c*. The frame side portions 568*d* will be described later.

It should be noted that, in the present embodiment, the unit shown in FIGS. 16A and 16B, in which the regulation blade 560, the blade support plate 562 and the frame 568 are integrated, is called the toner charging unit 563 serving as an example of a developer charging unit. That is, the toner charging unit 563 includes the regulation blade 560, the blade support plate 562 and the frame 568. Of FIGS. 16A and 16B, FIG. 16A is a diagram where the surface at which the rubber portion 560*a* abuts against the developing roller 510 is shown from the front, and FIG. 16B is a diagram where the back of the surface at which the rubber portion 560*a* abuts against the developing roller 510 is shown from the front.

Figure 19:
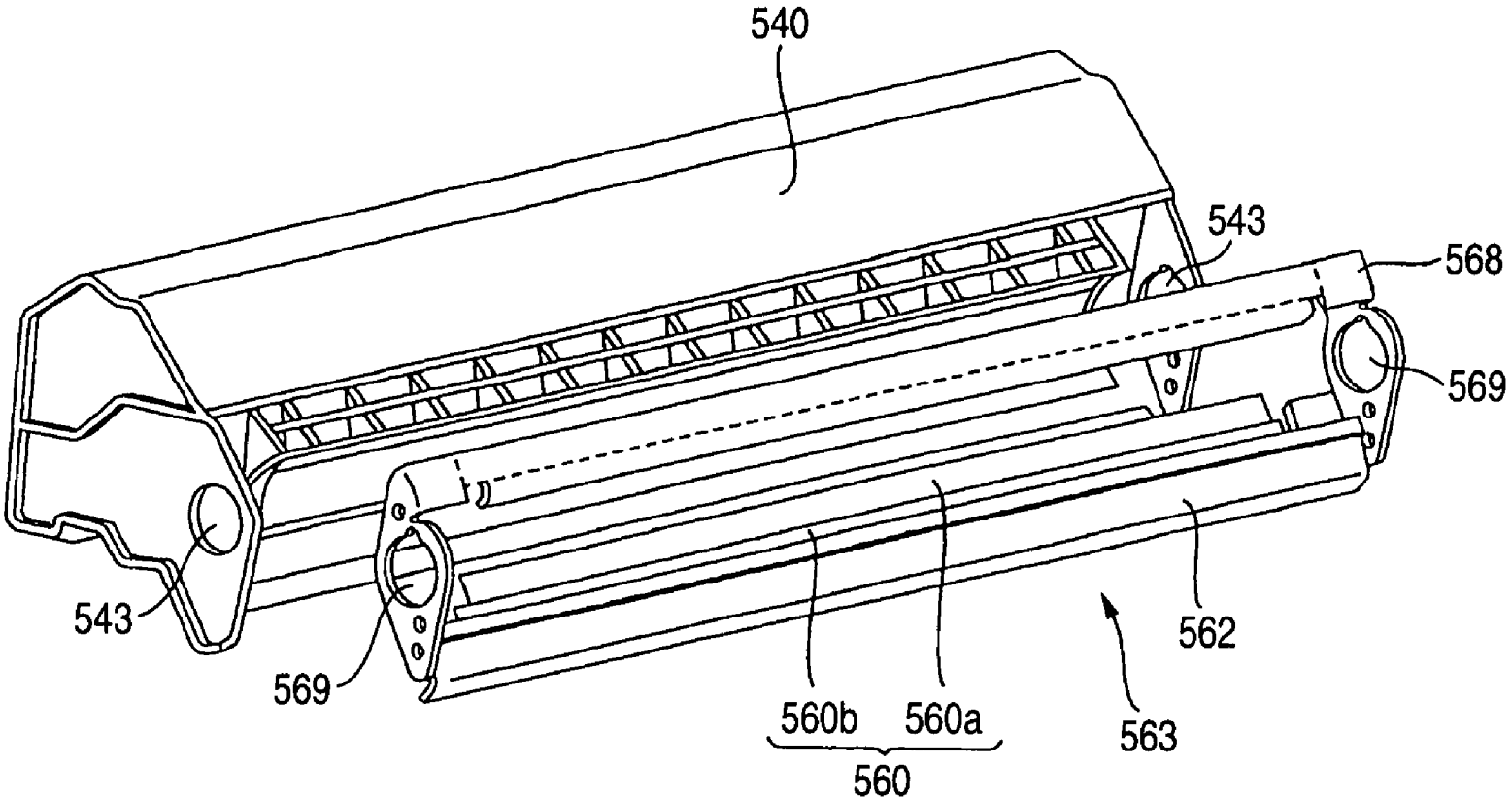
FIG. 19 is a schematic diagram showing a state that the toner charging unit 563 is detached from a housing 540.

As shown in FIG. 19, the toner charging unit 563 configured in this manner is attachable to and detachable from the housing 540. In a state that the toner charging unit 563 is attached to the housing 540, the regulation blade 560 disposed in the toner charging unit 563 exhibits the aforementioned function. Also, the toner charging unit 563 includes, at the frame side portions 568*d*, developing roller passing holes 569. In a state that the toner charging unit 563 is attached to the housing 540, the developing roller 510 is passed through the developing roller passing holes 569 and developing roller passing holes 543 disposed in the housing 540 and is supported. FIG. 19 is a schematic diagram showing a state that the toner charging unit 563 is detached from the housing 540.

Also, the blade back member 570 comprising moltopren is disposed at the side opposite to the developing roller 510 side of the regulation blade 560. The blade back member 570 prevents the toner from entering between the rubber support portion 560*b* and the housing 540, stabilizes the elastic force of the rubber support portion 560*b*, and urges the rubber portion 560*a* from directly behind the rubber portion 560*a* in the direction of the developing roller 510, whereby it presses the rubber portion 560*a* against the developing roller 510. Thus, the blade back member 570 improves the even abutment of the rubber portion 560*a* against the developing roller 510.

The end of the regulation blade 560 of the side opposite from the side supported at the blade support plate 562, i.e., the proximal end, does not contact the developing roller 510, but a portion separated by a predetermined distance from the proximal end contacts the developing roller 510 with a width. That is, the regulation blade 560 does not contact the developing roller 510 at the edge but around the middle. Also, the regulation blade 560 is disposed so that the proximal end thereof faces the upstream side of the direction in which the developing roller 510 rotates—i.e., it counter abuts. It should be noted that the abutment position at which the regulation blade 560 abuts against the developing roller 510 is lower than the central axis of the developing roller 510 and lower than the central axis of the toner supply roller 550.

In this manner, the blade support plate includes the first bent portion, the support portion and the second bent portion, which are formed by bending a rectangular material along the longitudinal direction thereof, the support portion supports the regulation blade, the direction in which the first bent portion is bent is opposite to the direction in which the second bent portion is bent, and the toner charging unit includes the free length determining member for determining the free length of the regulation blade. Due to this, it becomes possible to make the charge of the toner even.

That is, as described in the prior art section, when the regulation blade is fixed by spot welding to the blade support plate, there are cases where the spot-welded positions on the regulation blade determine the free length of the regulation blade. In this case, the distance between the spot-welded position in the lateral direction of the regulation blade and the free length end of the regulation blade becomes the free length. Additionally, fixing the free length along the longitudinal direction of the regulation blade contributes to the evenness of the pressure of the regulation blade on the developing roller.

However, because spot welding is ordinarily done by welding at plural points, of the positions in the longitudinal direction of the regulation blade, the pressure differs between the positions where spot welding has been conducted and the positions where spot welding has not been conducted, and there is the potential for the pressure in the longitudinal direction to become uneven.

Thus, the free length determining member for determining the free length of the regulation blade is disposed in the toner charging unit. In so doing, the free length becomes determined by the free length determining member rather than the spot-welded positions on the regulation blade. Thus, differences in pressure between the positions where spot welding has been conducted and the positions where spot welding has not been conducted do not arise, and it becomes possible to make the pressure of the regulation blade on the developing roller even.

Also, because the regulation blade is fixed to the blade support plate, the rigidity of the support member is weak, and if flexure occurs in the support member, there is the potential for flexure to also occur in the regulation blade and for the pressure to become uneven.

Figure 20A:
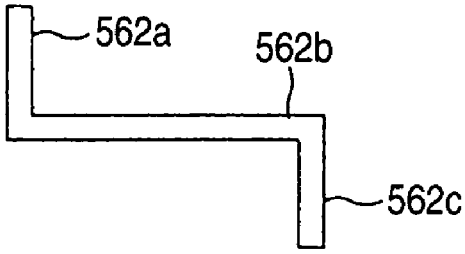
FIGS. 20A and 20B are schematic diagrams showing cross sections where the blade support plate 562 pertaining to the embodiment of the invention and a blade support plate pertaining to a comparative example have been cut along a plane orthogonal to the longitudinal direction.
Figure 20B:
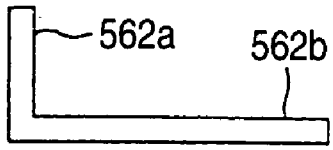

This will be further described using FIGS. 20A and 20B. FIGS. 20A and 20B are schematic diagrams showing cross sections where the blade support plate pertaining to the present embodiment and a blade support plate pertaining to a comparative example are cut along a plane orthogonal to the longitudinal direction. FIG. 20A shows the blade support plate pertaining to the present embodiment and FIG. 20B shows the blade support plate serving as a comparative example for comparison to the blade support plate of the present embodiment. As is clear from the drawings, the point of difference between the two is that the blade support plate serving as the comparative example does not include the second bent portion that the blade support plate pertaining to the present embodiment includes. That is, whereas the cross section of the blade support plate pertaining to the present embodiment is formed in a so-called "Z" shape, the cross section of the blade support plate serving as the comparative example is formed in a so-called "L" shape.

When the blade support plate pertaining to the present embodiment is compared to the blade support plate serving as the comparative example, the rigidity is stronger and flexure is more difficult to occur in the blade support plate pertaining to the present embodiment. The reason for this is because, whereas the blade support plate serving as the comparative example is formed by bending a rectangular member once along the longitudinal direction thereof, the blade support plate pertaining to the present embodiment is formed by bending a rectangular member twice along the longitudinal direction thereof and the directions in which the member is bent twice are different directions.

In this manner, when the regulation blade is supported by the blade support plate pertaining to the present embodiment that includes the first bent portion, the support portion and the second bent portion, which are formed by bending a rectangular member along the longitudinal direction thereof, and in which the support portion supports the regulation blade and where the direction in which the first bent portion is bent is opposite to the direction in which the second bent portion is bent, it becomes difficult for flexure to arise in the blade support plate because of the strength of the rigidity of the blade support plate. Thus, it also becomes difficult for flexure to arise in the regulation blade supported by the blade support plate, and it becomes possible to make the pressure of the regulation blade on the developing roller even.

Additionally, the aforementioned two effects are compounded so that the pressure of the regulation blade on the developing roller becomes more even and, as a result, the charge of the toner can be made even.

Also, this evenness of the charge can reduce drawbacks such as image deterioration, toner leakage and toner scattering.

Figure 21:
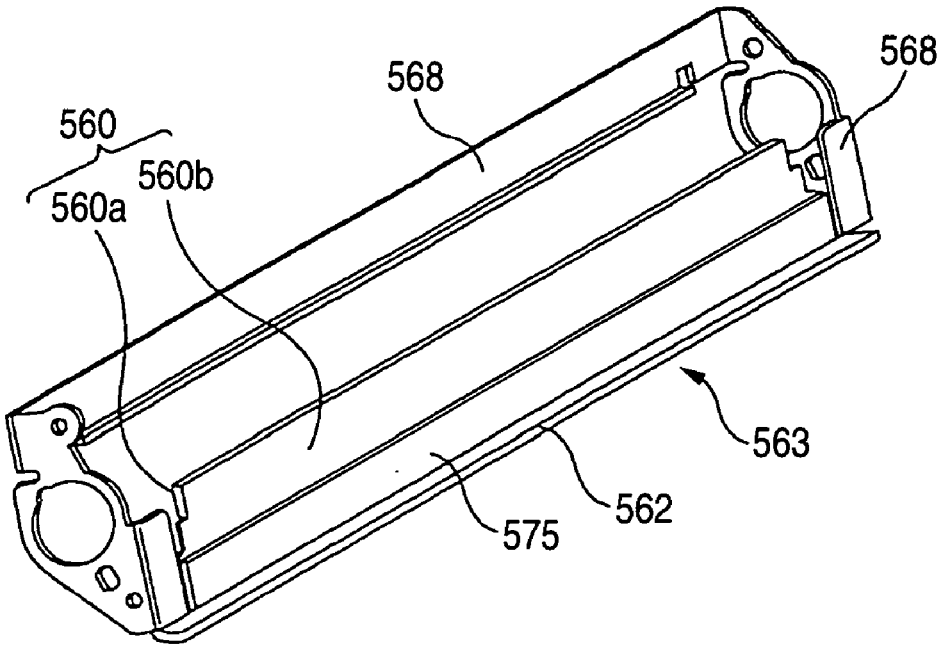
FIG. 21 is a perspective view showing the toner charging unit 563.

It should be noted that, in the above description, although not only the function of determining the free length but also functions such as supporting the seal member 520 and passing the developing roller 510 were given to the frame 568 that is the free length determining member, the invention is not limited to the same. For example, as shown in FIG. 21, the function of determining the free length may be separated from the frame 568 and given to the free length determining member 575 shown in FIG. 21, and the functions of supporting the seal member 520 and passing the developing roller 510 may be given to the frame 568 from which the function of determining the free length has been separated. FIG. 21 is a diagram corresponding to FIG. 16B and is a perspective view showing the toner charging unit 563.

Also, in the above-described embodiment, although the frame included the abutment portion for abutting against the regulation blade and the distance from the end of the abutment portion closest to the free length of the regulation blade was shorter than the distance from the fixed portion, at which the regulation blade and the blade support plate were fixed, to the free length, the invention is not limited thereto. The frame may be configured in any manner as long as it determines the free length of the regulation blade.

However, by configuring the frame in this manner, the frame can reliably determine the free length rather than the fixed portion, and in this respect the above-described embodiment is more preferable.

Also, although the regulation blade in the above-described embodiment was nipped between the frame and the blade support plate, the regulation blade is not limited thereto.

However, in this situation, because the regulation blade is stably supported and it becomes difficult for flexure to arise in the regulation blade, it becomes possible to further make the pressure of the regulation blade on the developing roller even. Consequently, the above-described embodiment is preferable in that the charge of the toner can be made more even.

Also, although the regulation blade in the above-described embodiment included the rubber portion abutting against the developing roller and the rubber support portion for supporting the rubber portion, with the rubber support portion being nipped between the frame and the blade support portion, the regulation blade is not limited thereto.

However, in this situation, because the rubber support portion is stably supported and it becomes difficult for flexure to arise in the rubber portion supported by the rubber support portion, it becomes possible to further make the pressure of the rubber portion on the developing roller even. Consequently, the above-described embodiment is preferable in that the charge of the toner can be made more even.

Also, although the thickness of the rubber support portion in the above-described embodiment was 1 mm or less, the invention is not limited thereto and the thickness may exceed 1 mm.

However, when the thickness of the rubber support portion is 1 mm or less, it becomes easy for the regulation blade to be affected by the flexure of the blade support plate due to the thinness of the rubber support portion. Thus, the above-described embodiment is more preferable in that the aforementioned effect—i.e., the effect of suppressing the occurrence of flexure of the blade support plate, so that it becomes possible to reduce the flexure of the regulation blade supported by the blade support plate and make the charge of the toner even—is more effectively exhibited.

Also, although the blade support plate and the regulation blade were fixed in the above-described embodiment by spot welding, in addition thereto, the free length determining portion of the frame and the regulation blade may also be fixed by spot welding. In so doing, because the regulation blade is stably supported and it becomes difficult for flexure to arise in the regulation blade, it becomes possible to further make the pressure of the regulation blade on the developing roller even. Consequently, the above-described embodiment is preferable in that the charge of the toner can be made more even.

Also, although the regulation blade and the support portion of the blade support plate in the above-described embodiment were fixed by spot welding at plural places along the longitudinal direction of the regulation blade, the invention is not limited thereto.

However, in this case, there is the potential for the regulation blade to become bent along the line joining the plural spot-welded places as a result of the spot-welded places being plural along the longitudinal direction of the regulation blade. In this situation, because the free length of the regulation blade is determined by the spot-welded positions on the regulation blade, the charge of the toner becomes more uneven. Thus, the above-described embodiment is more preferable in that the aforementioned effect—i.e., the effect that it becomes possible to make the charge of the toner even by disposing the free length determining member in the toner charging unit and determining the free length with the free length determining member rather than the spot-welded positions on the regulation blade—is more effectively exhibited.

Also, although the blade support plate in the above-described embodiment was fixed by screws to the free length determining member at both longitudinal-direction end portions of the support portion of the regulation blade, the invention is not limited thereto.

However, in this case, the above-described embodiment is more preferable in that the free length is reliably determined by the free length determining member.

Also, although the spot welding in the above-described embodiment was done with laser welding, the invention is not limited thereto and the spot welding may also be done with another welding method.

However, the above-described embodiment is more preferable in that, by using laser welding, accurate and precise control becomes possible and one is liberated from the difficulty of welding together plates whose materials are different and whose thicknesses are different.

===Configuration of Computer System===

Next, an embodiment of a computer system that is an example of an embodiment of the invention will be described with reference to the drawings.

Figure 22:
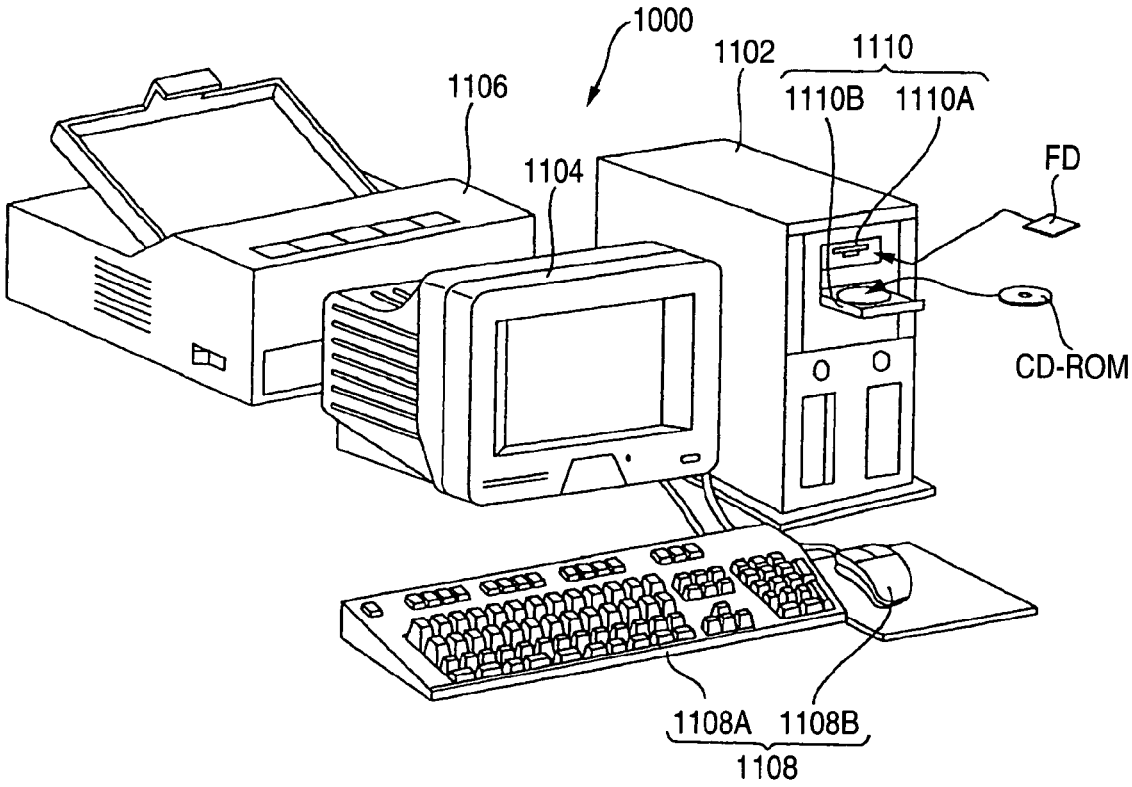
FIG. 22 is an explanatory diagram showing the external configuration of a computer system.

FIG. 22 is an explanatory diagram showing the external configuration of the computer system.

A computer system 1000 is disposed with a computer mainframe 1102, a display device 1104, a printer 1106, input devices 1108 and a reading device 1110. Although the computer mainframe 1102 in the present embodiment is mini-tower type case, it is not limited thereto. With respect to the display device 1104, although it is common for a CRT (Cathode Ray Tube), plasma display or liquid crystal display device to be used, the display device 1104 is not limited thereto. The above-described printer is used for the printer 1106. With respect to the input devices 1108, although a keyboard 1108A and a mouse 1108B are used in the present embodiment, the input devices 1108 are not limited thereto. With respect to the reading device 1110, although a flexible disk drive device 1110A and a CD-ROM drive device 1110B are used in the present embodiment, the reading device 1110 is not limited thereto and other devices, such as an MO (Magneto Optical) disk drive device or a DVD (Digital Versatile Disk) device may be used therefor.

Figure 23:
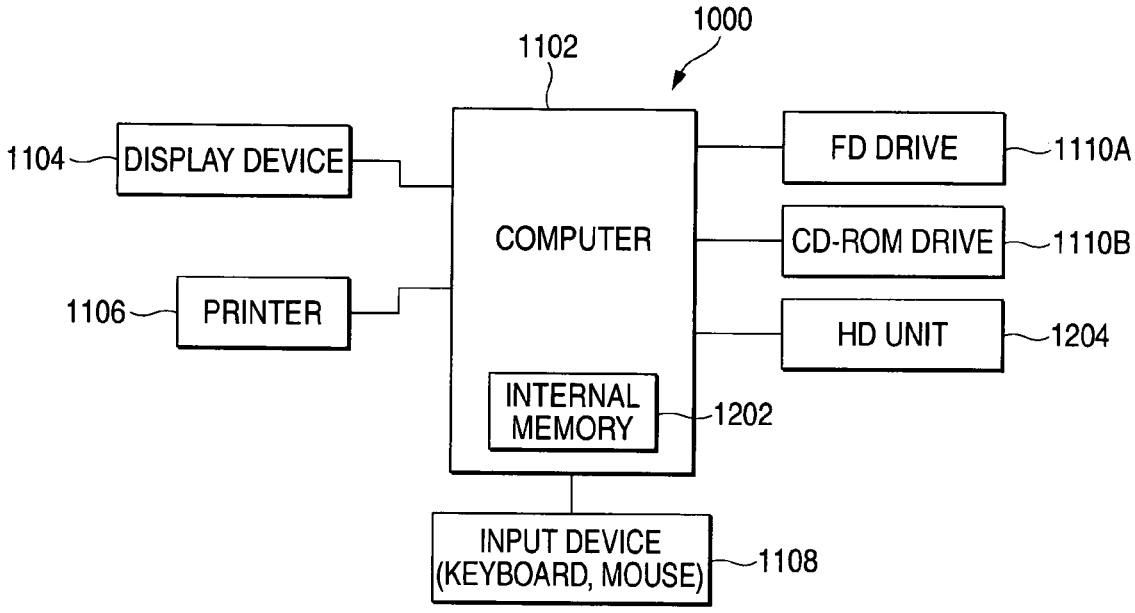
FIG. 23 is a block diagram showing the configuration of the computer system shown in FIG. 22.

FIG. 23 is a block diagram showing the configuration of the computer system shown in FIG. 22. An internal memory 1202 such as a RAM and an external memory such as a hard disk drive unit 1204 are also disposed inside the case in which the computer mainframe 1102 is accommodated.

It should be noted that, although an example is described in the present embodiment where the computer system is configured with the printer 1106 being connected to the computer mainframe 1102, the display device 1104 and the reading device 1110, the computer system is not limited thereto. For example, the computer system may also be configured by the computer mainframe 1102 and the printer 1106, and the computer system does not have to be disposed with any of the display device 1104, the input devices 1108 and the reading device 1110.

Also, the printer 1106 may include part of the functions or mechanisms of each of the computer mainframe 1102, the display device 1104, the input device 1108 and the reading device 1110. As an example, the printer 1106 may have a configuration including an image processing unit for conducting image processing, a display unit for conducting various display, and a recording media loading unit for loading recording media on which image data shot by a digital camera or the like is recorded. The computer system realized in this manner becomes a system that is more excellent as an overall system than conventional systems.

According to the invention, it becomes possible to realize a developer carrier suitable for suppressing the occurrence of density unevenness appearing in an image, a developing device disposed with the developer carrier, a developer charging unit for making the charge of the developer even, an image forming apparatus disposed with these, and a computer system.

SECOND EMBODIMENT

Figure 24:
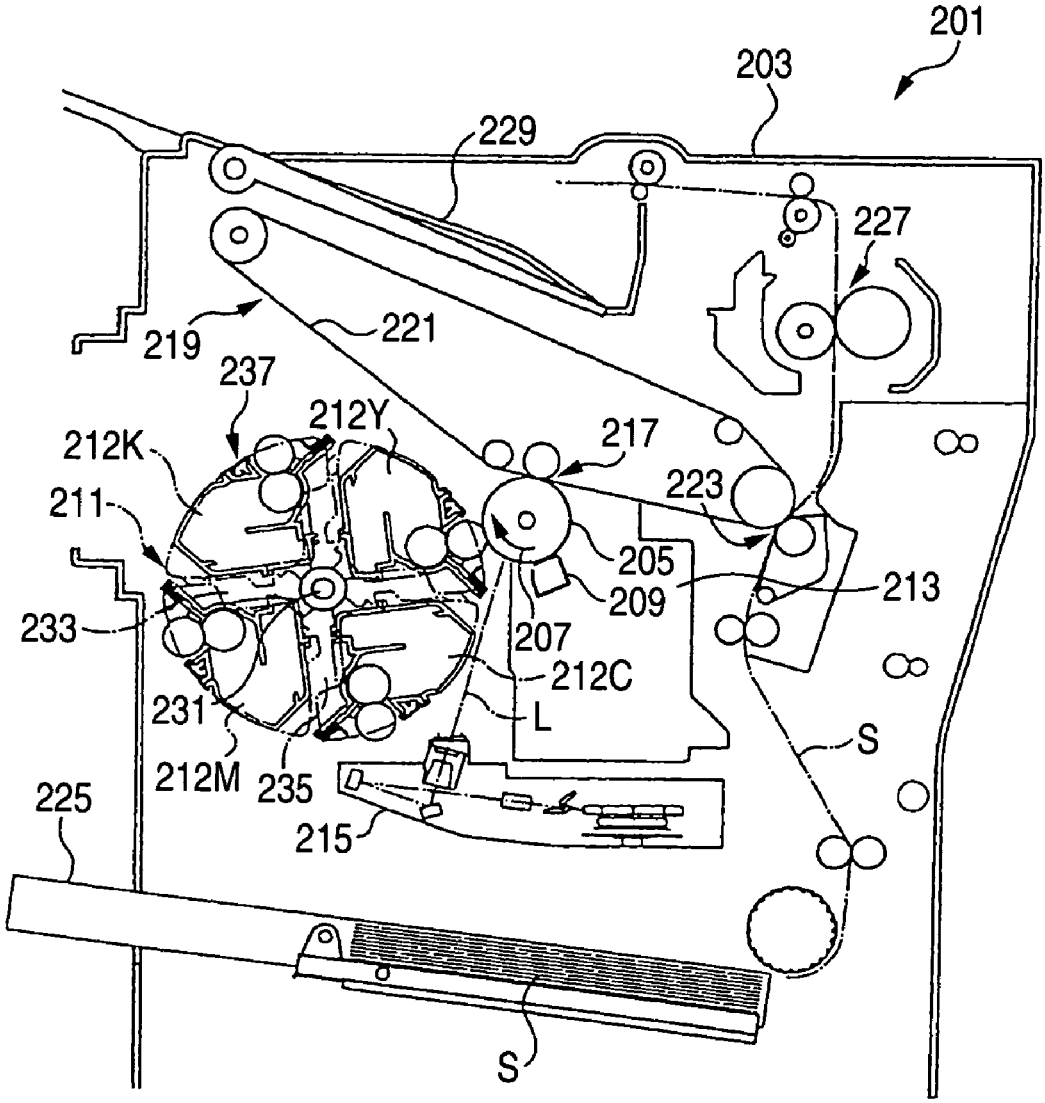
FIG. 24 is a side sectional view showing an image forming apparatus to which the present invention is applied.
Figure 25:
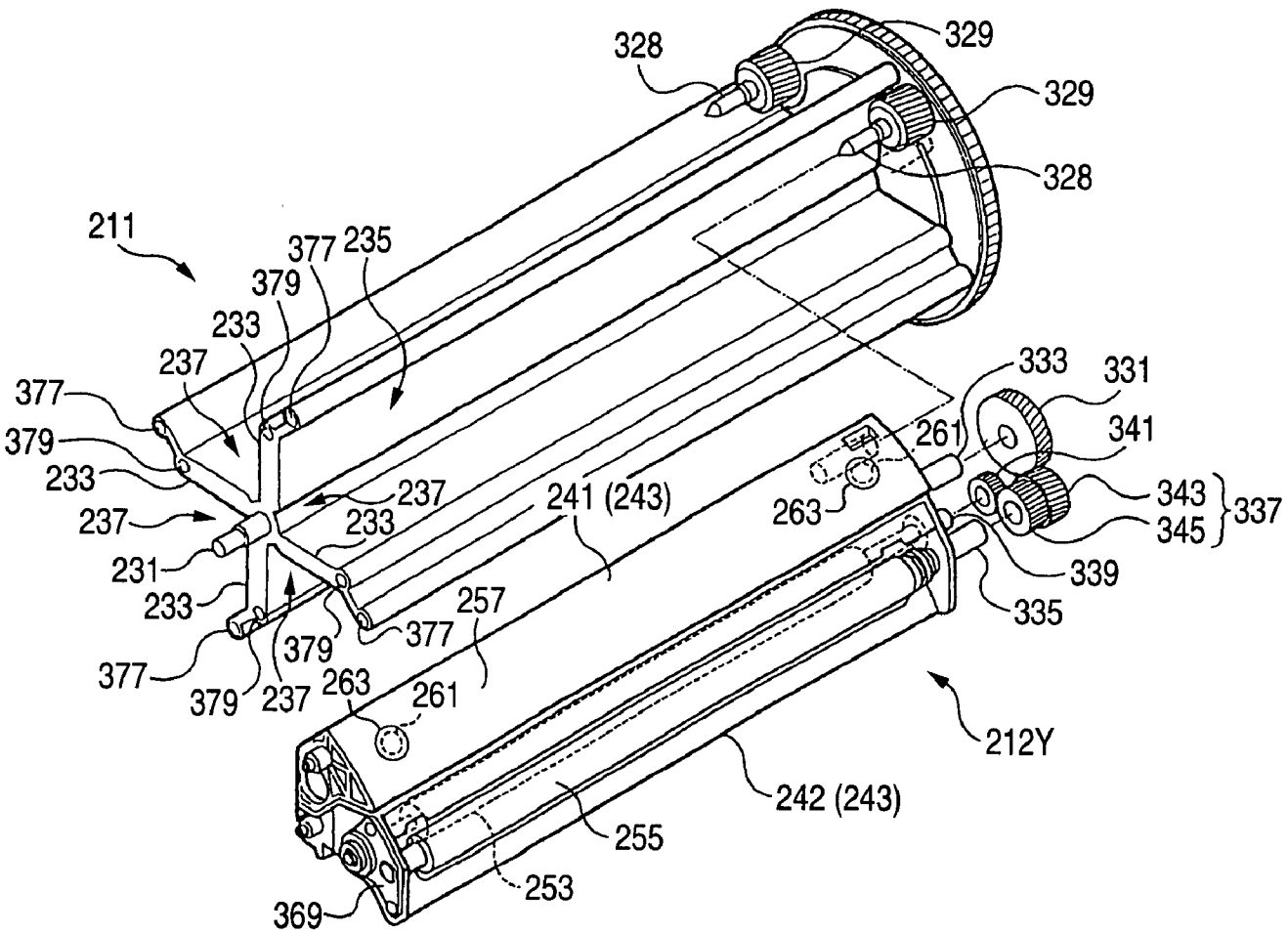
FIG. 25 is a perspective view of a rotary development unit of the invention.
Figure 26:
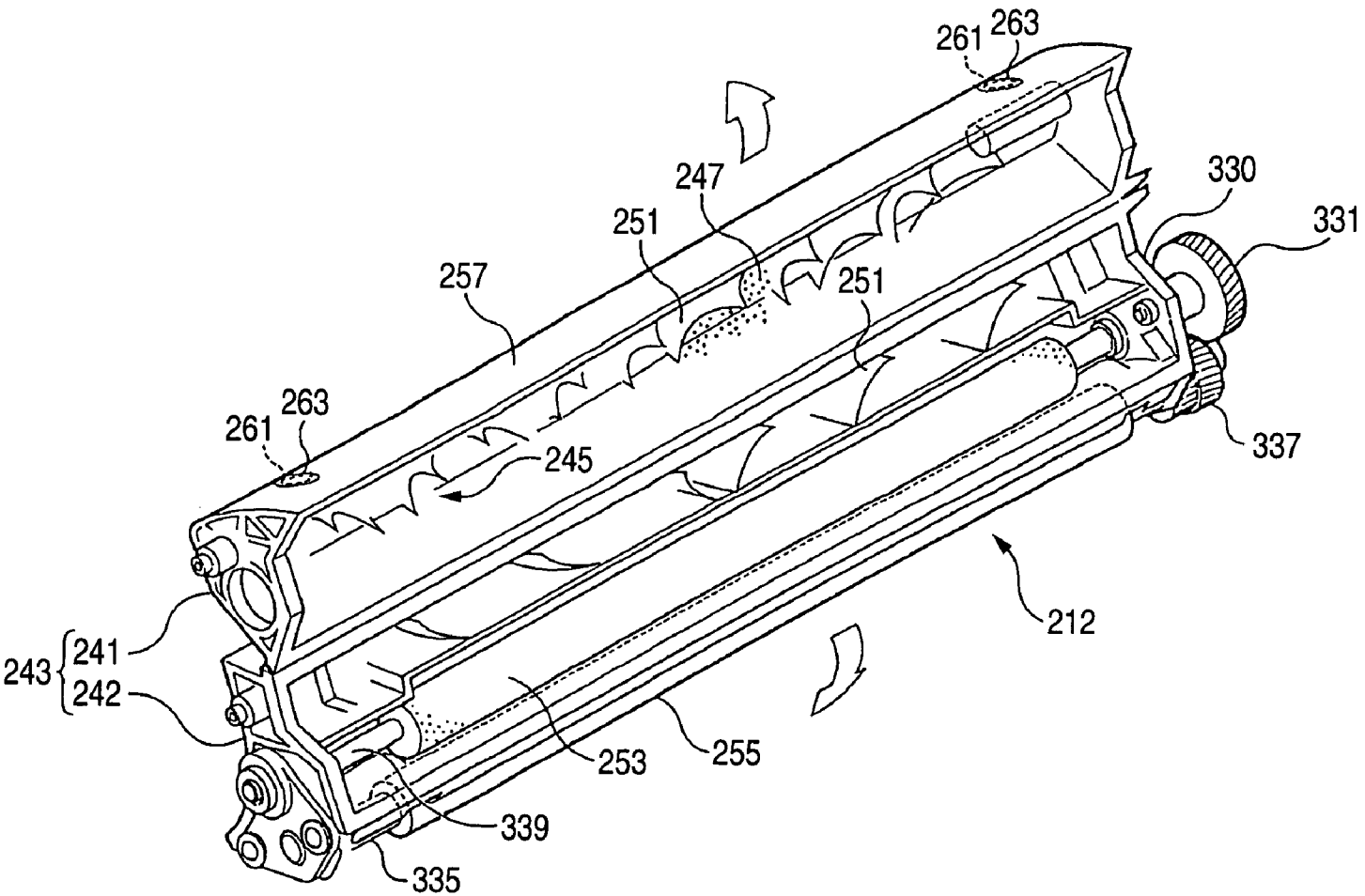
FIG. 26 is a perspective view of a developing cartridge (developing device of the invention) in the state the housing member of the invention is opened.
Figure 27:
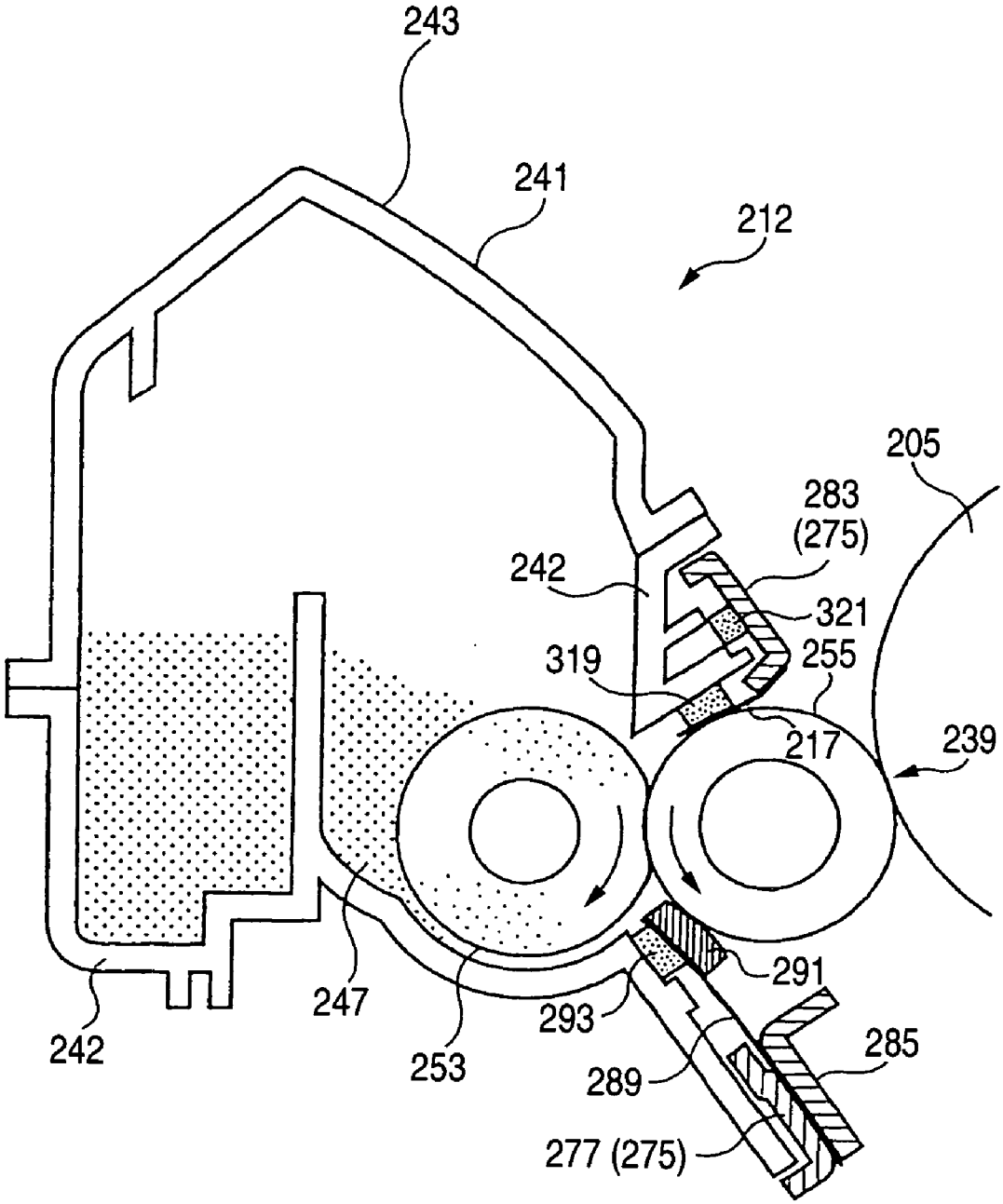
FIG. 27 is a side sectional view of a developing device of this invention.
Figure 28A:
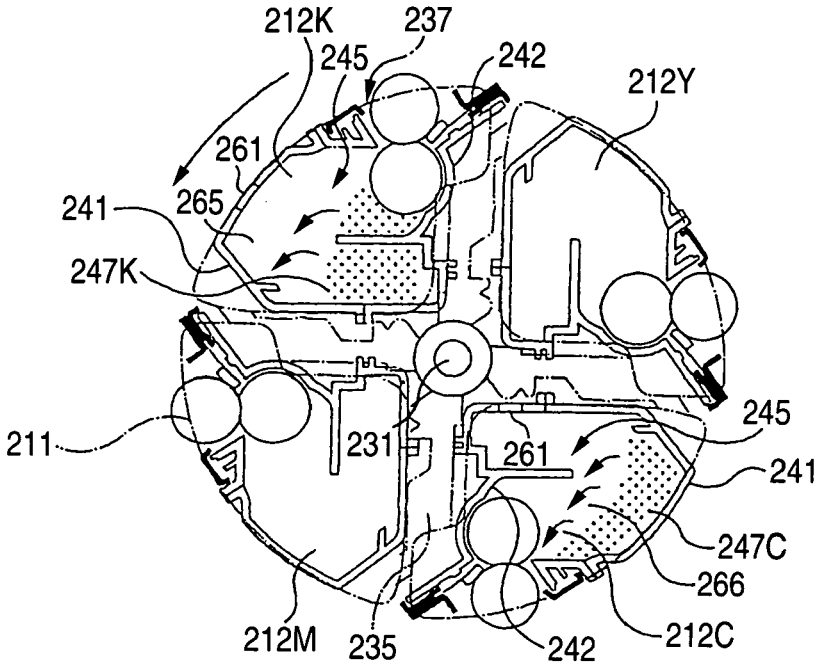
FIGS. 28A and 28B are explanatory views showing the movement of the toner during rotation of the invention.
Figure 28B:
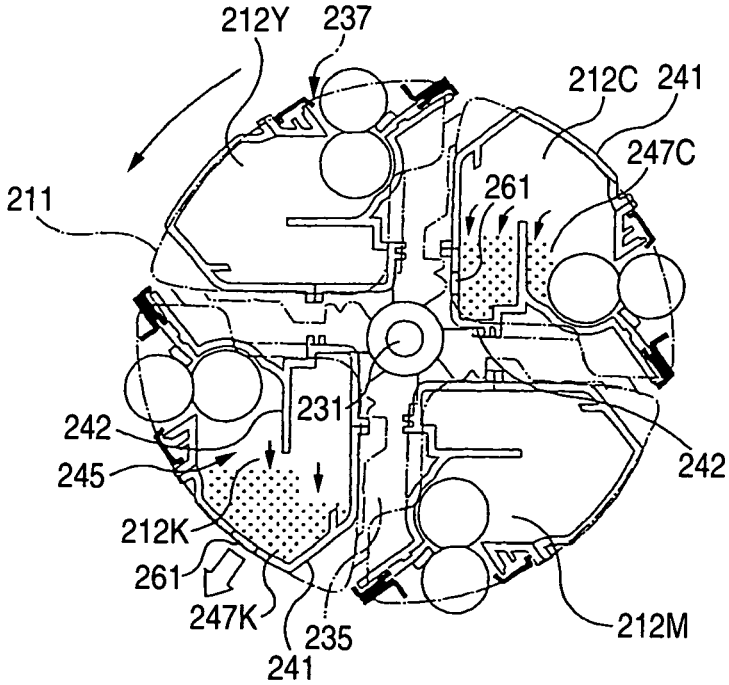

Second embodiment of the present invention will now be explained on the basis of the drawings. FIG. 24 is a side sectional view showing an image forming apparatus provided with a heat releasing device in a developing cartridge (developing device according to the present invention). FIG. 25 is a perspective view of a rotary development unit. FIG. 26 is a perspective view showing the upper and lower housing members in a state they are opened in the direction of the arrows. FIG. 27 is a side sectional view of the developing cartridge. Meanwhile, FIGS. 28A and 28B are explanatory views showing the toner movement within the cartridge as the rotary development unit is rotated from a state of FIG. 28A to a state of FIG. 28B, wherein notice is taken to the two developing cartridges.

Figure 29A:
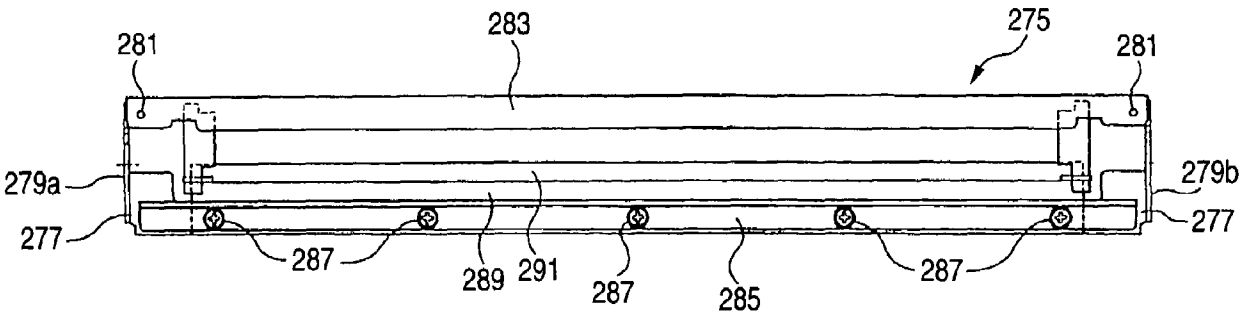
FIG. 29A is a front view showing the roller support frame overall of the invention.
Figure 29C:
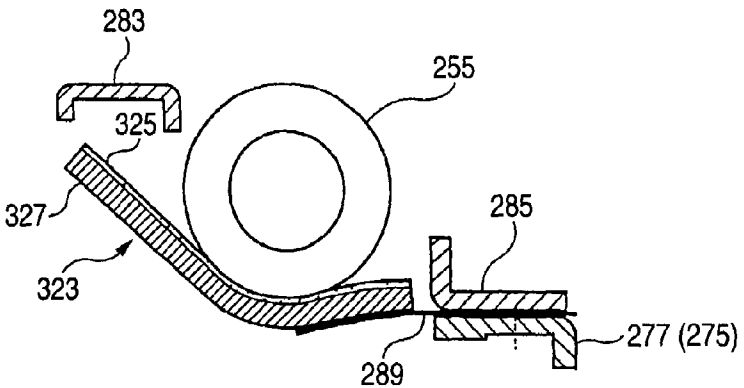
FIG. 29C is a side sectional view showing a roller end seal member and the periphery of the roller support frame.
Figure 29B:
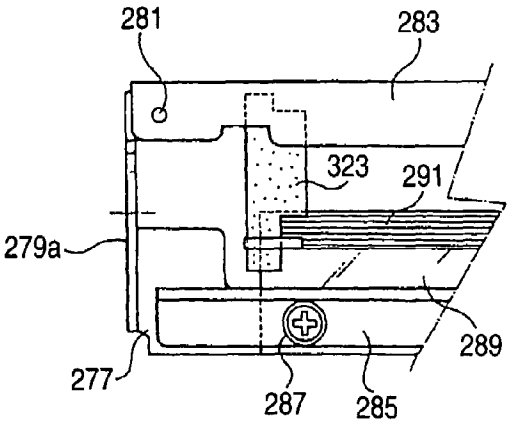
FIG. 29B is an enlarged view of the left-side part of the roller support frame.
Figure 30B:
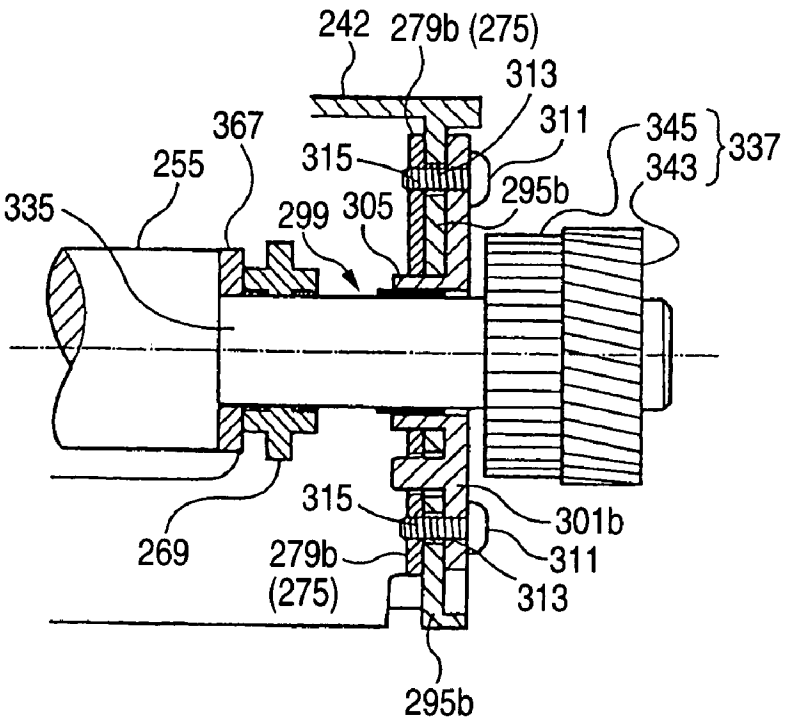
FIG. 30B is a sectional view showing a manner of supporting the shaft by breaking away the right side of the developing roller 55 of FIG. 26.
Figure 30A:
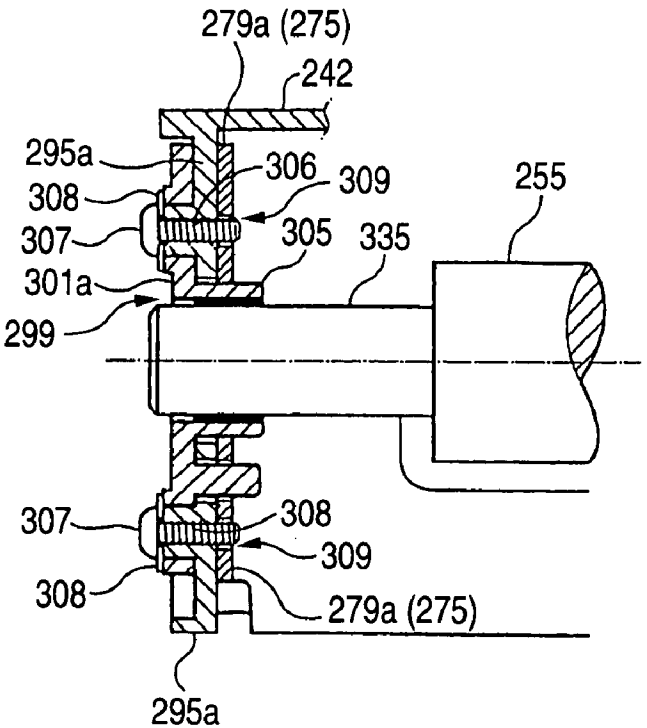
FIG. 30A shows a manner of supporting the shaft by breaking away the left side of the developing roller.
Figure 31:
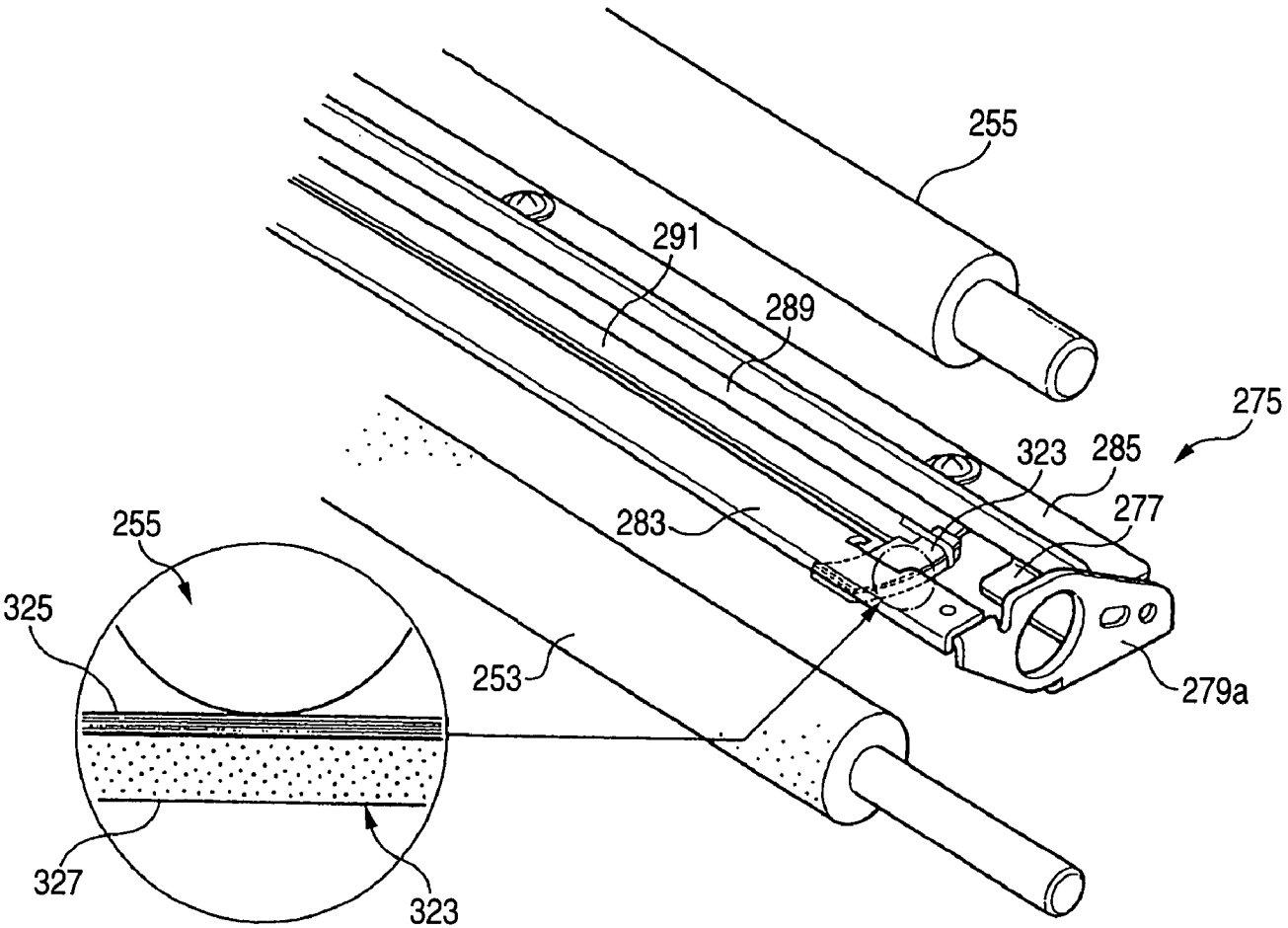
FIG. 31 is a perspective view of a roller support frame, supply roller and developing roller of this invention.

Furthermore, FIG. 29A is a front view showing the entire roller support frame, FIG. 29B is an enlarged view of a left part of the roller support frame, and FIG. 29C is a side sectional view showing a roller-end seal member and the roller support frame and the periphery thereof. FIG. 30A shows the manner of supporting a shaft by breaking away the left-side part of the developing roller of FIG. 26 while FIG. 30B shows the manner of supporting the shaft by breaking away the right-side part of the developing roller of FIG. 26. Furthermore, FIG. 31 is a perspective view showing the roller support frame and the supply and developing rollers supported thereon.

In an image forming apparatus 201 to which the present invention is applied, a photosensitive drum (photosensitive body of the invention) 205 is arranged for rotation in a direction at the arrow 207 within an apparatus main body 203. In a periphery of the photosensitive drum 205, there are arranged a charging unit 209, a rotary development unit 211 supporting a developing cartridge serving as developing device and a cleaning unit 213, along in the rotation direction 207. The charging unit 209 is applied with a charging bias voltage from a charging bias voltage circuit (not shown), to cause a uniform charge over the outer peripheral surface of the photosensitive drum 205.

An optical exposure unit 215 is arranged below the rotary development unit 211. The optical exposure unit 215 illuminates laser light L toward the outer peripheral surface of the photosensitive drum charged by the charging unit 209. The optical exposure unit 215 scans laser light L for exposure over the photosensitive drum 205 according to the image data obtained by expanding an image forming command, to form an electrostatic latent image on the photosensitive drum 205 correspondingly to the image forming command.

The electrostatic latent image thus formed is developed with toner by the rotary development unit 211. Namely, this embodiment has, as the rotary development unit 211, a yellow developing cartridge 212Y, a cyan developing cartridge 212C, a magenta developing cartridge 212M and a black developing cartridge 212K, arranged for rotation about an axis of the rotary shaft 231 of the rotary development unit 211. The developing cartridges 212Y, 212C, 212M, 212K, if determined in circumferential position of the development unit 211, is allowed to selectively position close to the photosensitive drum 205 and supply toner to the surface of the photosensitive drum 205. Due to this, the electrostatic latent image on the photosensitive drum 205 is developed into an actual image in the selected toner color. In FIG. 24 is shown the state the yellow developing cartridge 212Y is to supply toner to the photosensitive drum 205. Note that, in this description, when the term "upper" or "lower" is used in concerned with the developing cartridge, the direction of the developing cartridge 212Y in FIG. 24 is taken as a reference while when the term "left" or "right" is used in relation to the developing cartridge, the direction of the developing cartridge in FIG. 26 is taken as a reference.

A transfer unit 219 is arranged above the region of from the rotary development unit 211 to the cleaning unit 213. The transfer unit 219 has an intermediate transfer belt 221 stretched over a plurality of rollers, and a drive part (not shown) for rotatively driving the intermediate transfer belt. The toner image developed by the development unit 211, in a primary transfer region 217, is primarily transferred onto the intermediate transfer belt 221 of the transfer unit 219. Meanwhile, the photosensitive drum 205, in a position rotated in a rotation direction shown at the arrow 207 from the primary transfer region 217, is scratched of the remaining toner on the outer peripheral surface of the photosensitive drum 205 after primary transfer, by the cleaning section 213.

In the case to transfer a color image onto a sheet S, the toner images in respective colors formed on the photosensitive drum 205 are laid together onto the intermediate transfer belt, thus formed into a color image. Furthermore, in a secondary transfer region 223, the color image is secondarily transferred onto the sheet S taken out of the cassette 225. The sheet S thus formed with a color image is transported onto a sheet discharge tray 229 provided in the upper part of the apparatus main body 203 via a fixing unit 227.

Next explained is the structure and operation of the rotary development unit 211 arranged on the image forming apparatus 201 of FIG. 24. As shown in FIG. 25, the rotary development unit 211 has the rotary shaft 231 at a center thereof. In the periphery of the rotary shaft 231, there is fixed on the rotary shaft 231 a support frame 235 structured with four frame elements 233 formed at an angular interval of 90 degrees. Between the frame elements 233, containers 237 are formed. The containers 237 respectively accommodate developing cartridges 212Y, 212C, 212M and 212K in four respective colors, as noted before, fixed on the support frame 235 by not-shown fixing hardware. Note that the developing cartridge 212Y only is shown in FIG. 25, for simplification sake.

The rotary shaft 231 is connected with a drive part, not shown, through a clutch. By driving the drive part, the support frame 235 is structurally rotated to selectively position anyone of the four developing cartridges 212Y, 212C, 212M, 212K in a developing position (position of the developing cartridge 212Y, in FIG. 24) opposed to the photosensitive drum 205.

The developing cartridges 212Y, 212C, 212M, 212K, to be held by the support frame 235, have the same structure. Consequently, the developing cartridges 212Y, 212C, 212M, 212K herein are commonly referred to as a developing cartridge 212 in the below explanation.

For the developing cartridge 212, an upper housing member 241 and a lower housing member 242 are assembled together and formed into a housing 243 as a main body.

As shown in FIG. 26, the housing 243 is formed therein with a toner container 245 for accommodating a toner. The toner container 245 is formed with a plurality of agitating protuberances 251 slanted to agitate the toner 247. When the rotary development unit 211 rotates about the rotary shaft 231, the toner 247 falls along the agitating protuberances 251 so that the toner 247 can be agitated within the toner container 245.

Meanwhile, in the toner container 245, a supply roller 253 (referred also to as S roller) in a state held on a metal rotation shaft 339 is rotatably arranged on the housing 243. As shown in FIGS. 26 and 27, there is provided on the outer side of the supply roller 253 a developing roller 255 (referred also to as D roller) for rotation relative to the housing 243, in a state contacted with the supply roller 253 and held on a metal rotation shaft 335. When the supply roller 253 in a state carrying on its surface the toner 247 contained in the housing 243 rotates in a direction of the arrow (FIG. 27), the developing roller 255 rotates in a direction of the arrow in FIG. 27 at a speed lower than the supply roller 253 while receiving, at its outer peripheral surface, toner 247 from the supply roller 253. In this embodiment, the supply roller 253 assumably rotates at a speed 1.5 times faster than the developing roller 255. Note that the supply roller 253 and developing roller 255 can be charged through the application of a charging bias voltage by a mechanism, hereinafter referred.

As shown in FIG. 27, the developing roller 255 rotates in contact with the developing roller 255. The toner 247 carried on the developing roller 255, in a developing position 239, is put onto the surface of the photosensitive drum 205. In this manner, toner 247 is rubbed from the supply roller 253 onto the surface of the developing roller 255. Thus, a toner layer is formed in a predetermined thickness (e.g. approximately 10–20 mm). The toner layer is similarly transferred onto the photosensitive drum 205.

Referring back to FIG. 25, the upper member 241 configuring the housing 243 has a communication hole 261 formed in the upper surface 257, to allow the air within the toner container 245 to communicate with the air. The communication hole 261 is bonded with a seal 263 formed with a multiplicity of fine pores in a size to pass air but not to pass toner. By providing such air communicating means with the toner container 245 in the upper surface 257 of the upper housing member 241, when the rotary development unit 211 rotates about the rotary shaft 231, the toner 247 falls down to thereby expel the lower air through the communication hole 261. This can replace the air at within the toner container 245.

FIGS. 28A and 28B show the movement of toner 247 within the developing cartridge 212C, 212K as notice is given to the developing cartridges 212C and 212K when the rotary development unit 211 rotates from a state shown in FIG. 28A to a state shown in FIG. 28B. Note that the seal is omitted in the showing of FIGS. 28A and 28B.

In FIG. 28A, the toner 247K within the developing cartridge 212K is in a position close to the lower housing member 242. Thereafter, when the rotary development unit 211 rotates to the position shown in FIG. 28B, the toner 247K within the developing cartridge 212K moves falling toward the upper housing member 241. At that time, the air of the space region 265 within the toner container 245 is expelled through the communication hole 261 by the toner 247K falling from the above in a covering manner.

By thus allowing the air within the toner container 245 to freely communicate with the air, the pressure within the toner container 245 does not become negative even in the course of consuming the toner 247 within the toner container 245. Thus, the pressure within the toner container 245 can be always kept equal to the atmospheric pressure. Meanwhile, even where there is a heat generating source nearby the toner container 245, the air within the toner container 245 can be prevented from expanding into a pressurizing state due to the heat of from the heat generating source. Accordingly, the supply state of toner from the toner container 245 can be maintained constant at all times by excluding the influence of the pressure within the toner container 245.

Next explained is the peripheral structure of the developing roller 255 in the developing cartridge 212, with reference to FIGS. 27, 29A, 29B, 29C and 31. The housing 243 of the developing cartridge 212 is fixed with a roller-support frame 275. The roller-support frame 275, entirely constructed of metal, is structured with a lower frame part 277, side frame parts 279*a*, 279*b* formed by bending 90 degrees at both ends of the lower frame part 277 and an upper frame part 283 connected on the upper ends of the side frame parts 279*a*, 279*b* by screws 281. In a region surrounded by the lower frame part 277, the upper frame part 283 and the two side frame parts 279*a*, 279*b*, the developing roller 255 can be arranged.

Meanwhile, as shown in FIGS. 29A, 29B and 29C, a blade fixing frame 285 is mounted on the lower frame part 277 by a plurality of fixing screws 287. Between the blade fixing frame 285 and the lower frame part 277, a blade support frame 289 of phosphor bronze is provided as shown in FIG. 27. A regulation blade 291 of rubber, a resin member or the like is bonded on the upper surface at a tip of the blade support plate 289. The regulation blade 291 is urged at a constant pressure against the peripheral surface of the developing roller 255 throughout the lengthwise thereof, by the spring restoring action of the blade support plate 289 itself and the elastic restoring action of a backup sponge 293 (see FIG. 27) provided in the beneath at the tip of the blade support plate 289.

The regulation blade 291 has a property to charge toner 247 placed in friction therewith, into the same polarity as that thereof. In this manner, the toner charged in a predetermined polarity is supplied onto the developing roller 255 so that the electrostatic latent image on the photosensitive drum 205 can be developed with the toner 247 over the developing roller 255.

Meanwhile, the regulation blade 291 has a function to level out the toner on the developing roller 255 uniformly to a final thickness of approximately 20 mm, for example. Accordingly, in order to make the thickness of toner uniform throughout the lengthwise of the developing roller, it is emphasized for the developing cartridge 212 so that the regulation blade 291 is urged at a constant pressure against the peripheral surface of the developing roller 255 throughout the lengthwise thereof.

In order to secure such a uniform urge pressure of the regulation blade 291 on the developing roller 255, the upper frame part 283 is added as a constituent element of the roller support frame 275 as mentioned above, to make the roller support frame 275 in a closed loop structure.

Namely, by adopting the closed loop structure to unitize the developing roller 255 and the regulation blade 291 together, the roller support frame 275 is improved in shape retainability. When the developing cartridge 212 is loaded in the container 237 of the rotary development unit 211 or unloaded therefrom, even if a considerable force is applied to the roller support frame 275, the developing roller 255 and the regulation blade 291 are not readily changed in positional relationship throughout the lengthwise thereof. Due to this, the regulation blade 291 is continuously urged always at a constant force on the peripheral surface of the developing roller 255. This makes it possible to prevent the distribution of toner 247 from deviating lengthwise on the peripheral surface of the developing roller 255, thus preventing against poor printing such as uneven depth of color.

Next explained is the structure of attaching the roller support frame 275 on the lower housing member 242, with reference to FIGS. 30A and 30B. FIG. 30A shows the manner of supporting the rotation shaft 335, by braking away the left part of the developing roller 255. FIG. 30B shows the manner of supporting the rotation shaft 335, by braking away the right part of the developing roller 255.

As shown in FIGS. 30A and 30B, the lower housing member 242 has end faces 295*a*, 295*b* each formed with a supply-roller through-hole (not shown) and developing-roller through-hole 299. Shaft support members 301*a*, 301*b* are provided on the outer side of the end faces 295*a*, 295*b*.

Meanwhile, the rotation shaft 335 of developing roller 255 at its both ends is rotatably supported by shaft support parts 305 extending from the shaft support member 301*a*, 301*b* to the inside of the developing-roller through-hole 299. As shown in FIG. 30A, two holes 306 are formed somewhat smaller than the external diameter of the screw 307, in the left end face 295*a* of the lower housing member 242. By forcibly screwing the screws 307 there through washers 308, fixing is made between the shaft support member 301*a* on the left and the left end face 295*a* of the lower housing member 242. Meanwhile, in the left side frame part 279*a* of the roller support frame 275, two holes for screws 307 are formed in positions aligned with the holes 306 in the left end face 295*a* of the lower housing member 242. However, these holes are made in free holes 309 greater than the external diameter of the screw 307, in which the screws 307 are received.

On the other hand, two free holes 313 are formed greater than the external diameter of the screw 311, in the right end face 295*b* of the lower housing member 242. In the right-side frame part 279*b* of the roller support frame 275, formed are two screw holes 315 formed with female threads for screws 311 in aligned positions. By screwing the screw 311 in the free hole 313 and screw hole 315 through the hole formed in the right shaft support member 301*b*, fixing is integrally made between the right shaft support member

301*b*, the right end face 295*b* of the lower housing member 242 and the right side frame part 279*b*.

This structure results in a relationship between the housing 243 and the roller support frame 275 that, on the right, they are mutually fixed to restrict the movement in a direction lengthwise of the housing while, on the left, the side frame part 279*a* of the roller support frame 275 is not fixed to the end face 295*a* of the lower housing member, and hence the both are allowed to freely move in the lengthwise direction of the housing without mutual affections.

The reason of adopting this structure is because of the following. Namely, because the resin structuring the housing 243 has a greater thermal expansion coefficient than the metal structuring the roller support frame 275, a difference of expansion/contraction occurs between the housing 243 and the roller support frame 275 (housing 243 is greater in expansion/contraction difference) due to temperature change, which effect by such expansion/contraction difference should be eliminated. Namely, adopting the above structure makes it possible to prevent the roller support frame 275 from distorting due to a difference in expansion/contraction between the housing 243 and the roller support frame 275. Accordingly, it is possible to maintain at constant the abutment pressure of the regulation blade 291 against the outer periphery of the developing roller 255 provided on the roller support frame 275, throughout the lengthwise thereof. Thus, toner supply can be realized without non-uniformity throughout the lengthwise.

Incidentally, although not clearly illustrated in FIGS. 30A and 30B, design is made to form a slight gap between the end face 295*a* of the lower housing member 242 and the side frame part 279*a* of the roller support frame 275 even in a state the lower housing member 242 shrinks in the greatest degree.

Next explained is the structure for preventing toner 247 from scattering from the toner container 245 to the outside. As shown in FIG. 27, in the above of the developing roller 255, a scatter-preventing seal member 317 is fixed on the upper frame part 283 of the roller support frame 275. The scatter-preventing seal member 317 has the other end urged toward the developing roller 255 by the backup sponge 319 fixed on the lower housing member 242. This prevents toner 247 from scattering to the outside through between the developing roller 255 and the upper frame part 283.

Meanwhile, a seal member 321 is bonded on an inner surface of the upper frame part 283 of the roller support frame 275. The seal member 321 closes the gap to the lower housing member 242, thereby preventing the toner 247 passed the backup sponge 319 from scattering to the outside.

Furthermore, as shown in FIGS. 29C and 31, the developing roller 255 has peripheral-surface both ends abutted against by roller-end seal members 323, thereby preventing toner 247 from scattering to the outside through the end of the developing roller 255. As shown in the partial enlarged view of FIG. 31, the roller-end seal member 323 is of a double layer structure that the upper low-friction functioning member 325 and the lower powder-seal functioning member 327 are bonded together. The upper low-friction functioning member 325 is structured of a material made to reduce the rotation frictional resistance in the contact surface with the developing roller 255 and excellent in durability against rotational friction, e.g. Fujiron 7000 (Registered Trademark) (by Fujiko K.K.). Meanwhile, the lower powder-seal functioning member 327 is structured of a material excellent in seal function against a powder such as toner, e.g. woolen felt.

The roller-end seal member 323 has a base end fixed on the blade support plate 289 or the lower frame part 277. The tip end of the roller-end seal member 323 is supported from the below by the lower housing member 242 without fixed to the lower housing member 242, thus being made as a free end.

By making the tip of the roller-end seal member 323 as a free end, there is a delicate change, by aging, of the contact between the both-end peripheral surface of the developing roller 255 and the roller-end seal members 323. This can avoid the roller-end seal member 323 at its same point from being worn out in a groove form and lowered in sealability.

Figure 32:
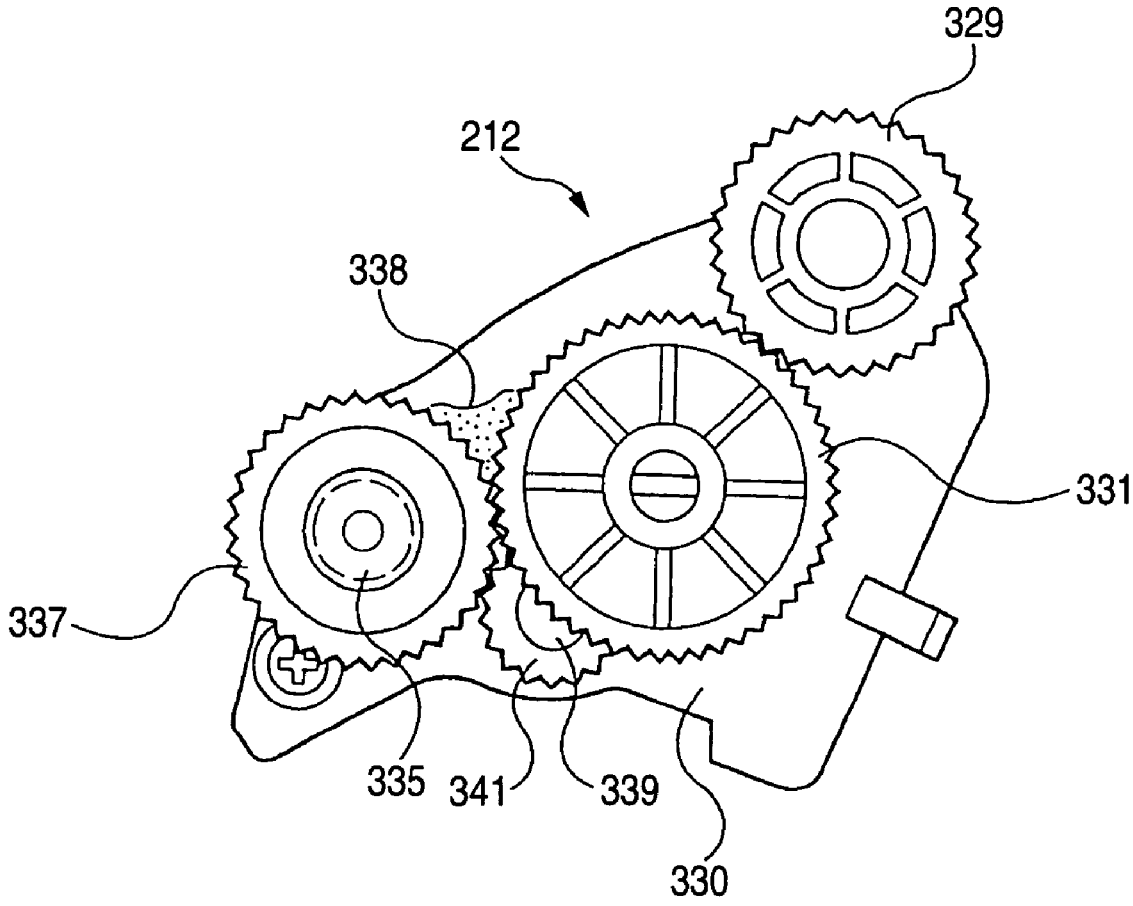
FIG. 32 is a side view showing a driving system of the supply and developing rollers of this invention.
Figure 33:
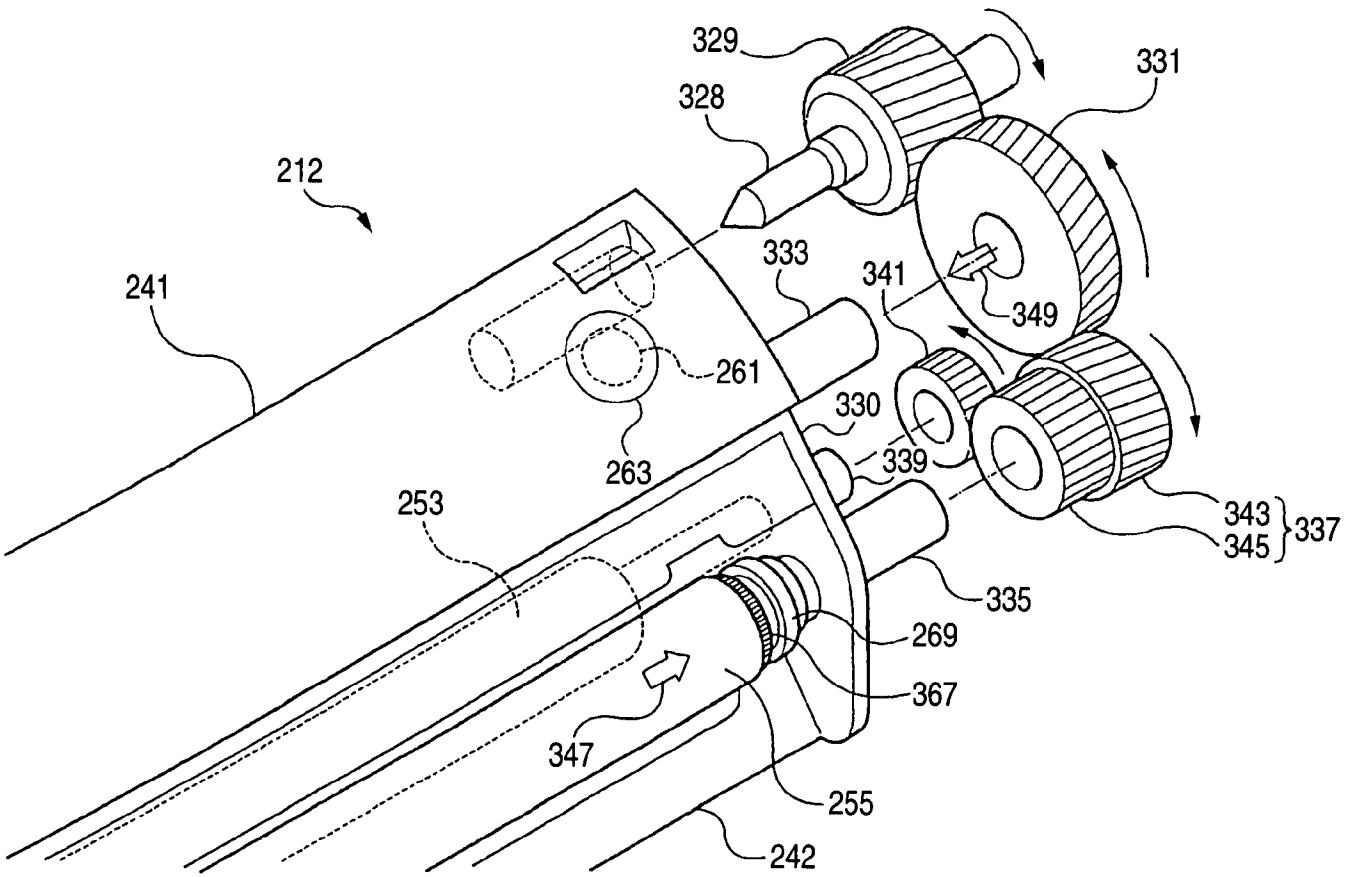
FIG. 33 is a partial perspective view showing a driving system of the supply and developing rollers of this invention.
Figure 34:
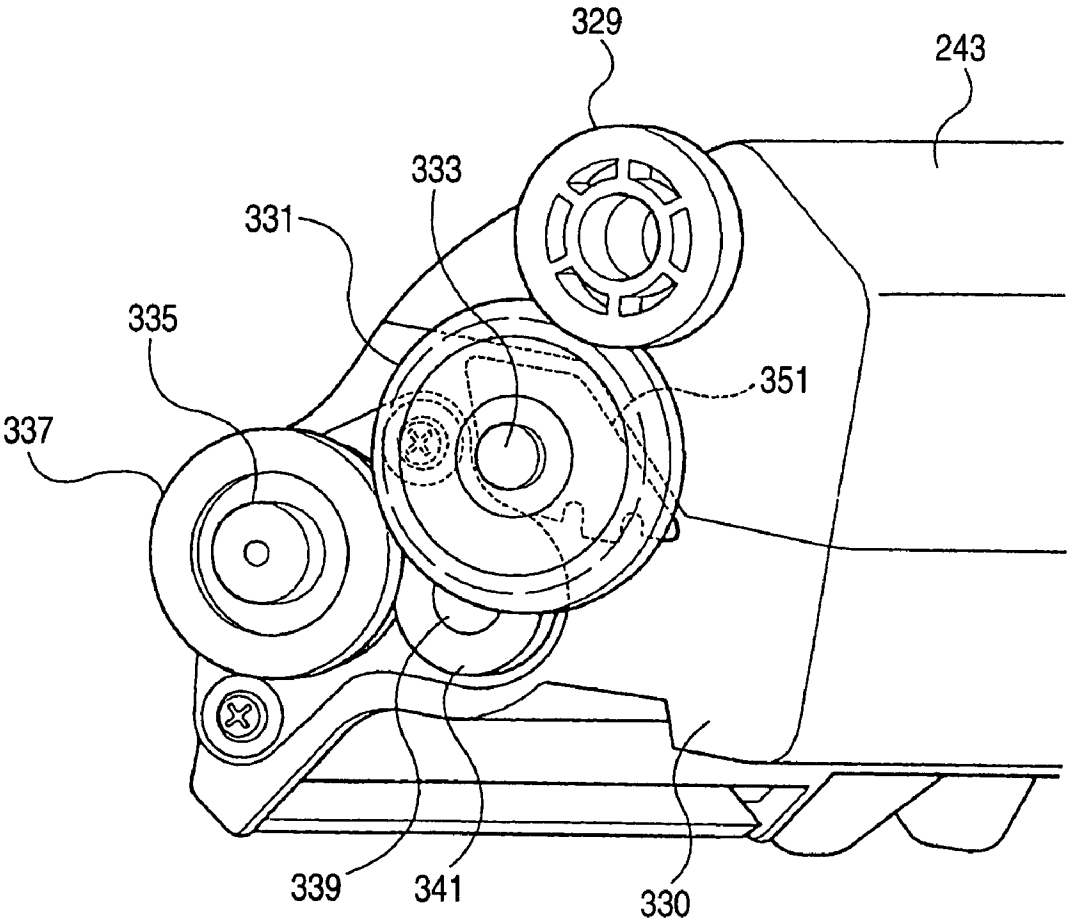
FIG. 34 is a side sectional view of around an idle gear of this invention.
Figure 35:
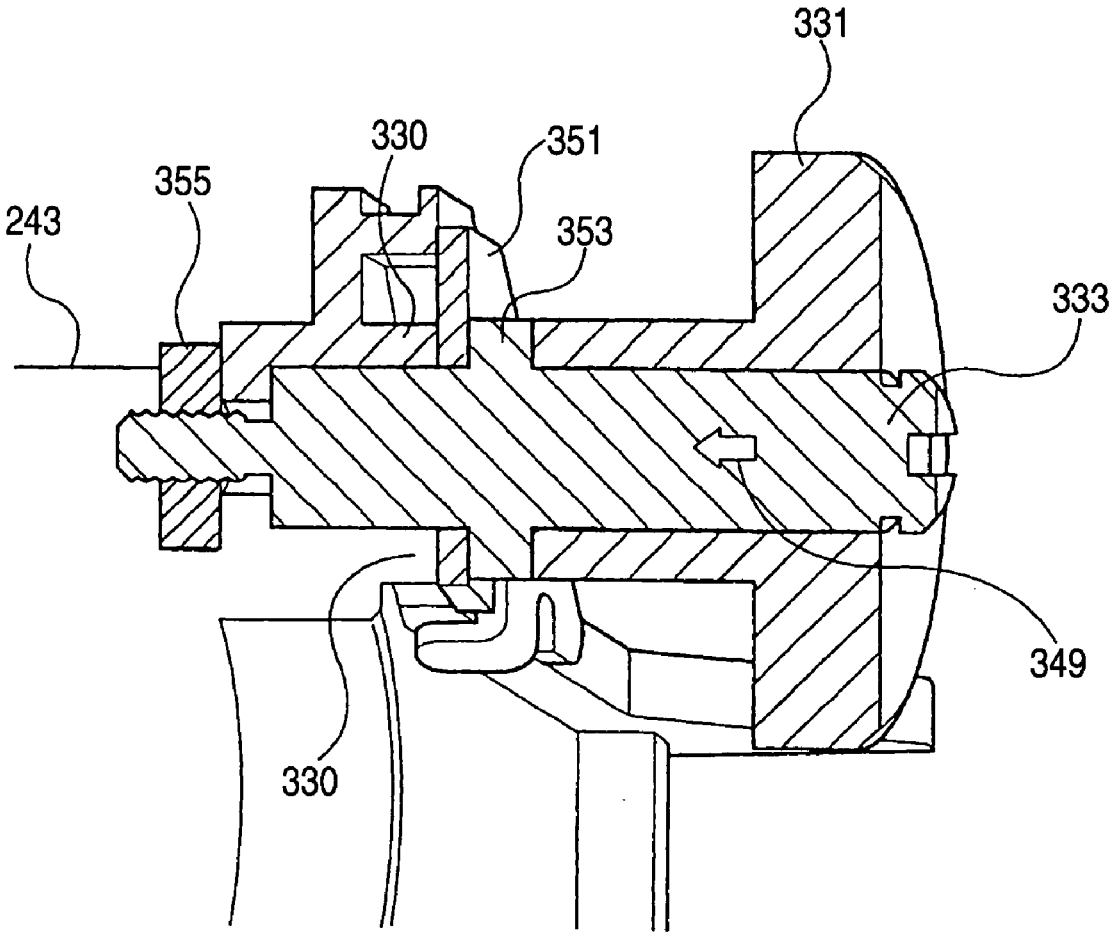
FIG. 35 is a sectional view of the idle gear of this invention, taken along the lengthwise axis of a rotation shaft thereof.

Next explained is the driving mechanism for the supply roller 253 and developing roller 255, with reference to FIGS. 32 to 35. FIG. 32 is a side view of the developing cartridge showing a driving system for the supply roller and developing roller. FIG. 33 is a partial perspective view of the developing cartridge showing the driving system for the supply roller and developing roller. FIG. 34 is a front view showing a right end face of the developing cartridge while FIG. 35 is a sectional view taken along the lengthwise axis of an idle gear rotation shaft.

In FIG. 32, the reference 329 designates a rotary gear. The rotary gear 329 is provided by being inserted on a pin 328 (see FIG. 25) formed inward from the end face of the container 237 of the rotary development unit 211. The rotary gear 329 is connected to a not-shown driving source, to deliver a driving force to the supply roller and developing roller through an idle gear, hereinafter referred, and the like.

As shown in FIG. 32, the rotary gear 329 is in mesh with the idle gear 331 as an adjacent intermediate gear. The idle gear 331 is rotatably provided on a support shaft 333 fixed on the right end face 330 (end face positioned right in FIG. 26) of the housing 243 of the developing cartridge 212. The idle gear 331 is also in mesh with a developing-roller driving gear 337 provided on the rotation shaft 335 of the developing roller 255. The developing-roller driving gear 337 is in mesh with a supply-roller driving gear 341 provided on the rotation shaft 339 of the supply roller 253.

The developing-roller driving gear 337 is structured by two gear parts, i.e. a first gear part 343 positioned outer and having a helical gear form and a second gear part 345 positioned inner and having a spur gear form. The second gear part 345 is adjacent to the first gear part 343 and has an outer diameter somewhat smaller than the first gear part 343. As shown in FIG. 32, when shipping the present developing cartridge 212, grease 338 is supplied above the point where the idle gear 331 is in mesh with the developing-roller driving gear 337. During rotation of the gear, grease 338 can be fed to all the gears through the gear peripheral surfaces. Incidentally, the place grease is provided may be above a point where the other gears are in mesh with.

The idle gear 331 has a helical gear form for mesh with the first gear part 343 of the developing-roller driving gear 337. Meanwhile, the rotary gear 329 also has a helical gear form for mesh with the idle gear 331. On the other hand, the supply-roller driving gear 341 has a spur gear form, which is in mesh with the second gear part 345 of the developing-roller driving gear 337.

The idle gear 331 and the first gear part 343 of developing-roller driving gear 337 have such a helical gear direction that, when the gears are rotated in the direction shown at the arrow in FIG. 33, the developing roller 255 is urged in a direction shown at the arrow 347. By thus adopting the helical gear on the driving mechanism for the supply roller 253 and developing roller 255, the developing roller 255 is urged in the direction shown at the arrow 347 whereby the developing roller 255 is positioned in a lengthwise position. Incidentally, the urging structure of the developing roller 255 based on such a helical gear corresponds to a biasing device of a claim. There is a tendency that the idle gear 331 is urged in a direction shown at the arrow 349 due to the reaction of such an urge force. As a result, the idle-gear support shaft 333 forcibly presses and deforms the right end face of the housing 243 softened by gear frictional heat or the like.

For this reason, as shown FIG. 34, a pressure dispersing plate 351 is provided as a deformation preventing device, which is in abutment against a right end outer face 330 of the housing 243 at an area sufficiently broader than the section of the support shaft 333. This disperses the stress applied to the idle-gear support shaft 333 to the pressure dispersing plate 351, thereby preventing the right end face 330 of the housing 243 from deforming.

Explaining in greater detail, the idle-gear support shaft 333, at around a center thereof, is integrally formed with a holding part 353 having an increased diameter in a flange form from the support shaft 333, as shown in FIG. 35. The idle gear 331 is rotatably provided outer than the holding part 353. The idle-gear support shaft 333 has a base end penetrating through the right end face of the housing 243 and fixed to the end face 330 by a nut 355. The pressure dispersing plate 351 is structured as one example by a metal plate having a hole the support shaft 333 penetrates, and provided in a manner sandwiched between the holding part 353 and the right end outer face 330 of the housing 243. Due to this, in case a load is applied in a direction shown at the arrow 349 to the idle-gear support shaft 333, the holding part 353 presses the pressure dispersing plate 351. By supporting the pressure dispersing plate 351 on the broad area of the right end face 330 of the housing 243, the end face 330 is prevented from deforming.

The shape and size of the pressure dispersing plate 351 can be properly determined not to deform the right end face 330 of the housing 243, depending on a load applied to the idle-gear support shaft 333. Meanwhile, there is no need to integrally form the holding part 353 with the support shaft 333. A ring-formed holding part 353 may be passed over the conventional support shaft 333 and foxed by a pin or the like. Meanwhile, the pressure dispersing plate 351 can be directly fixed on the support shaft 333 without the use of the holding part 353.

Figure 36:
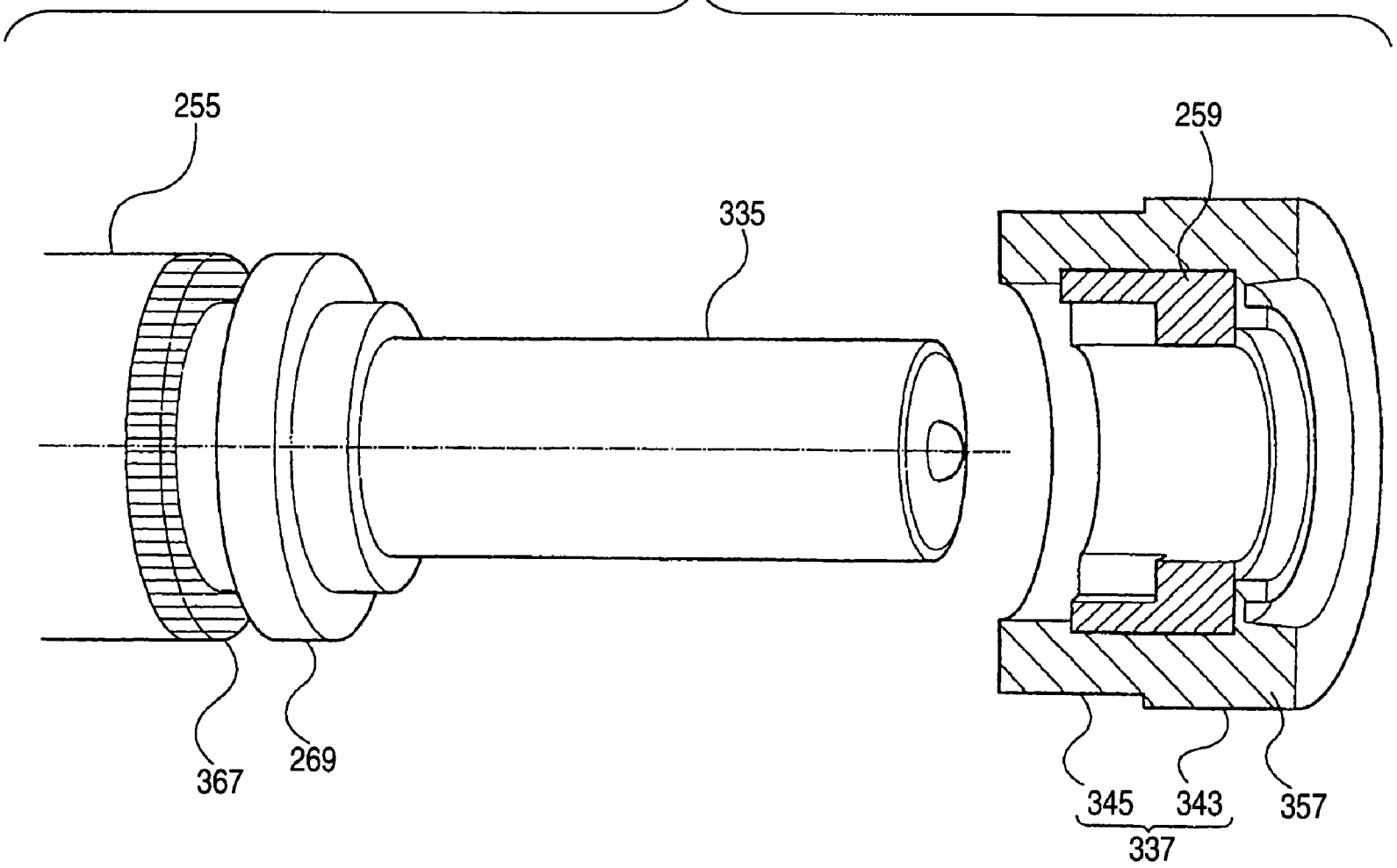
FIG. 36 is a longitudinal sectional view showing the interior of a developing-roller driving gear of this invention.
Figure 37:
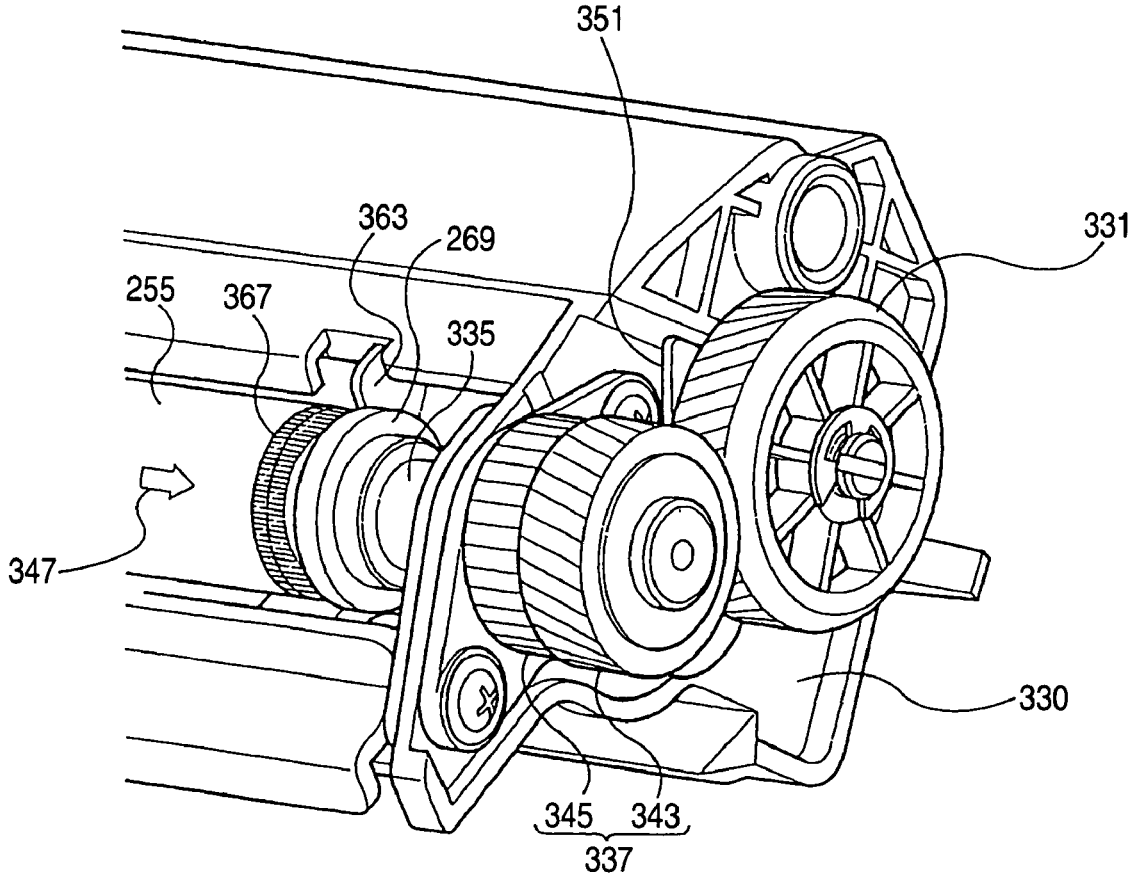
FIG. 37 is a perspective view showing a developing device of the invention by opening the right-side part.
Figure 38:
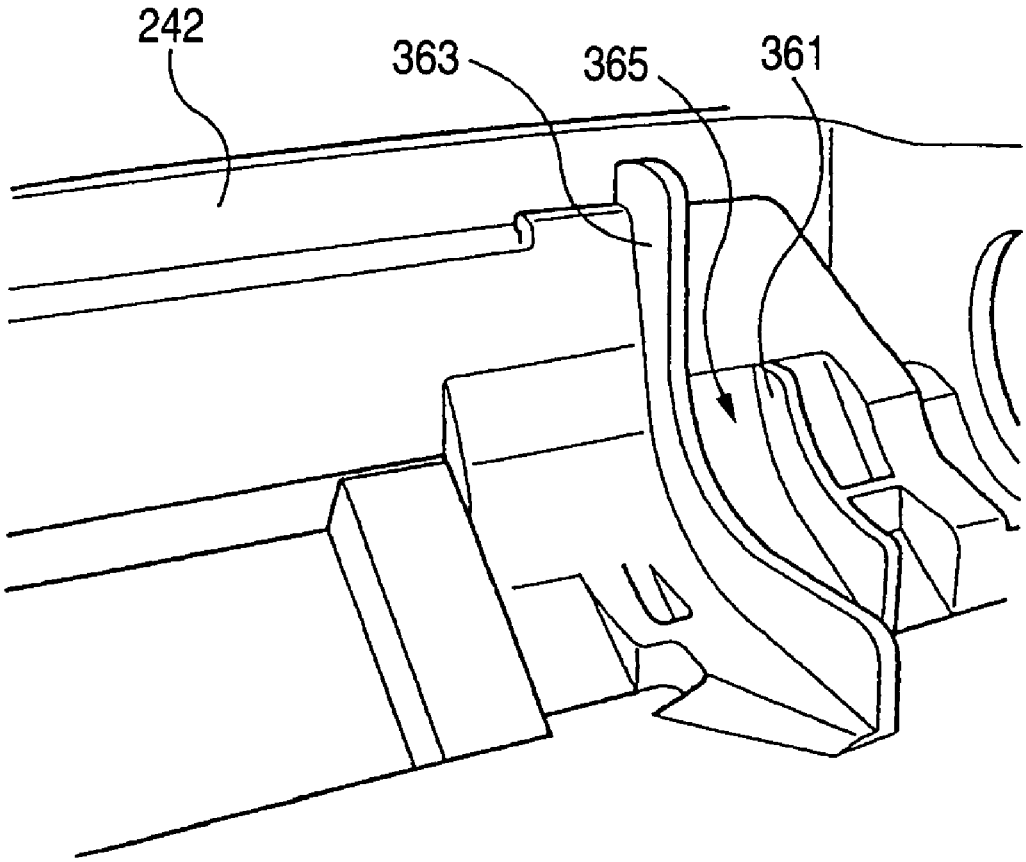
FIG. 38 is a perspective view showing a structure of the end abutment part of the invention.
Figure 39:
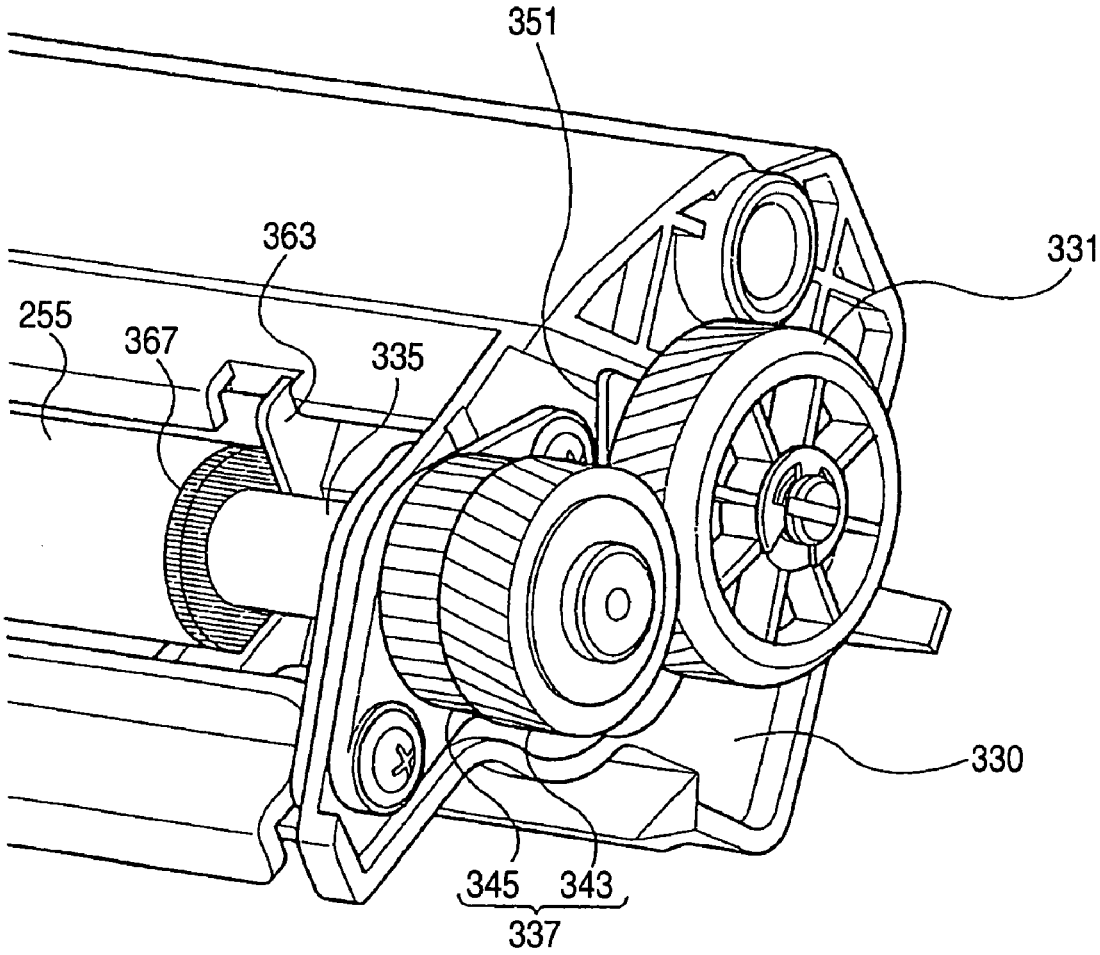
FIG. 39 is a perspective view of a developing roller provided with a low friction member of the invention.
Figure 40:
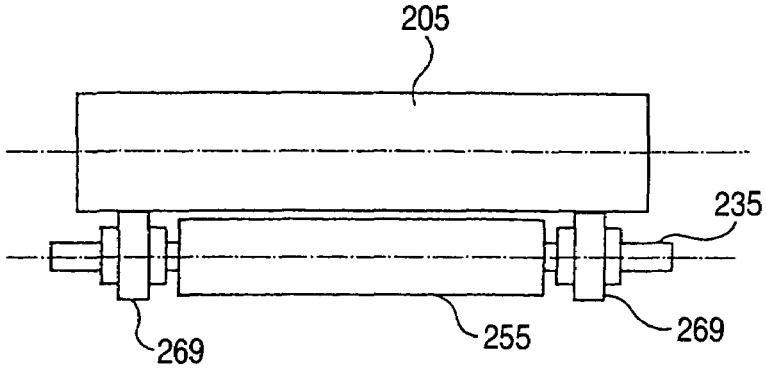
FIG. 40 is a front view showing a relationship between an abutment-regulating roll and a photosensitive drum (photosensitive body of the invention).

Next explained is the peripheral structure of the developing roller 255, with reference to FIGS. 36 to 40. FIG. 36 is a longitudinal sectional view showing the interior of the developing-roller driving gear. FIG. 37 is a perspective view showing a right-side part of the developing cartridge. FIG. 38 is a perspective view showing a structure in the periphery of the low friction member. FIG. 39 is a perspective view showing a state the low friction member is provided on the right end face of the developing roller. FIG. 40 is a front view showing a relationship between an abutment regulating roller and a photosensitive drum.

As shown in FIG. 36, the developing-roller driving gear 337 is structured by an outer part 357 where the foregoing first gear part 343 and second gear part 345 is formed with a step and an inner part 359 supporting the developing-roller rotation shaft 335. The outer part 357 of the developing-roller driving gear 337 is formed of resin while the inner part 359 is formed of sintered metal. The inner part 359 of sintered metal lies astride the first gear part 343 and the second gear part 345. By adopting such a structure, the heat caused in the developing cartridge 212 is conducted the developing-roller rotation shaft 335 and released at the inner part 359 of the developing-roller driving gear 337. Accordingly, it is possible to prevent the developing cartridge 212 from being heated up at the inside excessively.

In the case of forming such a form of developing-roller driving gear, an inner member 359 of sintered metal is prepared. In a state of the inner member 359 of sintered metal is present, an outer member 357 is formed by insert molding. In the conventional method of forming a gear having two gear parts with a step of resin only, a recess called "sink mark" is formed during cooling down after die-molding because of a thickness difference between the two gear parts, to have an effect upon the accuracy of bearing or gear outer edge. However, in this embodiment, an inner member 359 of sintered metal is formed lying astride the first gear part 343 and the second gear part 345, to resin-mold only the outer part 357. Due to this, there is no possibility of causing such "sink mark" in the boundary of the first gear part 343 and the second gear part 345.

Accordingly, accuracy is improved in the bearing part of the developing-roller driving gear 337. This can prevent against chatter in the developing-roller rotation shaft 335. Furthermore, as a result of improved accuracy in the outer edge of the developing-roller driving gear 337, driving the developing roller is stabilized. Also, because of structuring the inner part 359 of a sintered metal, there is a merit the shaft is easily placed in pressure-contact with.

The above structure, that the gear is made in a double layer structure having a metal-make inner member and a resin-make outer member in order to release, at the inner member, the heat in the developing cartridge through the shaft attached on the inner member, can be applied similarly to the supply-roller driving gear 341, the idle gear 331 or the rotary gear 329, besides the developing-roller driving gear 337.

Meanwhile, as shown in FIG. 40, the developing roller 255 has, at both ends of its rotation shaft 335, abutment-regulating rolls 269 having a diameter slightly greater than the developing roller 255, provided for rotation relative to the rotation shaft 335. In FIG. 24, when the rotary development unit 211 rotates and the yellow developing cartridge 212Y, for example, moves towards the photosensitive drum 205, the two abutment-regulating rolls 269 of the developing cartridge 212Y at peripheral surfaces hits on the photosensitive drum 205, to thereby define the distance between the peripheral surface of the developing roller 255 and the peripheral surface of the photosensitive drum to a predetermined distance. Note that the predetermined distance, although depicted comparatively great in FIG. 40, is actually of an extremely small distance of 1 mm or smaller.

As shown in FIG. 38, in a bottom surface of the lower housing member 242, an end abutment structure is formed for determining a movement limit of upon urging the developing roller 255 toward the developing-roller driving gear 337.

Namely, the lower housing member 242 is formed with a support part 361 for supporting the rotation shaft of the developing roller 255 and an end abutment part 363 positioned spaced leftward of the support part 361. Between the support part 361 and the end abutment part 363, a roll receiving part 365 is formed to receive the right abutment-regulating roller 269.

In the left of the end abutment part 363, i.e. on the side close to the developing roller 255, a ring-formed low friction member 367 is provided penetrating the rotation shaft 335 of the developing roller. The low friction member 367 positions in a state sandwiched between the right end face of the developing roller 255 and the end abutment part 363. When the developing roller 255 is rotated by the driving mechanism and the developing roller 255 is urged toward the driving gear by the action of the helical-teethed roller driving gear 337, the developing roller 255 at its right end face is urged on the end abutment part 363 through the low friction member 367.

Consequently, between the end face of developing roller 255 and the low friction member 367 and between the low friction member 367 and the end abutment part 363, there is a reduction in frictional coefficient and hence in frictional heat generation. This can prevent overheat in the developing cartridge 212 and softened deformation of the end abutment part 363 due to overheat. Meanwhile, by preventing the end abutment part 363 from deforming, lengthwise positioning is positively available on the developing roller 255 and, ultimately, positioning is positively available also on the entire developing cartridge 212. Furthermore, because there is no direct frictional contact between the end face of the developing roller 255 and the end abutment part 363, the end face of the developing roller 255 and the end abutment part 363 can be prevented from being worn by rotation of the developing roller 255.

The low friction member 367 includes polyslider (registered trademark), as a concrete example. Besides, the conventionally known materials having a low frictional coefficient and wear resistance can be used as a low frictional member 367.

Figure 41:
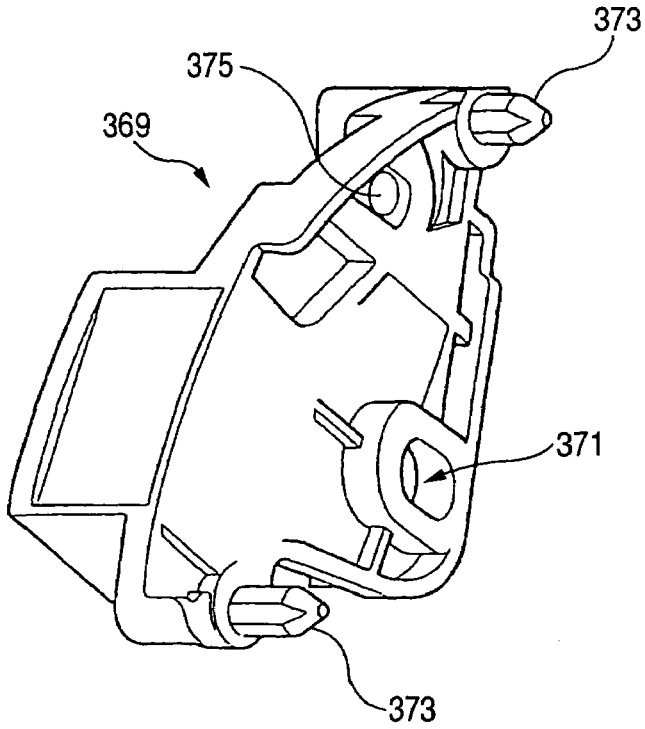
FIG. 41 is a perspective view of an end cover of the invention as viewed from the back.
Figure 42:
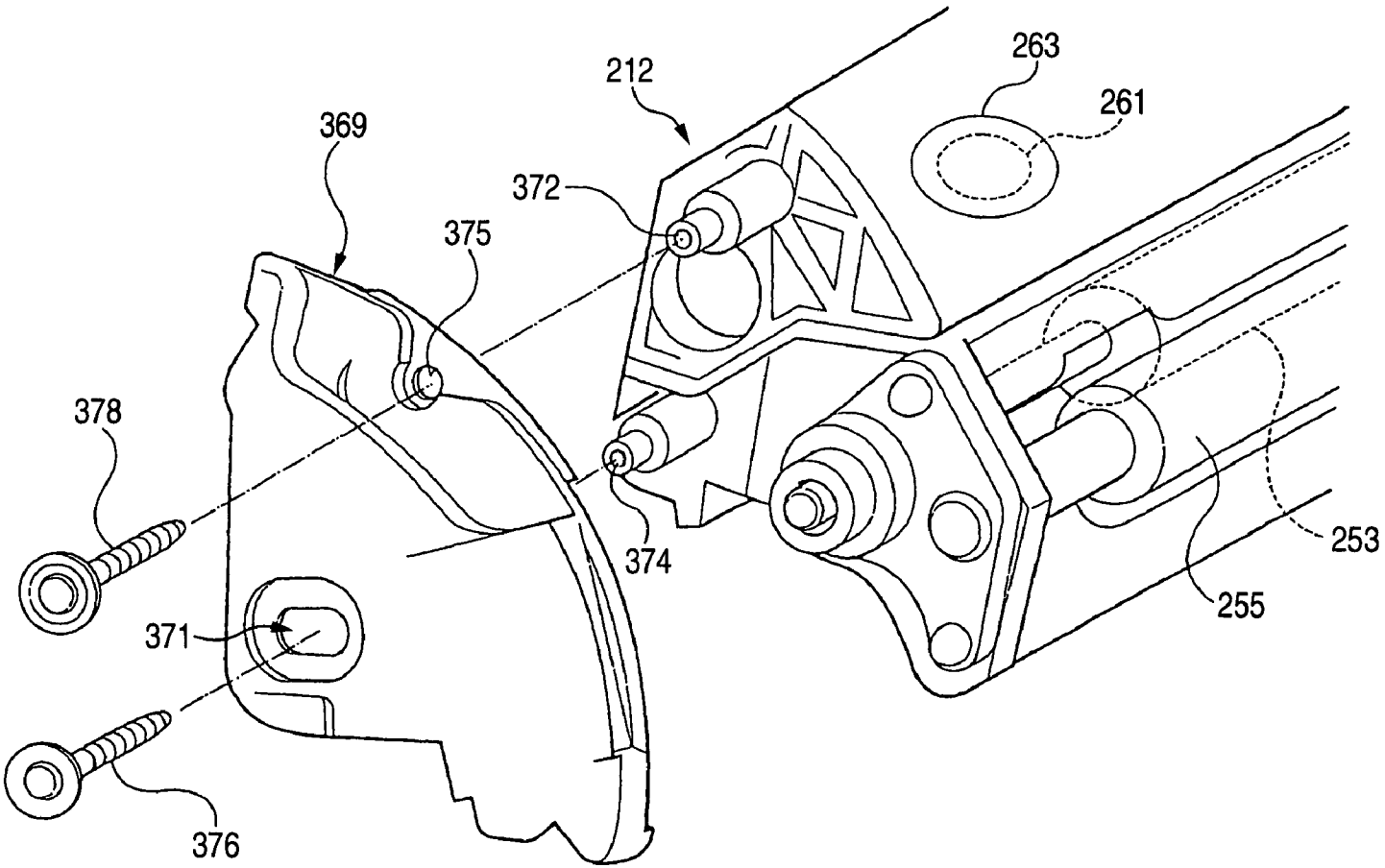
FIG. 42 is an exploded perspective view showing a left-side part of a developing device of the invention.
Figure 43A:
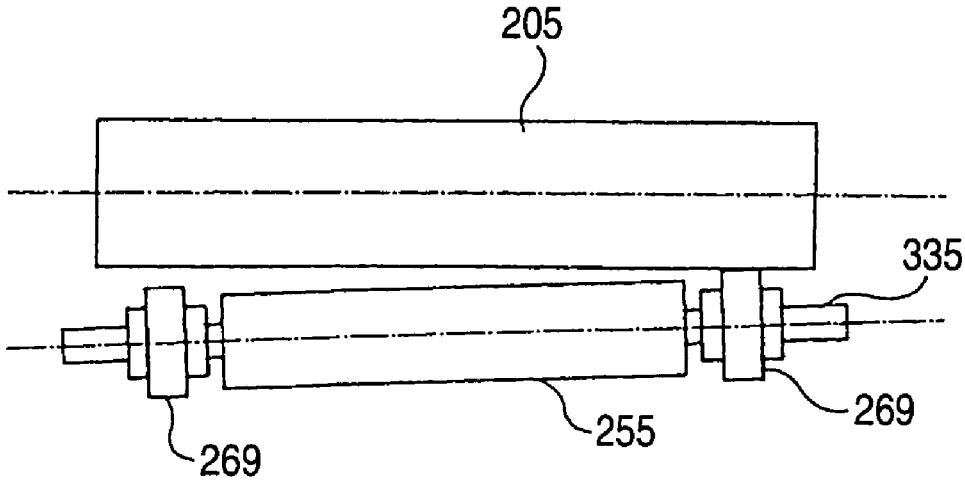
FIGS. 43A and 43B are explanatory views of when the developing roller of the invention approaches the photosensitive drum.
Figure 43B:
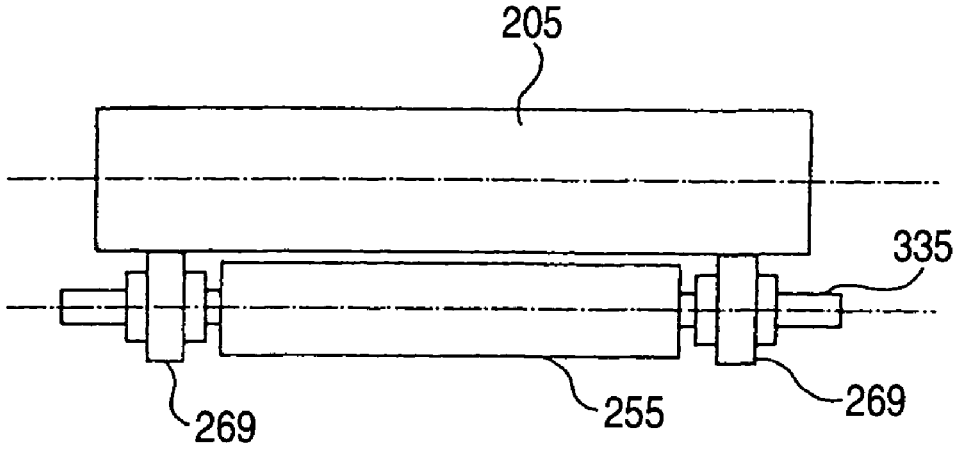

Next explained are the structure of the left end (end opposite to the developing-roller driving gear 337) of the developing cartridge 212 and the operation based upon the structure, with reference to FIGS. 41 to 43A and 43B. FIG. 41 is a perspective view of the left end cover of the developing cartridge as viewed from the backside thereof. FIG. 42 is a perspective view showing a state that the end cover is provided at the left end of the developing cartridge. FIGS. 43A and 43B are an explanatory view showing a state that the developing roller approaches the photosensitive drum during development.

As shown in FIG. 42, the end cover 369 is provided on the left end of the developing cartridge 212. The end cover 369 is formed nearly in a fan shape matched to the left end form of the developing cartridge 212. An elongate hole 371 is formed at around a fan pivot. There are formed two pressure-contact projections 373 (see FIG. 41) projecting toward the developing cartridge 212, close to the respective ends of the fan. Meanwhile, a hole 375 is formed nearby one pressure-contact projection 373.

On the other hand, two screw holes 372, 374 are formed in the left end of the developing cartridge 212. By screwing a screw 376 in the screw hole 374 through the elongate hole and screwing a screw 378 in the screw hole 372 through the hole 375, the end cover 369 is attached on the left end of the developing cartridge 212. The end cover 369 is not firmly fixed by the screws 376, 378. Namely, the screws 376, 378 are provided such that the developing cartridge 212 is allowed to swing about the screw 378 provided to the hole 375 within a range that the screw 376 abuts against the respective ends of the elongate hole 371.

Because this structure allows the developing roller 255 to swing about the right end, when the developing cartridge 212 approaches the photosensitive drum 205 due to rotation of the rotary development unit 211, the developing roller first approaches the photosensitive drum 205 in a state inclined relative thereto by the action of guide means (not shown) such as a cam, as shown in FIG. 43A. Thereafter, as shown in FIG. 43B, it gradually is positioned in parallel with the photosensitive drum 205, as shown in FIG. 43B. By approaching of the developing roller 255 to the photosensitive drum 205 in this way, finally the positional relationship between the developing roller 255 and the photosensitive drum 205 is determined with greater correctness.

Meanwhile, the support frame 235 has end pressure-contact parts 377 formed at respective terminals of the frame elements, as shown in FIG. 25. Inner pressure-contact parts 379 are respectively formed inward of the end pressure-contact parts 377. In the case of loading the developing cartridge 212 in the support frame 235, the developing cartridge 212 in a state placed in the container 237 is slid in a lengthwise direction, to pressure-contact the two pressure-contact projections 373 (FIG. 41) respectively to the end pressure-contact part 377 and the inward pressure-contact part 379. This fixes the developing cartridge 212 on the support frame 235.

Figure 44:
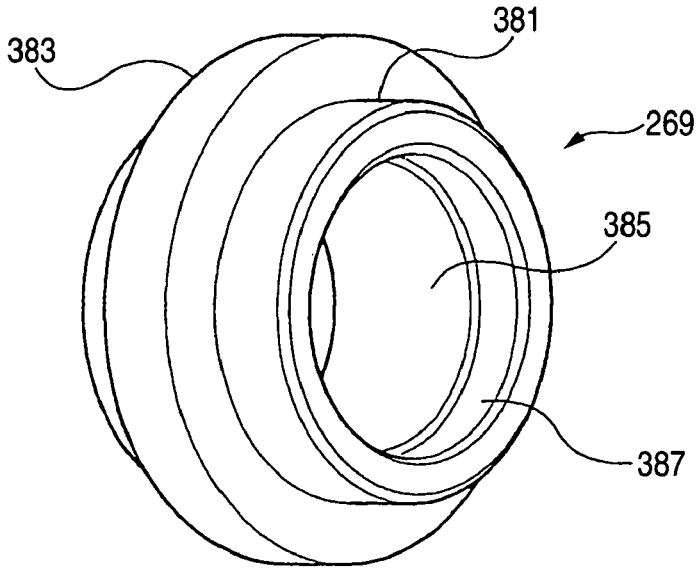
FIG. 44 is an enlarged perspective view of an abutment-regulating roll of the invention.
Figure 45:
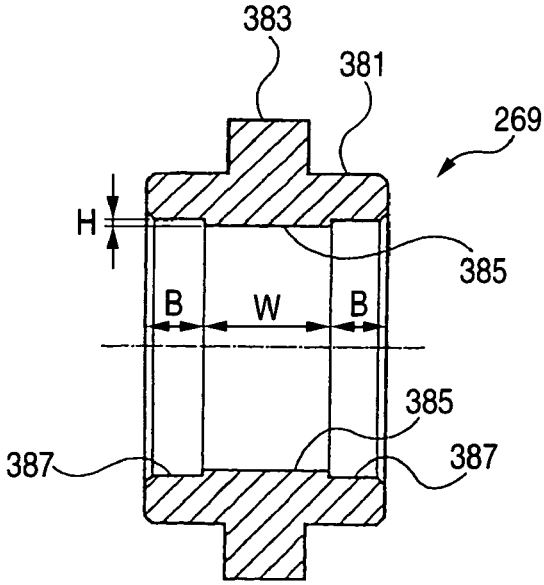
FIG. 45 is a sectional view of an abutment-regulating roll of the invention.
Figure 46A:
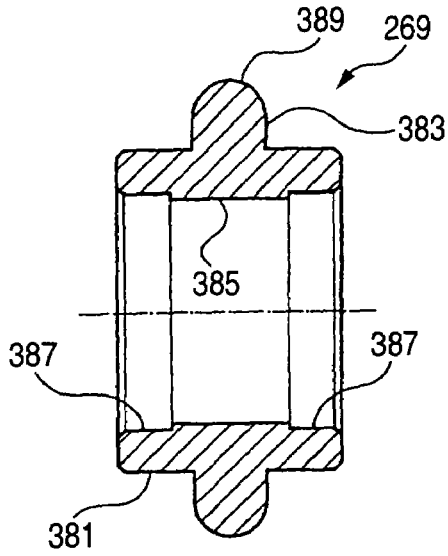
FIGS. 46A and 46B are sectional views showing another embodiment of abutment-regulating roll of the invention.
Figure 46B:
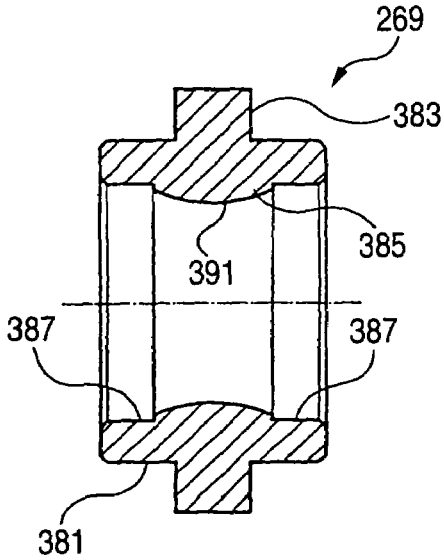

Next explained is the detailed structure of the abutment-regulating roll 269, with reference to FIGS. 44 to 46B. FIG. 44 is a enlarged perspective view of the abutment-regulating roll. FIG. 45 is a longitudinal sectional view of the abutment-regulating roll. FIGS. 46A and 46B are sectional views showing another embodiment of the abutment-regulating roll.

As explained in concerned with FIG. 40, the abutment-regulating rolls 269 are provided for rotation about the rotation shaft 335 of the developing roller. When the rotary development unit 211 rotates, the two abutment-regulating rolls at peripheral surfaces hit on the photosensitive drum 205, to thereby define the distance between the peripheral surface of the developing roller 255 and the peripheral surface of the photosensitive drum 205 to a predetermined distance.

The abutment-regulating roll 269 has a roll main body 381 formed cylindrical, and a roll acting part 383 formed in the center of the roll main body 381 hand having an increasing diameter in a disk form from the outer peripheral surface thereof and formed integral therewith. Meanwhile, an inner projection 385 is formed in the inner peripheral surface of the abutment-regulating roll 269, in a position corresponding to the inner side of the roll acting part 383 and in a manner projecting inward from a central position in a rotation shaft direction.

By adopting such a structure, the developing-roller rotation shaft 335 has a decreased part in slide contact with the abutment-regulating roll 269. The abutment-regulating roll 269 is allowed to easily rotate about the rotation shaft 335.

The inner peripheral surface of the inner projection 385 is a part to substantially support the developing-roller 335. The developing-roller rotation shaft 335 is only in contact with the inner peripheral surface of the inner projection 385 but out of contact with the other inner peripheral surface 387 of the roll main body 381. Because the inner projection 385 is formed inward of the roll acting part 383, when the roll acting part 383 is in abutment against the photosensitive drum 205, the urging force is applied to the inner projection 385. This can be supported by the developing-roller rotation shaft 335.

Meanwhile, because the other inner peripheral surface 387 of the roll main body 381 than the inner projection 385 is structured recessed by one step as viewed from the inner projection 385, when the developing-roller rotation shaft 335 inclines relative to the photosensitive drum 205 as shown in FIG. 43A, a space can be provided to allow the developing-roller rotation shaft 335 to incline at the both sides of the inner projection. Due to this, even in case the developing-roller rotation shaft 335 takes an inclination position in the initial stage the developing roller 255 approaches the photosensitive drum 205 (see FIG. 43A), it is possible to avoid such a situation that the rotation shaft 335 is caught in the inner peripheral surface 387 of the roll main body 381 and not to be released from the situation.

Furthermore, as a result of forming the inner projection 385 to increase the thickness of the relevant part, a "sink mark" is not readily caused which could occur in the process of resin-molding and cooling down the structure the roll acting part 383 projects outward of the roll main body 381. Meanwhile, the inner projection 385 can be formed with higher accuracy because of the diameter is smaller than the other inner periphery and narrower in width.

As shown in FIG. 45, the inner projection 385 has a width W and a height H, to have a size B on the both sides of the inner projection 385 set equal in the inner peripheral surface of the roll main body 381. The width W, height H and size B of the inner projection 385 is set in such dimensions that, in the initial stage the developing roller 255 in a somewhat inclining state approaches the photosensitive drum 205, when it inclines relative to the photosensitive drum 205 as shown in FIG. 43A, the developing-roller rotation shaft 335 is not placed in contact with the inner peripheral surface 387 of the roll main body 381. If showing one example of such dimensions, the width W of the inner projection 385 is 5.0 mm, the height H is 0.3 mm and the size B is 2.2 mm.

Due to the presence of the parts corresponding to the size B on both sides of the inner projection 385 in the inner peripheral surface of the roll main body 381, i.e. the extended parts attached with references 387, well balance is given in respect of the left and right of the inner projection 385. Accordingly, during rotation of the abutment-regulating roll 269, aligning action about the inner projection 385 is improved, making it possible to stably maintain the state that the abutment-regulating roll 269 is in vertical abutment against the photosensitive drum 205, i.e. well-positioned state.

The abutment-regulating roll 269 can be partly modified in shape, as shown in FIGS. 46A and 46B. Namely, in the embodiment shown in FIG. 46A, the roll acting part 383 has a peripheral surface 389 formed arcuate in section in a manner projecting outward. With this form, because the roll acting part 383 and the photosensitive drum 205 has a reduced contact area, the contact resistance decreases to improve the rotatability of the abutment-regulating roll 269. Meanwhile, in the embodiment shown in FIG. 46B, the inner projection 385 has an inner peripheral surface 391 formed arcuate in section in a manner projecting inward. According to this form, because the inner peripheral surface 391 of the inner projection 385 and the developing-roller rotation shaft 335 have a reduced contact area, the contact resistance decreases to improve the rotatability of the abutment-regulating roll 269. Incidentally, in the case that the inner peripheral surface 391 of the inner projection 385 is formed arcuate, the radius of curvature of the inner peripheral surface 391 is set such that, even if the developing-roller rotation shaft 335 inclines, the rotation shaft 335 is not brought into contact with the other inner peripheral surface 387 of the roll main body 381.

Figure 47:
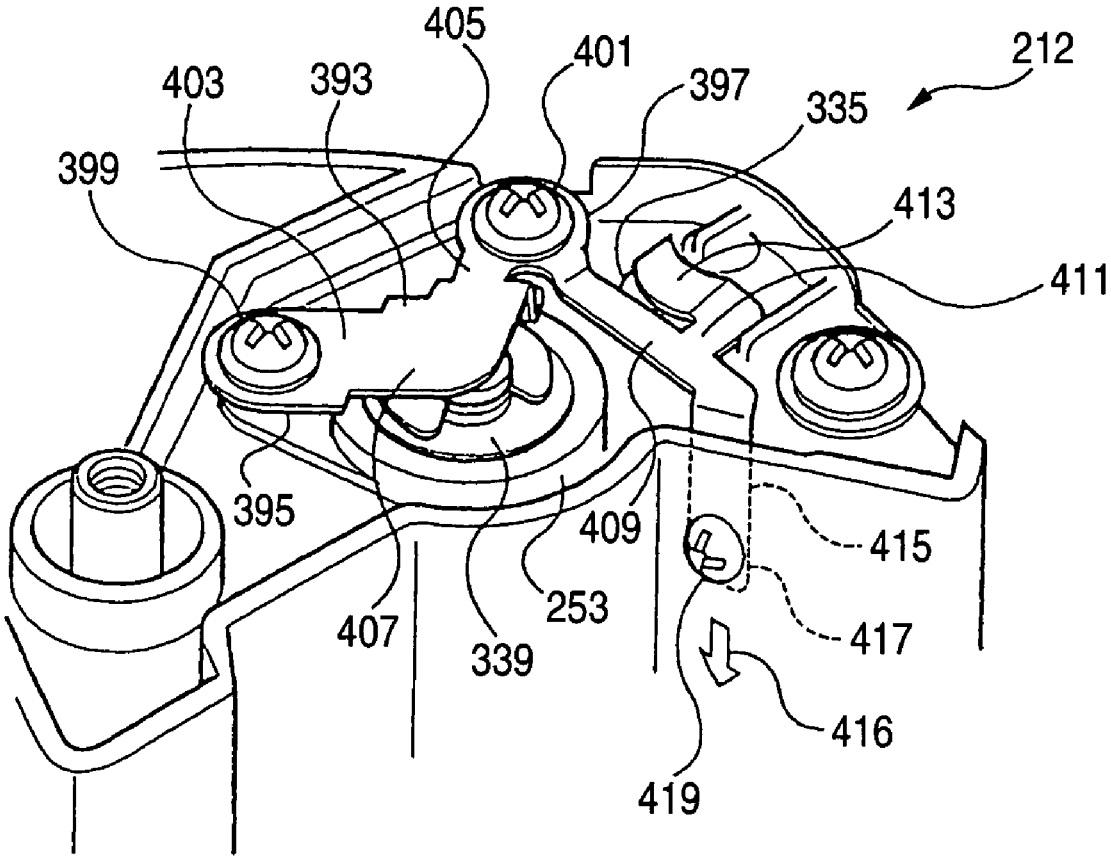
FIG. 47 is a perspective view showing a left-side view of the developing device of the invention.
Figure 48:
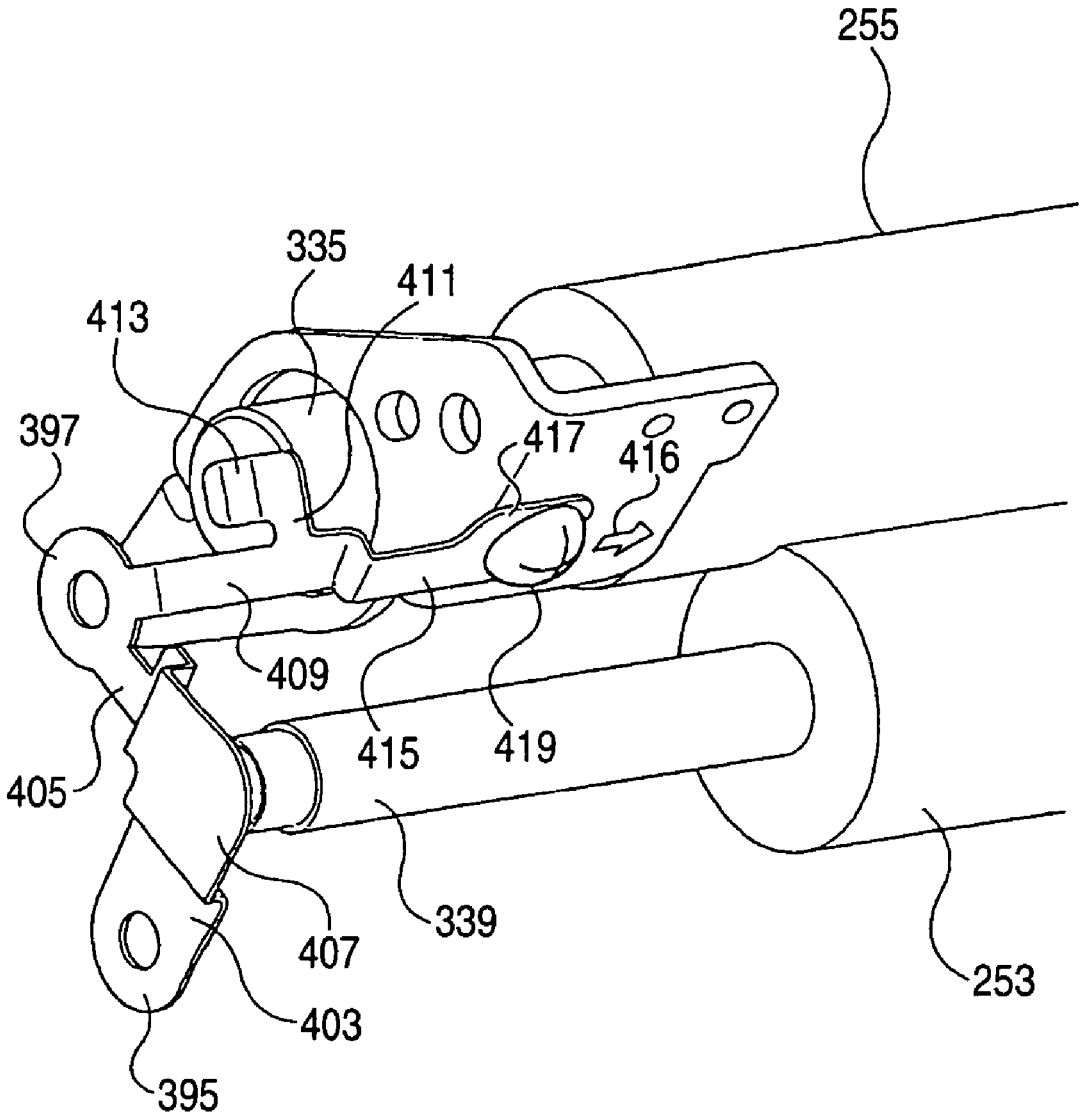
FIG. 48 is a perspective view showing a contact state of a conductor elastic plate of the invention.
Figure 49:
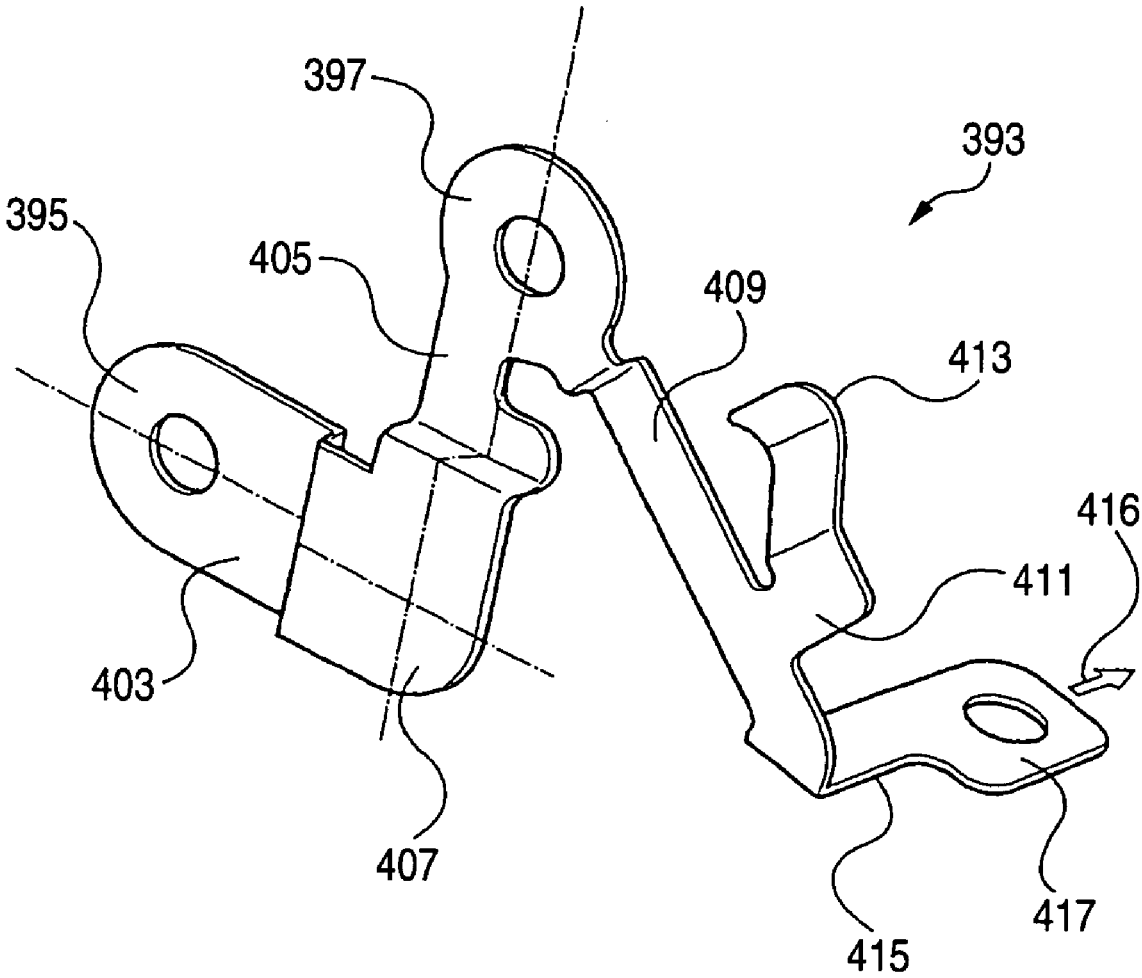
FIG. 49 is a perspective view of the conductor elastic plate of the invention.

Next explained is the structure for applying an charging bias voltage in order to charge the supply roller 253 and developing roller 255. FIG. 47 is a perspective view showing a state that the end cover is removed from the left end of the developing cartridge. FIG. 48 is a perspective view showing a contact state between the supply roller and the developing roller. FIG. 49 is a perspective view of a conductor elastic plate. Note that FIG. 48 omittedly depicts the blade fixing frame 285, the blade support frame 289 and the regulation blade 291.

As mentioned before, the supply roller 253 and developing roller 255 can be charged in order to adsorb toner on the roller peripheral surface. Also, the regulation blade 291 can be charged in order to properly charge the toner to be transported to a developing region. The application voltage for such charge is applied to between one electric terminal connected to a right end of the developing roller 255 and the other electric terminal connected to a right end of the supply roller 253 through the rotation shaft 335 of the developing roller 255, a conductor elastic plate 393 provided at the left end of the developing roller 255, and the rotation shaft 339 of the supply roller 253. Furthermore, from the conductor elastic plate 393, voltage can be applied to the regulation blade 291.

As shown in FIG. 47, the conductor elastic plate 393 is provided inside of the end cover of the developing cartridge 212, to entirely have a stereoscopic structure formed by bending a flat sheet, as shown in FIG. 49. The conductor elastic plate 393 has a first screw fixing part 395 and a second screw fixing part 397 (corresponding to a second fixing part), and fixed to the screw holes formed in the left end face of the housing 243 of the developing cartridge 212 respectively by screws 399, 401. Incidentally, the second screw fixing part 397 corresponds to the second fixing part in the claim and one fixing part.

From the first screw fixing part 395 and the second screw fixing part 397, a first arm 403 and a second arm 405 are respectively formed extending nearly rectangular to each other. The first arm 403 and the second arm 405 intersect together at a first electric contact 407.

The first electric contact 407 is in abutment against the left end of the supply-roller rotation shaft 339.

By thus forming the first electric contact 407 at the intersection of the first arm 403 and the second arm 403 that extend rectangular to each other, the first arm 403 and the second arm 405 act as leaf springs. Thus, the first electric contact 407 can damp the contact pressure as caused by a contact of the first electric contact 407 with the end of the supply-roller rotation shaft 339. Accordingly, in the first screw fixing part 395 and second screw fixing part 397 distant from the first electric contact 407, even if the conductor elastic plate 393 is strongly tightened on the housing 243 by screws 399, 401, there is no substantial increase of a contact pressure of the first electric contact 407 with the end of the supply-roller rotation shaft 339 owing to the leaf-spring damping action of the first arm 403 and second arm 405.

On the other hand, as a result of screwing to the housing 243 by the first screw fixing part 395 and second screw fixing part 397, the conductor elastic plate 393 elastically deforms such that the first electric contact 407 is urged onto the end of the supply-roller rotation shaft 339. Consequently, it is possible to positively maintain the state that the first electric contact 407 is placed in contact at a proper contact pressure with the end of the supply-roller rotation shaft 339.

In this manner, because the first electric contact 407 is allowed to be contacted at a comparatively weak contact pressure with the end of the supply-roller rotation shaft 339, it is possible to prevent against hole opening in the first electric contact resulting from the friction with the first electric contact 407 due to rotation of the supply-roller rotation shaft 339.

In the above embodiment, the first arm 403 and the second arm 405 have an intersection angle of approximately 90 degrees. However, because of delicately changing the contact pressure as caused by a contact of the first electric contact 407 with the supply-roller rotation shaft 339, it is possible to properly change the intersection angle in a range of 30 degree to 150 degrees, preferably in a range of 60 degree to 120 degrees, more preferably in a range of 80 degree to 100 degrees.

The conductor elastic plate 393 has further a third arm 409 integrally extending from the second arm 397. The third arm 409 has an intermediate part having, through a branch arm 411, a part made as a free end connected with a second electric contact 413 in a leaf spring form. The second electric contact 413 has a form curved downward in a convex form as shown in FIG. 49. This curved underside is in contact with the left end of the developing-roller rotation shaft 335, thereby functioning as an electric contact.

Incidentally, in this embodiment, the first arm, the second arm 405, the third arm 409, the branch arm 411, the first electric contact 407 and the second electric contact 413 are in positions nearly on the same plane on the left end face of the developing cartridge 212.

At the opposite end of the third arm 409 to the second screw fixing part 397, a fourth arm 415 is formed bent by 90 degrees therefrom and extending toward the right end of the developing roller 255. The fourth arm 415 has an end formed with a ring-formed third screw fixing part 417 (corresponding to the other fixing part). In the state the fourth arm 415 is somewhat pulled toward the right end of the developing cartridge 212 as shown at the arrow 416, the third screw fixing part 417 is fixed to the lower frame part 277 by a screw 419. Electric conductivity is provided from the lower frame part 277 to the regulation blade 291 (see FIG. 29B) through the blade support plate 289, with a result that the potential applied to the conductor elastic plate 393 causes a charging action on the regulation blade 291. Incidentally, in this embodiment, although the potential applied on the regulation blade 291 is regulated equal to the potential applied to the supply roller 253 and developing roller 255, these potential are not necessarily equal to each other.

By fixing the fourth arm 415 in a state somewhat pulled in the direction shown at the arrow 416, the third arm 409 deflects toward the arrow 416. Due to this, the leaf-spring-formed second electric contact 413 is deflected into abutment against the left end of the developing-roller rotation shaft 335 at a proper contact pressure, which state can be maintained. The second electric contact 413 is formed at the free end branched from the fourth arm 415. Consequently, even when the force pulling toward the arrow 416 is somewhat strong, damp effect is caused by the leaf-spring action of the second electric contact 413. Accordingly, there is no possibility that such a strong contact pressure as forming a hole in the second electric contact 413 be caused on the second electric contact 413 due to wear. Accordingly, it is possible to provide an electric contact stable over a long term.

THIRD EMBODIMENT

Figure 50:
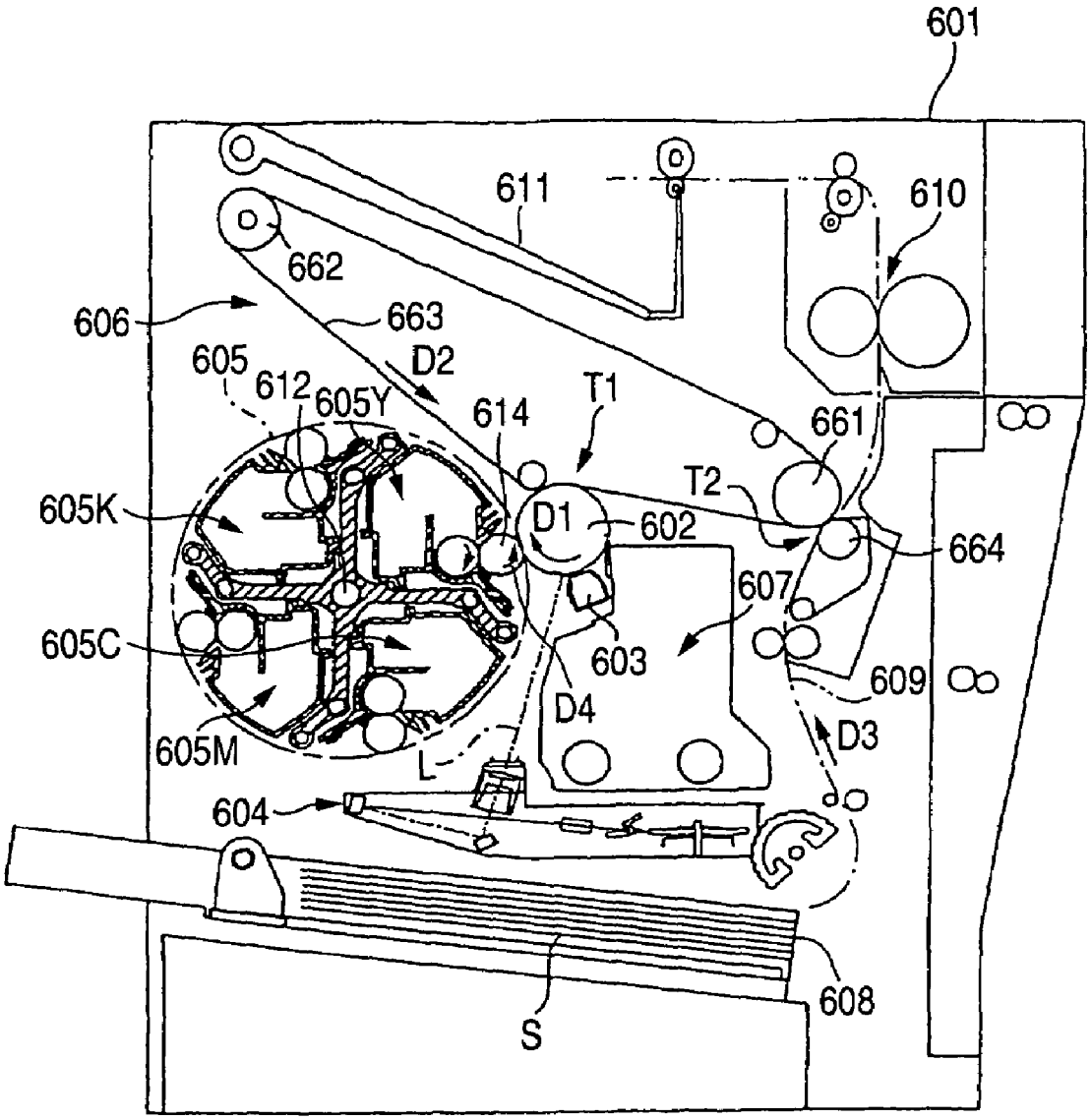
FIG. 50 is a whole constitutional view showing one example of an image forming apparatus to which the invention is applied.

Third embodiment of the invention will be described below with reference to drawings. FIG. 50 is a whole constitutional diagram showing one example of an image forming apparatus to which a developing device of the invention is applied.

In this image forming apparatus, a photosensitive drum 602 served as image carrier is arranged in an apparatus main body 601 and it is driven by a not-shown drive unit in a direction of an arrow D1. Around this photosensitive drum 602, a charging unit 603 for charging the photosensitive drum 602 uniformly, an exposure unit 604, a rotary development unit 605, a transfer unit 606, and a cleaning unit 607 are respectively arranged in the rotational direction D1.

In the rotary development unit 605, a yellow developing device 605Y, a magenta developing device 605M, a cyan developing device 605C and a black developing device 605K are provided rotatably about a rotary shaft 612 by a drive unit (not shown). A developing roller 614 in one of these developing devices 605Y, 605C, 605M, and 605K is selected and rotation-moved in a position close to the photosensitive drum 602, whereby an electrostatic latent image on the photosensitive drum 602 is made visible with the selected toner color.

The developing roller 614 is constituted so as to be held with a predetermined gap between the photosensitive drum 602 and it, and it is rotation-driven in a direction of an arrow D4. Further, a peripheral speed of the developing roller 614 is set higher than the peripheral speed of the photosensitive drum (for example 1.6 times).

The transfer unit 606 includes an intermediate transfer belt 663 laid between a drive roller 661 and a driven roller 662, a drive unit (not shown) for rotation-driving the intermediate transfer belt 663 in a direction of an arrow D2, and a second bias transfer roller 664 which is provided opposed to the drive roller 661 and transfers four full color images formed on the intermediate transfer belt 663 onto a sheet S.

At a bottom of the apparatus main body 601, a sheet supply cassette 608 is arranged, and the sheet S in the sheet supply cassette 608 is transported on a sheet transporting passage 609 in a direction of an arrow D3 through the second bias transfer roller 664 and a fixing unit 610 to a sheet discharge tray 611.

The working of the thus structured image forming apparatus will be described. Upon reception of image forming signals from a not-shown computer, the photosensitive drum 602, the development unit 605, and the intermediate transfer belt 663 rotate and drive. Firstly, an outer surface of the photosensitive drum 602 is uniformly charged by the charging unit 603, the uniformly charged outer surface of the photosensitive drum 602 is selectively exposed to light according to image data of a first color (for example, yellow) by the exposure unit 604, and an electrostatic latent image of yellow is formed.

By the rotation of the yellow developing device 605Y, the developing roller 614 for yellow comes close to the position where the electrostatic latent image is formed on the photosensitive drum 602 and is positioned. By rotation of the developing roller 614, a toner image of the yellow electrostatic latent image is formed on the photosensitive drum 602. Next, the toner image formed on the photosensitive drum 602 is transferred onto the intermediate transfer belt 663 in a first bias transfer region T1. At this time, the second bias transfer roller 663 is separated from the intermediate transfer belt 663.

The above process is performed correspondingly to image forming signals for a second color, a third color, and a fourth color, and latent image formation, development, and transfer are repeated by one rotation of the photosensitive drum 602 and the intermediate transfer belt 663, so that the toner images of four colors according to the image forming signals are multi-layer transferred onto the intermediate transfer belt 663.

At a timing where this full color image reaches the second bias transfer roller 664, the sheet S is supplied from the sheet transporting passage 609 to a second bias transfer region T2. At this time, the second bias transfer roller 664 is pressed on the intermediate transfer belt 663, and a second bias transfer voltage is applied, so that the full color toner image on the intermediate transfer belt 663 is transferred onto the sheet S. The toner image transferred onto this sheet S is heat-pressed by the fixing unit 610 and fixed, and thereafter the sheet S is discharged to the sheet discharge tray 611.

FIRST EXAMPLE

Figure 51A:
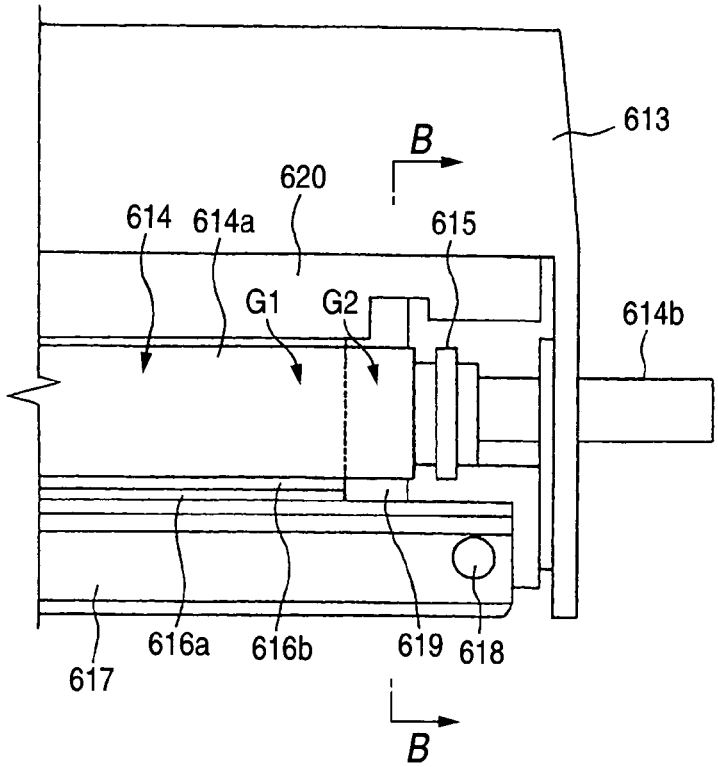
FIGS. 51A and 51B are diagrams for explaining a developing device of FIG. 50.
Figure 51B:
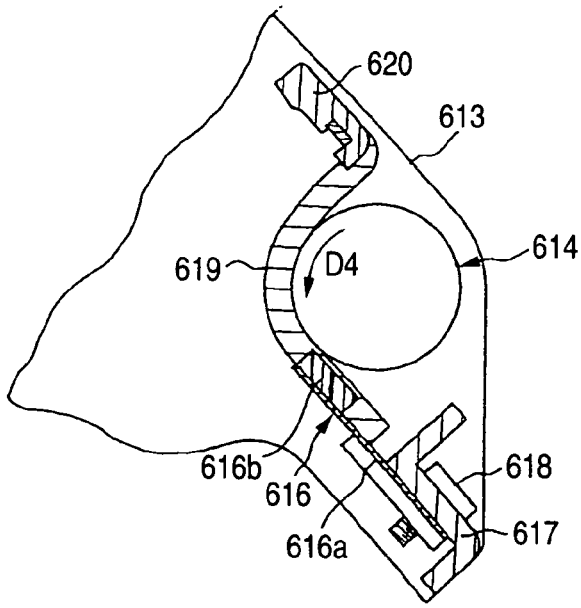

FIGS. 51A and 51B show the developing device 605Y of the developing device in FIG. 50, in which FIG. 51A is a partially front view of a development housing, and FIG. 51B is a sectional view taken along a line B—B of FIG. 51A, viewed in a direction of an arrow. In FIG. 51A, though the developing roller only on one side is shown, it has right and left symmetrical constitution.

In FIGS. 51A and 51B, the developing device includes a development housing 613, and the developing roller 614 is provided rotatably in the development housing 613 and rotation-driven by a not-shown drive source in the direction of the arrow D4. The developing roller 614 includes a roller body 614*a* and rotation shafts 614*b* formed on both sides in the axial direction of the roller body 614*a*. Cylindrical distance keeping members 615 which come into contact with the photosensitive drum 602 and keep the distance between the developing roller 614 and the photosensitive drum 602 are rotatably inserted into and attached to the rotation shafts 614*b* on the both side.

With a development region G1 of the developing roller 614, a toner layer regulation member 616 is brought into contact. This toner layer regulation member 616 comprises a leaf spring 616*a* of which one end is supported at the development housing 613 by a support member 617 and a bolt 618, and a rubber-made regulation blade 616*b* fixed to the other end of the leaf spring 616*a*. The leading end of the regulation blade 616*b* is brought into contact with the developing roller 614 in a counter direction (on the more upstream side in the rotating direction of the developing roller 614 than the support member 617 of the leaf spring 616*a*). Further, the toner layer regulation member 616 may be composed of only the leaf spring or the rubber blade. In this case, the leaf spring 616*a* or the regulation blade 616*b* are replaced with the toner layer regulation member 616 in the following description.

In a non-development region G2 (both ends of developing roller) of the developing roller, 614, a seal member 619 made of soft urethane or felt is arranged to prevent toner around the developing roller in the development region G1 from leaking to the non-development region G2. The upper end of the seal member 619 is supported by a support member 620 fixed to the development housing 613.

The thus constructed developing device has the following problems: The toner leaks from a small gap between the regulation blade 616*b* and the seal member 619, and the toner disperses by centrifugal force caused by rotation of the developing roller 614, so that the inside of the device body is stained. Further, the toner is accumulated at both ends of the developing roller 614, and this accumulated toner is attached onto the photosensitive drum 602 and transferred onto both ends of a sheet.

Figure 52:
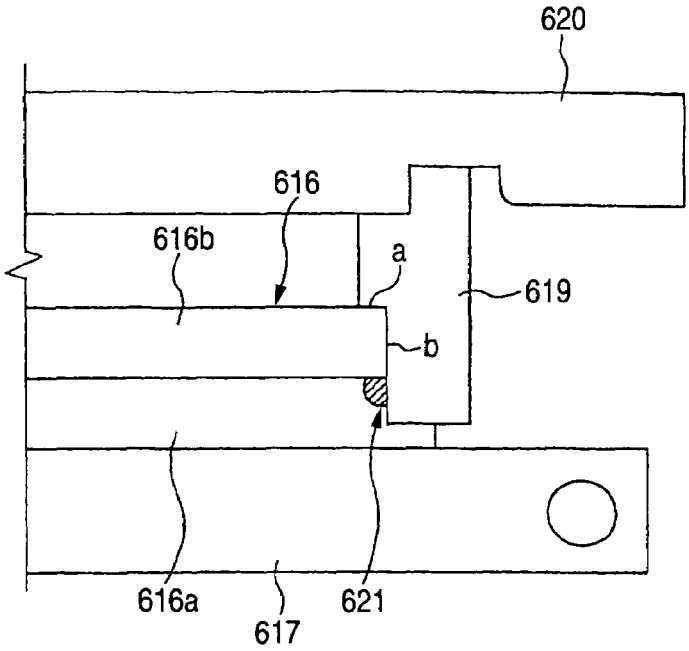
FIG. 52 is a diagram showing a first example according to the third embodiment of the invention.
Figure 53:
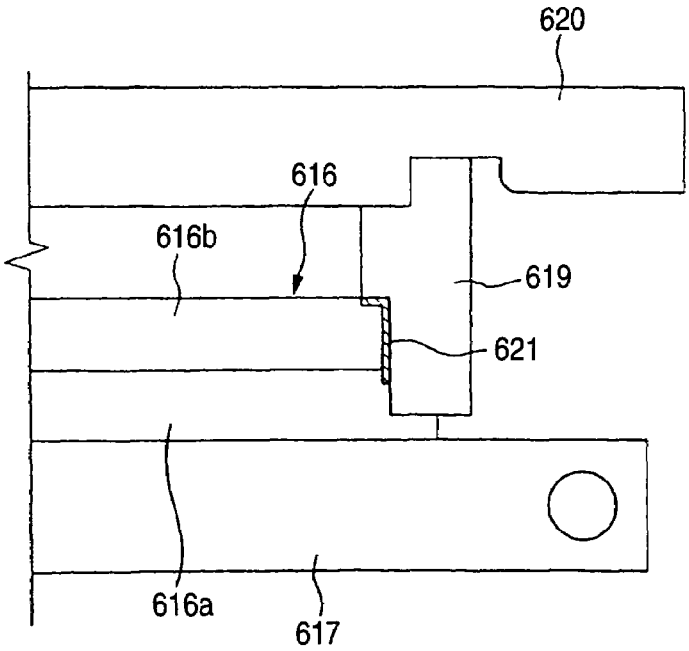
FIG. 53 is a diagram showing a modified example of the first example.

FIGS. 52 and 53 show each mode for carrying out the invention, and they are enlarged front views showing a state where the developing roller 614 is removed in FIGS. 51A and 51B. The seal member 619 seals an end upper surface a of the regulation blade 616*b* and an end side surface b thereof, and is placed on the upper surface of the leaf spring 616*a*.

In the mode shown in FIG. 52, in the gap between the leaf spring 616*a* and the seal member 619, a hard resin adhesive 621 is dropped off and filled to prevent the toner from leaking from the small gap between the regulation blade 616*b* and the seal member 619. The hard resin adhesive 621 is adhesive which becomes hard when it is hardened in a liquid state, and it is preferably UV-curing adhesive which becomes hard by irradiation of UV arrays.

The hard resin adhesive 621 is difficult to be absorbed in the seal member 619 made of the soft urethane or the felt, and it is hardened in the coating state without expanding or contracting. Therefore, it is possible to remove the problem that registration error between the seal member 619 and the regulation blade 616*b* is caused by the expansion or contraction thereby to cause the toner leakage and bad toner transportation. It is not necessary for the hard resin adhesive 621 to seal the entire region of the portion to be sealed (portion from which the toner leaks), and the seal member 619 can be brought close to the regulation blade 616*b* by sealing only a part of its portion.

Figure 54:
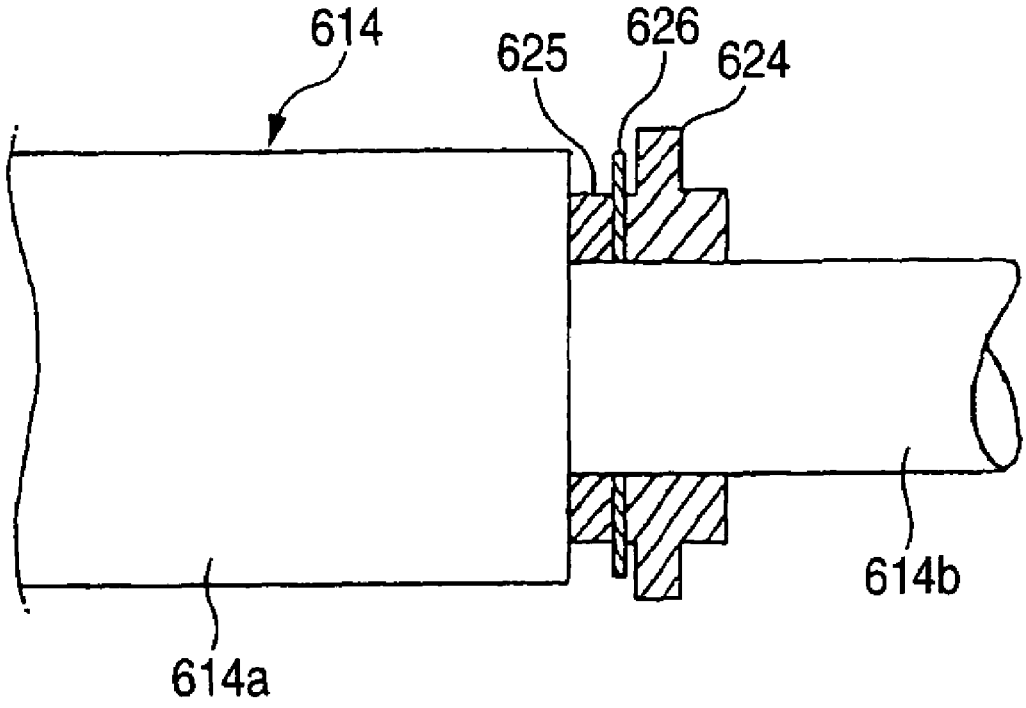
FIG. 54 is a partially sectional view of a developing roller, showing a second example of the developing device according to the third embodiment of the invention.

In a modified example of FIG. 54, in the gap between the leaf spring 616*a* and the regulation blade 616*b*, and the seal member 619, the hard resin adhesive 621 is dropped off and filled to prevent the toner from leaking from the small gap between the regulation blade 616*b* and the seal member 619.

SECOND EXAMPLE

FIG. 54 shows a second example of the developing device of the third embodiment, and FIG. 54 is a partially sectional view of the developing roller 614 of each developing device 605Y, 605C, 605M, 605K in FIG. 50. In FIG. 54, though the developing roller only on one side is shown, it has right and left symmetrical constitution.

In FIG. 54, the developing roller 614 includes a roller body 614*a* and a rotation shaft 614*b* formed on both sides in the axial direction of the roller body 614*a*. Cylindrical distance keeping members 624 which come into contact with the photosensitive drum 602 and keep the distance between the developing roller 614 and the photosensitive drum 602 are rotatably inserted into and attached to the rotation shaft 614*b* on the both sides. This distance keeping member 624 has the diameter which is larger by 0.2 mm than the diameter of the roller body 614*a*, whereby the predetermined gap is kept between the photosensitive drum 602 and the developing roller 614.

Between the rotation shaft 614*b* and the distance keeping member 624, lubricant composed of silicon oil or grease is filled. Hereby, even in a long use, frictional power between the rotation shaft 614*b* and the distance keeping member 624 can be reduced, and sliding performance between them can be improved, so that unevenness in speed of the photosensitive drum 602 can be removed.

In case that the lubricant is filled between the rotation shaft 614*b* and the distance keeping member 624, there is a case that the lubricant flows out and disperses on the surface of the roller body 614*a* or the surface of the photosensitive drum 602. Therefore, a lubricant absorber 625 made of felt is attached between the distance keeping member 624 and the side surface of the roller body 614*a*. Hereby, it is possible to prevent the lubricant that has flown out from dispersing on the surface of the roller body 614*a* or the surface of the photosensitive drum 602.

In this case, when a high sliding resin plate 626 made of fluorocarbon resin is arranged between the distance keeping member 624 and the lubricant absorber 625, the sliding performance between the distance keeping member 624 and the lubricant absorber 615 can be increased.

In case that the developing device of this example is applied to the rotary development unit of FIG. 50, unevenness in speed of the photosensitive drum 602 caused in switching of each developing device can be prevented.

As clear from the above description, according to the seal structure of the invention, there are provided the developing roller, the toner layer regulation member which is brought into contact with the developing roller, and the seal members which are provided at the both ends of the developing roller, and the hard resin adhesive is filled in the gap between the toner layer regulation member and the seal member. Therefore, the toner leakage from the both ends of the developing roller and the toner dispersion can be prevented with the simple constitution and at a low cost.

As clear from the above description, according to the invention, in the developing device having the developing roller with the predetermined gap from the photosensitive drum, it is possible to reduce the frictional power between the distance keeping member and the developing roller, and remove the unevenness in speed of the photosensitive drum.

What is claimed is:

1. A developing device comprising:

a developer carrier for carrying a developer, including an opposing region that opposes a latent image-carryable region on an image carrier, and a solid portion that is solid at an end portion of the developer carrier in a longitudinal direction thereof, wherein the developing device develops a latent image carried in the latent image-carryable region with the developer carried on the developer carrier, and an end of the solid portion, which is on a side of a center of the developer carrier in the longitudinal direction, is located closer to the center of the developer carrier than an edge of the opposing region;

wherein the developing device develops the latent image carried in the latent image-carryable region with the developer carried on the developer carrier, in a state that the developer carrier and the image carrier are not in contact with each other, and a deflection amount of the developer carrier at an end portion of the developer carrier in a longitudinal direction thereof is smaller than a deflection amount at a center of the developer carrier in the longitudinal direction.

2. The developing device according to claim 1, further comprising an abutment member that abuts against the developer carrier along the longitudinal direction of the developer carrier, wherein the developer carrier is supported at both ends in the longitudinal direction thereof so that the developer carrier is abutted with the abutment member along the longitudinal direction of the developer carrier.

3. The developing device according to claim 2, wherein the abutment member presses the developer carrier towards the image carrier.

4. The developing device according to claim 2, wherein the abutment member is a developer supply member for supplying the developer to the developer carrier.

5. The developing device according to claim 2, wherein the abutment member is a layer thickness regulating member for regulating a layer thickness of the developer carried on the developer earner.

6. The developing device according to claim 1, wherein the developer carrier is made of metal.

7. The developing device according to claim 1, wherein the latent image carried on the image carrier is developed with the developer using a jumping development format.

8. A developing device comprising:

a developer carrier for carrying a developer, including an opposing region that opposes a latent image-carryable region on an image carrier, and a solid portion that is solid at an end portion of the developer carrier in a longitudinal direction thereof, wherein the developing device develops a latent image carried in the latent image-carryable region with the developer carried on the developer carrier, and an end of the solid portion, which is on a side of a center of the developer carrier in the longitudinal direction, is located closer to the center of the developer carrier than an edge of the opposing region;

wherein the developing device develops the latent image carried in the latent image-carryable region with the developer carried on the developer carrier in a state that the developer carrier and the image carrier are not in contact with each other;

wherein a deflection amount of the developer carrier at an end portion of the developer carrier in a longitudinal direction thereof is smaller than a deflection amount at a center of the developing carrier in the longitudinal direction;

wherein the developing device further includes an abutment member that abuts against the developer carrier along the longitudinal direction of the developer carrier, and the developer carrier is supported at both ends in the longitudinal direction thereof so that the developer carrier is abutted with the abutment member along the longitudinal direction of the developer carrier;

wherein the abutment member presses the developer carrier towards the image carrier;

wherein the abutment member is a developer supply member for supplying the developer to the developer carrier;

wherein the developer carrier is made of metal; and wherein the latent image carried on the image carrier is developed with the developer using a jumping development format.

9. A developer carrier for carrying a developer, the developer carrier comprising:

an opposing region that opposes a latent image-carryable region on an image carrier, and a solid portion that is solid at an end portion of the developer carrier in a longitudinal direction thereof;

wherein an end of the solid portion, which is on a side of a center of the developer carrier in the longitudinal direction, is located closer to the center of the developer carrier than an edge of the opposing region;

wherein the developer carrier carries a developer for developing a latent image carried on an image carrier in a state that the developer carrier and the image carrier are not in contact with each other, and wherein the deflection amount of the developer carrier at an end portion of the developer carrier in a longitudinal direction thereof is smaller than a deflection amount at a center of the developing carrier in the longitudinal direction.

10. An image forming apparatus comprising a developing device including:

an image carrier for carrying a latent image, and a developer carrier for carrying a developer, the developer carrier including an opposing region that opposes a latent image-carryable region on the image carrier and a solid portion that is solid at an end portion of the developer carrier in a longitudinal direction thereof, wherein the developing device develops a latent image carried in the latent image-carryable region with the developer carried on the developer carrier, and an end of the solid portion, which is on a side of a center of the developer carrier in the longitudinal direction, is located closer to the center of the developer carrier than an edge of the opposing region;

wherein the developing device develops the latent image carried in the latent image-carryable region with the developer carried on the developer carrier in a state that the developer carrier and the image carrier are not in contact with each other, and wherein a deflection amount of the developer carrier at an end portion of the developer carrier in a longitudinal direction thereof is smaller than a deflection amount at a center of the developer carrier in the longitudinal direction.

11. A computer system comprising:

a computer mainframe;

a display device connectable to the computer mainframe and an image forming apparatus connectable to the computer mainframe, the image forming apparatus comprising a developing device including:

an image carrier for carrying a latent image, and a developer carrier for carrying a developer, the developer carrier including an opposing region that opposes a latent image-carryable region on the image carrier and a solid portion that is solid at an end portion of the developer carrier in a longitudinal direction thereof, wherein the developing device develops a latent image carried in the latent image-carryable region with the developer carried on the developer carrier, and an end of the solid portion, which is on a side of a center of the developer carrier in the longitudinal direction, is located closer to the center of the developer carrier than an edge of the opposing region;

wherein the developing device develops the latent image carried in the latent image-carryable region with the developer carried on the developer carrier in a state that the developer carrier and the image carrier are not in contact with each other, and wherein a deflection amount of the developer carrier at an end portion of the developer carrier in a longitudinal direction thereof is smaller than a deflection amount at a center of the developer carrier in the longitudinal direction.

* * * * *